US005765533A

United States Patent [19]

Nakajima

[11] Patent Number: 5,765,533

[45] Date of Patent: Jun. 16, 1998

[54] ENGINE AIR-FUEL RATIO CONTROLLER

[75] Inventor: Yuki Nakajima, Yokosuka, Japan

[73] Assignee: Nissan Motor Co., Ltd., Kanagawa, Japan

[21] Appl. No.: 840,471

[22] Filed: Apr. 18, 1997

[30] Foreign Application Priority Data

| | | | |
|---|---|---|---|
| Jul. 2, 1996 | [JP] | Japan | 8-172361 |
| Jul. 3, 1996 | [JP] | Japan | 8-173802 |
| Mar. 18, 1997 | [JP] | Japan | 9-064391 |
| Apr. 18, 1997 | [JP] | Japan | 8-096854 |

[51] Int. Cl.[6] ..... F02M 51/00

[52] U.S. Cl. ..... 123/492

[58] Field of Search ..... 123/492, 491, 123/435, 480, 493; 364/431.051, 431.04

[56] References Cited

U.S. PATENT DOCUMENTS

| | | | |
|---|---|---|---|
| 5,584,277 | 12/1996 | Chen et al. | 123/492 |
| 5,609,139 | 3/1997 | Ueda et al. | 123/492 |
| 5,629,853 | 5/1997 | Ogawa et al. | 364/431.051 |
| 5,647,324 | 7/1997 | Nakajima | 123/491 |

FOREIGN PATENT DOCUMENTS

| | | | |
|---|---|---|---|
| 1-305142 | 12/1989 | Japan | 123/492 |
| 1-305144 | 12/1989 | Japan | 123/492 |
| 3-111639 | 5/1991 | Japan | 123/492 |
| 3-111642 | 5/1991 | Japan | 123/492 |
| 3-134237 | 6/1991 | Japan | 123/492 |
| 8-246920 | 9/1996 | Japan | 123/492 |

*Primary Examiner*—Raymond A. Nelli
*Attorney, Agent, or Firm*—McDermott, Will & Emery

[57] ABSTRACT

In engine feedback control, a target air-fuel ratio corresponding amount is computed according to engine running conditions. A steady state deposition amount is also computed according to the target air-fuel ratio corresponding amount and engine running conditions. A difference between the steady state deposition amount and the deposition amount at that time is calculated, and a deposition rate is computed based on a quantity proportion. A basic injection amount is corrected by the target air-fuel ratio corresponding amount, and this corrected value is again corrected by the deposition rate so as to calculate a final injection amount. As the steady state deposition amount varies according to the target air-fuel ratio corresponding amount according to this invention, overrichness or overleanness due to insufficiency of the transient correction amount when the target air-fuel ratio corresponding amount is changed, is prevented.

25 Claims, 52 Drawing Sheets

Tw
Twf
START-UP

TVO

A/F
HESITATION DUE TO LEAN A/F
DUE TO DECREASING
CORRECTION OF Kathos

Mfh
Mf

LARGE DECREASING
CORRECTION OF Kathos
Kathos
0

Tp · Tfbya
TIME

Tw
Twf
START-UP

TVO
CORRECTION ONLY BY CORRECTION FACTOR

A/F
A/F BECOMES FLAT BY DECREASING Kathos AND INCREASING Tfbya
Mfh INCREASE AMOUNT DUE TO INCREASE OF Kub AT NON-STEADY STATE TEMP.
Mfh Mf
Kathos DECREASING CORRECTION AMOUNT IS SMALL Kathos
0
INCREASE OF STEADY STATE CORRECTION PART Tp · Tfbya
CORRECTION ONLY BY CORRECTION FACTOR
TIME

ENGINE AIR-FUEL RATIO CONTROLLER

FIELD OF THE INVENTION

This invention relates to air-fuel ratio control of an engine, and more specifically, to a wall flow correction of air-fuel ratio.

BACKGROUND OF THE INVENTION

An air-fuel ratio of a fuel injection type vehicle engine easily tends to deviate from a target value due to a quantitative variation of fuel wall flow during acceleration and deceleration.

Wall flow refers to a phenomenon where fuel injected from a fuel injection valve deposits on an intake manifold and intake port, and enters a cylinder of the engine as a liquid flowing on a wall surface.

Tokkai-Hei 1-305142 published by the Japanese Patent Office in 1989 discloses an air-fuel ratio controller which corrects for excess or deficiency of fuel due to this wall flow as a transient correction amount Kathos.

This controller comprises maps which establish a steady state deposition amount Mfh and quantity proportion Kmf based on engine load, engine rotation speed Ne and cooling water temperature Tw.

The steady state deposition amount Mfh and quantity proportion Kmf are found from these maps based on engine load, engine rotation speed Ne and predicted temperature value Tf of a fuel deposited part.

Herein, a deposition amount Mf is the quantity of fuel depositing on the intake manifold and intake port.

The steady state deposition amount Mfh is the amount of fuel depositing in a steady engine running state determined by the engine rotation speed and the temperature of the fuel deposited part.

The quantity proportion Kmf is a coefficient showing the extent to which the difference (Mfh–Mf) between the steady state deposition amount Mfh and the deposition amount Mf at present is reflected in the correction of the fuel injection amount.

The aforesaid device calculates a fuel deposition amount Vmf per fuel injection from an expression using these values. This deposition amount per injection is referred to as an deposition rate. A basic injection pulse width Tp of a fuel injection valve is corrected based on this deposition rate Vmf.

The deposition amount Mf is a predicted parameter calculated cyclically as an integral value of Vmf for each fuel injection.

When the steady state deposition amount Mfh changes, the deposition amount Mf follows Mfh with a first order delay.

Tokkai-Hei 8-246920 published by the Japanese Patent Office in 1996 discloses that a fuel injection pulse width Ti equivalent to a fuel injection amount of the fuel injection valve is determined by the following expression.

$$Ti=(Tp+Kathos)\cdot Tfbya\cdot\alpha+Ts \quad (71)$$

where,

Kathos=transient correction amount to compensate the wall flow variation in a transient engine running state, Ti=fuel injection pulse width corresponding to the fuel injection amount of the fuel injection valve, Tfbya=target air-fuel ratio coefficient α=air-fuel ratio feedback correction coefficient, and Ts=ineffectual injection pulse width.

This device satisfies various fuel injection control needs. For example, the stability of the engine during a cold start is improved by changing the target air-fuel ratio coefficient Tfbya to various values according to the engine running conditions, power demands are met when the engine is under heavy load, and the device may also be applied to lean burn engines.

The target air-fuel ratio coefficient Tfbya is a value centered on 1.0. When it is greater than 1.0, the air-fuel ratio is rich, and when it is less than 1.0, the air-fuel ratio is lean. For example, when the engine is in an idle state immediately after a cold start, engine stability is enhanced by making the target air-fuel ratio coefficient Tfbya higher than 1.0, and the air-fuel ratio richer. Also after warmup is complete, the vehicle is driven with the air-fuel ratio on the rich side by maintaining the target air-fuel ratio coefficient Tfbya higher than 1.0.

On the other hand, under lean burn conditions, the target air-fuel ratio coefficient Tfbya is made smaller than 1.0 and the vehicle is driven with a lean air-fuel ratio so as to suppress fuel consumption.

In this way, the target air-fuel ratio coefficient Tfbya is changed according to a change of engine running condition. Maximum engine output power is obtained at an air-fuel ratio richer than the stoichiometric air-fuel ratio, the target air-fuel ratio coefficient Tfbya being 1.2.

When the accelerator pedal is depressed, the engine is driven in this power-oriented air-fuel ratio range. When the vehicle decelerates from this power-oriented air-fuel ratio range, Tfbya may change for example from 1.2 to 1.0. The inventor found that in this case, a deficiency appears in the transient correction amount Kathos so that the air-fuel ratio temporarily becomes overlean. Herein, the transient correction amount Kathos is a negative value, and if Kathos were deficient, this would mean that its absolute value were small.

In this case, Kathos is deficient as shown by the broken line of FIG. 17D, so the air-fuel ratio (abbreviated as A/F in the figure) is temporarily overrich as shown by FIG. 17E, and a delay also occurs in changing over to the stoichiometric air-fuel ratio.

From analysis, the steady state deposition amount Mfh was found to be effectively in direct proportion to the target air-fuel ratio coefficient Tfbya. The required value of Mfh therefore changes abruptly from a value corresponding to Tfbya=1.2 to a value corresponding to Tfbya=1.0 as shown by the double dotted line of FIG. 17C.

The required value of the deposition amount Mf should converge with a first order delay as shown by the single dotted line in the figure.

Accordingly, the required value of Kathos calculated from the difference of the required value of Mfh and the required value of Mf varies as shown by the solid line of FIG. 17D.

On the other hand, in computing Kathos in the above equation (71), the steady state deposition amount Mfh and quantity proportion Kmf are found using data for Tfbya=1.0, i.e. the stoichiometric air-fuel ratio, hence Mfh varies as shown by the double dotted line of FIG. 7C, and the deposition amount Mf varies as shown by the broken line in the figure. As a result, Kathos becomes smaller than required value of Kathos as shown by the broken line of FIG. 17D.

In this case, "smaller" means a value nearer to 0.

In other words, as the deceleration correction amount of the fuel injection amount due to Kathos is less than what is required, the air-fuel ratio becomes overrich.

Similarly, the transient correction amount Kathos is also deficient when Tfbya changes to a larger value as when the vehicle accelerates from the lean burn region, for example. In this case, Kathos takes a positive value, so the air-fuel ratio becomes overlean.

However, Tokkai-Hei 1-305144 published in 1989 and Tokkai-Hei 3-111639 published in 1991 by the Japanese Patent Office, disclose introduction of a cylinder-specific wall flow correction amount Chosn into the air-fuel ratio correction in addition to the transient correction amount Kathos. Wall flow fuel may be divided into a low frequency component having a comparatively slow response wherein the proportion flowing directly into the cylinder directly is small, and a high frequency component having a comparatively fast response wherein the proportion flowing directly into the cylinder is high. Kathos is a wall flow correction for the low frequency component, and it may be applied to all cylinders. On the other hand, Chosn addresses the high frequency component and is calculated separately for each cylinder.

In other words, proper correction for the high frequency component which has a fast response cannot be made with Kathos alone, and Chosn is therefore used to correct for the high frequency component.

In this case, a cylinder-specific wall flow correction Chosn is calculated using $\Delta Avtp_n$, which is a variation of a pulse width Avtp equivalent to the fuel injection amount corresponding to the cylinder intake air volume from the immediately preceding injection.

For example, during acceleration when Avtp is increasing, Chosn is calculated by the following expression.

$$Chosn=\Delta Avtp_n \cdot Gztwp \quad (72)$$

where, Gztwp=increase amount gain.

During deceleration when Avtp is decreasing, Chosn is calculated by the following expression.

$$Chosn=\Delta Avtp_n \cdot Gztwm \quad (73)$$

where, Gztwm=decrease amount gain.

A wall flow correction for the high frequency component is performed by adding the cylinder-specific wall flow correction Chosn to the fuel injection pulse width. The increase amount gain Gztwp of expression (72) and decrease amount gain Gztwm of expression (73) are coefficients for applying a water temperature correction.

"n" which is added as a suffix in the above Chosn, $\Delta Avtp_n$ and Tin indicates the cylinder number.

However, as the cylinder-specific wall flow correction Chosn is also computed using data for Tfbya=1.0, i.e. for the stoichiometric air-fuel ratio, a deficiency arises in Chosn when Tfbya changes such as when the vehicle decelerates from the output air-fuel ratio, and a temporary overrich easily occurs.

Conversely, a temporary overlean easily occurs during acceleration.

Mfh and Kmf mentioned above are determined according to the intake valve temperature Tf which is predicted based on the cooling water temperature Tw. Tokkai-Hei 3-134237 published by the Japanese Patent Office in 1991, further discloses use of a wall flow corrected temperature Twf which converges with a first order delay toward the cooling water temperature Tw from a temperature lower than the cooling water temperature Tw by a predetermined value during startup, instead of the intake valve temperature Tf.

This determination is made by arranging the cooling water temperature Tw to be constant, and allowing the intake valve temperature to reach a temperature higher than the cooling water temperature Tw by a predetermined value, i.e. a steady state temperature. This is because it is actually impossible to set Mfh and Kmf in a non-steady state. Therefore, when Mfh, Kmf are found using the wall flow corrected temperature Twf instead of the cooling water temperature Tw, the temperature must be a steady state temperature.

However as disclosed in the above-mentioned Tokkai-Hei 3-34237, if the wall flow corrected temperature Twf is merely used instead of the cooling water temperature Tw for the calculation of Mfh and Kmf based on the cooling water temperature in the steady state, non-steady temperature states can only be handled in a rough estimation.

This for example corresponds to considering that a steady state where the cooling water temperature Tw is 40° C., and a non-steady state where Twf is 40° C., are the same. For this reason, immediately after startup where the wall flow correction temperature Twf is continuously in a non-steady state, errors occur in the air-fuel ratio.

Also although nearly all of the fuel provided to the engine is used for combustion, a part of it is expelled as unburnt HC and leaks to the crank case via a gap between the cylinder and piston ring. This unburnt part cannot be used for combustion. According to the inventor's study, this unburnt fraction tends to make the air-fuel ratio shift towards lean during the latter half of acceleration in the non-steady temperature state.

SUMMARY OF THE INVENTION

It is therefore an object of this invention to prevent excesses and deficiencies of the transient correction amount Kathos when there is a change-over of the target air-fuel ratio coefficient Tfbya.

It is a further object of this invention to prevent excesses and deficiencies of the cylinder-specific wall flow correction amount Chosn when there is a change-over of the target air-fuel ratio coefficient Tfbya.

It is a still further object of this invention to improve the control precision of the air-fuel ratio in a non-steady temperature state.

It is a still further object of this invention to introduce a correction for unburnt fuel supplied to the engine, into air-fuel ratio control.

In order to achieve the above objects, this invention provides an air-fuel ratio controller for feedback controlling an air-fuel ratio of fuel and air supplied to an engine to a target air-fuel ratio. The engine has a cylinder in which the fuel and air are burned, a fuel injection valve for supplying fuel to the cylinder and a fuel deposition part on which fuel injected from the fuel injection valve temporarily deposits before reaching the cylinder.

The controller comprises a mechanism for computing a basic injection amount of the fuel injection valve, a mechanism for detecting an engine running condition, a mechanism for computing a target air-fuel ratio corresponding amount according to the engine running condition, a mechanism for computing a steady state deposition amount of injected fuel depositing on the deposition part based on the engine running condition, a mechanism for correcting the steady state deposition amount according to the target air-fuel ratio corresponding amount, a mechanism for computing a quantity proportion based on the engine running condition, a mechanism for storing a deposition amount of injected fuel depositing on the fuel deposition part, a mechanism for computing a difference between the steady state deposition amount and the stored deposition amount, a mechanism for computing a deposition rate based on the difference and the quantity proportion, a first correcting mechanism for correcting the basic injection amount by the target air-fuel ratio corresponding amount, a second correcting mechanism for correcting a correction value of the first correcting mechanism based on the deposition rate, a mechanism for supplying a specific quantity of fuel to the fuel injection valve with a predetermined timing, this specific quantity being obtained based on a value corrected by the second correcting mechanism, and a mechanism for updating the deposition amount stored by the storing mechanism by adding the deposition rate to the deposition amount.

It is preferable that the first correcting mechanism corrects the basic injection amount by multiplying the target air-fuel ratio corresponding amount by the basic injection amount.

It is further preferable that the running condition detecting mechanism comprises a mechanism for detecting engine load, engine rotation speed and engine temperature, the steady state deposition amount computing mechanism comprises a mechanism for computing a steady state deposition amount corresponding to a stoichiometric air-fuel ratio based on engine load, engine rotation speed and engine temperature, and the steady state deposition amount correcting mechanism comprises a mechanism for correcting the steady state deposition amount by multiplying a steady state deposition amount corresponding to the stoichiometric air-fuel ratio by the target air-fuel ratio corresponding amount.

It is still further preferable that the steady state deposition amount computing mechanism comprises a mechanism for calculating a steady state deposition rate corresponding to the stoichiometric air-fuel ratio based on engine load, engine rotation speed and engine temperature, and a mechanism for calculating a steady state deposition amount corresponding to the stoichiometric air-fuel ratio from the product of the steady state deposition rate and the basic injection amount.

It is also preferable that the running condition detecting mechanism comprises a mechanism for detecting engine load, engine rotation speed and engine temperature, the steady state deposition amount computing mechanism comprises a mechanism for calculating the steady state deposition amount corresponding to the stoichiometric air-fuel ratio based on engine load, engine rotation speed and engine temperature, and the steady state deposition amount correcting mechanism comprises a mechanism for computing a gain having the target air-fuel ratio corresponding amount as a parameter, and a mechanism for correcting the steady state deposition amount by multiplying the steady state deposition amount corresponding to the stoichiometric air-fuel ratio by the gain.

In this case, it is further preferable that the gain computing mechanism computes the gain by multiplying a coefficient having a value which is different when the target air-fuel ratio corresponding amount gives an air-fuel ratio on the rich side and when the target air-fuel ratio corresponding amount gives an air-fuel ratio on the lean side, by the target air-fuel ratio corresponding amount.

Alternatively, the steady state deposition amount computing mechanism may comprise a mechanism for calculating a steady state deposition rate corresponding to the stoichiometric air-fuel ratio based on engine load, engine rotation speed and engine temperature, and a mechanism for calculating a steady state deposition amount corresponding to the stoichiometric air-fuel ratio from the product of the steady state deposition rate and the basic injection rate.

It is also preferable that the running condition detecting mechanism comprises a mechanism for detecting engine load, engine rotation speed and engine temperature, and the quantity proportion computing mechanism comprises a mechanism for calculating a quantity proportion based on engine load, engine rotation speed and engine temperature.

It is also preferable that the controller further comprises a mechanism for storing a deposition rate on each fuel injection, a mechanism for computing a deposition rate difference between a deposition rate stored in an immediately preceding fuel injection and a deposition rate computed by the deposition rate computing mechanism, a mechanism for computing a response gain of the second correcting mechanism, and a third correcting mechanism for correcting a value corrected by the second correcting mechanism based on the deposition rate difference and response gain so as to obtain the specific quantity.

In this case, it is preferable that the controller further comprises a mechanism for prohibiting correction by the third correcting mechanism when the deposition rate is positive but decreasing.

In this case, it is also preferable that the controller further comprises a mechanism for prohibiting correction by the third correcting mechanism when the deposition rate is negative but increasing towards zero.

It is also preferable that the controller further comprises a mechanism for storing a value corrected by the first correcting mechanism on each fuel injection, a mechanism for computing a correction value difference between a value corrected by the first correcting mechanism in an immediately preceding fuel injection and a value corrected by the first correcting mechanism in a present fuel injection, a mechanism for computing a response gain of the second correcting mechanism, and a third correcting mechanism for correcting a value corrected by the second correcting mechanism based on the correction value difference and the response gain.

In this case also, it is preferable that the controller further comprises a mechanism for prohibiting correction by the third correcting mechanism when the deposition rate is positive but decreasing.

In this case, it is also preferable that the controller further comprises a mechanism for prohibiting correction by the third correcting mechanism when the deposition rate is negative but increasing towards zero.

This invention also provides an air-fuel ratio controller for such an engine that has a plurality of cylinders in which the fuel and air are burned, a fuel injection valve for supplying fuel to the cylinders and a fuel deposition part on which fuel injected from the fuel injection valve temporarily deposits before reaching the cylinder.

The controller comprises a mechanism for computing a basic injection amount of the fuel injection valve, a mechanism for detecting an engine running condition, a mechanism for computing a target air-fuel ratio corresponding amount according to the engine running condition, a mechanism for computing a steady state deposition amount of injected fuel depositing on the deposition part based on the engine running condition, a mechanism for correcting the steady state deposition amount according to the target air-fuel ratio corresponding amount, a mechanism for computing a quantity proportion based on the engine running condition, a mechanism for storing a deposition amount of injected fuel depositing on the fuel deposition part, a mechanism for computing a difference between the steady state deposition amount and the stored deposition amount, a mechanism for computing a deposition rate based on the difference and the quantity proportion, a first correcting mechanism for correcting the basic injection amount by the target air-fuel ratio corresponding amount, a second correcting mechanism for correcting a correction value of the first correcting mechanism based on the deposition rate, a mechanism for storing the deposition rate, a mechanism for computing a deposition rate difference between a deposition rate in an immediately preceding fuel injection and a deposition rate computed by the deposition rate computing mechanism, a mechanism for computing a response gain of the second correcting mechanism, a third correcting mechanism for correcting a value corrected by the second correcting mechanism based on the deposition rate difference and response gain, a mechanism for supplying a specific quantity of fuel to the fuel injection valve with a predetermined timing, the specific quantity corresponding to a value corrected by the third correcting mechanism, a mechanism for updating a deposition amount stored by the deposition amount storing mechanism by adding the deposition rate computed by the deposition rate computing mechanism to the stored deposition amount, a mechanism for cutting fuel injection to a specific cylinder under a predetermined condition, a mechanism for predicting a deposition amount which decreases due to fuel injection cut, a recovery mechanism for restarting fuel injection under a predetermined condition in the specific cylinder, and a mechanism for updating the deposition rate stored in the deposition rate storing mechanism by a value obtained by multiplying the quantity proportion by the difference between a deposition amount stored by the deposition amount storing mechanism and a deposition amount predicted by the predicting mechanism, when the recovery mechanism resumes fuel injection in the specific cylinder.

This invention also provides an air-fuel ratio controller comprising a mechanism for computing a basic injection amount of the fuel injection valve, a mechanism for detecting an engine running condition, a mechanism for computing a target air-fuel ratio corresponding amount according to the engine running condition, a mechanism for computing a steady state deposition amount of injected fuel depositing on the deposition part based on the engine running condition, a mechanism for correcting the steady state deposition amount according to the target air-fuel ratio corresponding amount, a mechanism for computing a quantity proportion based on the engine running condition, a mechanism for storing a deposition amount of injected fuel depositing on the fuel deposition part, a mechanism for computing a difference between the steady state deposition amount and the stored deposition amount, a mechanism for computing a deposition rate based on the difference and the quantity proportion, a first correcting mechanism for correcting the basic injection amount by the target air-fuel ratio corresponding amount, a second correcting mechanism for correcting a correction value of the first correcting mechanism based on the deposition rate, a mechanism for supplying a specific quantity of fuel to the fuel injection valve with a predetermined timing, the specific quantity corresponding to a value corrected by the second correcting mechanism, a mechanism for updating a deposition amount stored by the storing mechanism by adding the deposition rate to the deposition amount, a mechanism for cutting fuel injection in all cylinders under a predetermined condition, a recovery mechanism for restarting fuel injection in all cylinders under a predetermined condition, a mechanism for setting the target air-fuel ratio corresponding amount to zero when fuel injection is cut in all cylinders, a mechanism for setting the steady state deposition amount to zero when fuel injection is cut in all cylinders, and a mechanism for computing a deposition rate based on the stored deposition amount and a preset quantity proportion when fuel injection is cut in all cylinders.

It is preferable that the controller further comprises a mechanism for setting the preset quantity proportion based on a decrease proportion of a deposition amount when fuel injection is cut in a specific cylinder.

This invention also provides an air-fuel ratio controller comprising a mechanism for computing a basic injection amount of the fuel injection valve, a mechanism for detecting an engine running condition, a mechanism for computing a target air-fuel ratio corresponding amount according to the engine running condition, a mechanism for computing a steady state deposition amount of injected fuel depositing on the deposition part based on the engine running condition, a mechanism for correcting the steady state deposition amount according to the target air-fuel ratio corresponding amount, a mechanism for computing a quantity proportion based on the engine running condition, a mechanism for storing a deposition amount of injected fuel depositing on the fuel deposition part, a mechanism for computing a difference between the steady state deposition amount and the stored deposition amount, a mechanism for computing a deposition rate based on the difference and the quantity proportion, a first correcting mechanism for correcting the basic injection amount by the target air-fuel ratio corresponding amount, a second correcting mechanism for correcting a correction value of the first correcting mechanism based on the deposition rate, a mechanism for storing the deposition rate, a mechanism for computing a deposition rate difference between a deposition rate in an immediately preceding fuel injection and a deposition rate computed by the deposition rate computing mechanism, a mechanism for computing a response gain of the second correcting mechanism, third correcting mechanism for correcting a value corrected by the second correcting mechanism based on the deposition rate difference and response gain, a mechanism for supplying a specific quantity of fuel to the fuel injection valve with a predetermined timing, the specific quantity corresponding to a value corrected by the third correcting mechanism, a mechanism for updating a deposition amount stored by the deposition amount storing mechanism by adding the deposition rate computed by the deposition rate computing mechanism to the stored deposition amount, a mechanism for cutting fuel injection in all cylinders under a predetermined condition, a recovery mechanism for restarting fuel injection in all cylinders under a predetermined condition, a mechanism for setting the target air-fuel ratio corresponding amount to zero when fuel injection is cut in all cylinders, a mechanism for setting the steady state deposition amount to zero when fuel injection is cut in all cylinders, and a mechanism for computing a deposition rate based on the stored deposition amount and a preset quantity proportion when fuel injection is cut in all cylinders.

In this controller also, it is preferable that the controller further comprises a mechanism for setting the preset quantity proportion based on a decrease proportion of the deposition amount when fuel injection is cut in a specific cylinder.

This invention also provides an air-fuel ratio controller for feedback controlling an air-fuel ratio of fuel and air supplied to an engine to a target air-fuel ratio. The engine has a cylinder in which the fuel and air are burned, a fuel injection valve for supplying fuel to the cylinder and an intake valve on which fuel injected from the fuel injection valve temporarily deposits before reaching the cylinder.

The controller comprises a mechanism for computing a basic injection amount of the fuel injection valve, a mechanism for detecting an engine running condition, a mechanism for computing a target air-fuel ratio corresponding amount according to the engine running condition, a mechanism for detecting an engine cooling water temperature, a mechanism for estimating an intake valve temperature based on the cooling water temperature, a mechanism for storing a map of a steady state fuel deposition amount on the intake valve set according to a cooling water temperature in a steady temperature state of the engine, a mechanism for calculating a steady state deposition amount by looking up the map of steady state deposition amount based on the intake valve temperature, a mechanism for computing a steady state deposition correction amount in the non-steady temperature state based on a temperature difference between the cooling water temperature and intake valve temperature, a mechanism for correcting the steady state deposition amount based on the steady state correction amount, a mechanism for computing a quantity proportion based on the intake valve temperature, a mechanism for computing a deposition rate based on the steady state deposition amount after correction and the quantity proportion, a mechanism for computing an unburnt fraction correction amount based on the temperature difference, a mechanism for correcting the target air-fuel ratio corresponding amount according to the unburnt fraction correction amount, a mechanism for computing a fuel injection amount based on the basic fuel injection amount, the target air-fuel ratio corresponding amount after correction and the deposition rate, and a mechanism for supplying fuel corresponding to the computed fuel injection amount to the fuel injection valve.

This invention also provides an air-fuel ratio controller comprising a mechanism for computing a basic injection amount of the fuel injection valve, a mechanism for detecting an engine running condition, a mechanism for computing a target air-fuel ratio corresponding amount according to the engine running condition, a mechanism for detecting an engine cooling water temperature, a mechanism for estimating an intake valve temperature based on the cooling water temperature, a mechanism for computing a steady state deposition amount of fuel on the intake valve based on the intake valve temperature, a mechanism for storing a map of a quantity proportion set according to the cooling water temperature in a steady engine temperature state, a mechanism for calculating a quantity proportion by looking up the map of steady state deposition amount based on the intake valve temperature, a mechanism for computing a quantity proportion correction amount in a non-steady temperature state based on a temperature difference between the cooling water temperature and the intake valve temperature, a mechanism for correcting the quantity proportion based on the quantity proportion correction amount, a mechanism for computing a deposition rate based on the steady state deposition amount and the quantity proportion after correction, a mechanism for computing an unburnt fraction correction amount based on the temperature difference, a mechanism for correcting the target air-fuel ratio corresponding amount according to the unburnt fraction correction amount, a mechanism for computing a fuel injection amount based on the basic fuel injection amount, the target air-fuel ratio corresponding amount after correction and the deposition rate, and a mechanism for supplying fuel corresponding to the computed fuel injection amount to the fuel injection valve.

This invention also provides an air-fuel ratio controller comprising a mechanism for computing a basic injection amount of the fuel injection valve, a mechanism for detecting an engine running condition, a mechanism for computing a target air-fuel ratio corresponding amount according to the engine running condition, a mechanism for detecting an engine cooling water temperature, a mechanism for estimating an intake valve temperature based on the cooling water temperature, a mechanism for computing a steady state deposition amount of fuel on the intake valve based on the intake valve temperature, a mechanism for computing a quantity proportion based on the intake valve temperature, a mechanism for computing a deposition rate based on the steady state deposition amount and the quantity proportion, a mechanism for computing a deposition rate correction amount in a non-steady temperature state based on a temperature difference between the cooling water temperature and the intake valve temperature, a mechanism for correcting the deposition rate based on the deposition rate correction amount, a mechanism for computing an unburnt fraction correction amount based on the temperature difference, a mechanism for correcting the target air-fuel ratio corresponding amount according to the unburnt fraction correction amount, a mechanism for computing a fuel injection amount based on the basic fuel injection amount, the target air-fuel ratio corresponding amount after correction and the deposition rate after correction, and a mechanism for supplying fuel corresponding to the computed fuel injection amount, to the fuel injection valve.

This invention also provides an air-fuel ratio controller comprising a mechanism for computing a basic injection amount of the fuel injection valve, a mechanism for detecting an engine running condition, a mechanism for computing a target air-fuel ratio corresponding amount according to the engine running condition, a mechanism for detecting an engine cooling water temperature, a mechanism for estimating an intake valve temperature based on the cooling water temperature, a mechanism for computing a steady state deposition amount of fuel on the intake valve based on the cooling water temperature, a mechanism for computing a steady state correction amount in a non-steady temperature state based on a temperature difference between the cooling water temperature and the intake valve temperature, a mechanism for correcting the steady state deposition amount based on the steady state deposition correction amount, a mechanism for computing a quantity proportion based on the cooling water temperature, a mechanism for computing a deposition rate based on the steady state deposition amount after correction and the quantity proportion, a mechanism for computing an unburnt fraction correction amount based on the temperature difference, a mechanism for correcting the target air-fuel ratio corresponding amount according to the unburnt fraction correction amount, a mechanism for computing a fuel injection amount based on the basic fuel injection amount, the target air-fuel ratio corresponding amount after correction and the deposition rate, and a mechanism for supplying fuel corresponding to the computed fuel injection amount, to the fuel injection valve.

This invention also provides an air-fuel ratio controller comprising a mechanism for computing a basic injection amount of the fuel injection valve, a mechanism for detecting an engine running condition, a mechanism for computing a target air-fuel ratio corresponding amount according to the engine running condition, a mechanism for detecting an engine cooling water temperature, a mechanism for estimating an intake valve temperature based on the cooling water temperature, a mechanism for computing a steady state deposition amount of fuel on the intake valve based on the cooling water temperature, a mechanism for computing a quantity proportion based on the cooling water temperature, a mechanism for computing a quantity proportion correction amount in a non-steady temperature state based on a temperature difference between the cooling water temperature and the intake valve temperature, a mechanism for correcting the quantity proportion based on the quantity proportion correction amount, a mechanism for computing a deposition rate based on the steady state deposition amount and the quantity proportion after correction, a mechanism for computing an unburnt fraction correction amount based on the temperature difference, a mechanism for correcting the target air-fuel ratio corresponding amount according to the unburnt fraction correction amount, a mechanism for computing a fuel injection amount based on the basic fuel injection amount, the target air-fuel ratio corresponding amount after correction and the deposition rate, and a mechanism for supplying fuel corresponding to the computed fuel injection amount, to the fuel injection valve.

This invention also provides an air-fuel ratio controller comprising a mechanism for computing a basic injection amount of the fuel injection valve, a mechanism for detecting engine an engine running condition, a mechanism for computing a target air-fuel ratio corresponding amount according to the engine running condition, a mechanism for detecting an engine cooling water temperature, a mechanism for estimating an intake valve temperature based on the cooling water temperature, a mechanism for computing a steady state deposition amount of fuel on the intake valve based on the cooling water temperature, a mechanism for computing a quantity proportion based on the cooling water temperature, a mechanism for computing a deposition rate based on the steady state deposition amount and the quantity proportion, a mechanism for computing a deposition rate correction amount in a non-steady temperature state based on a temperature difference between the cooling water temperature and the intake valve temperature, a mechanism for correcting the deposition rate based on the deposition rate correction amount, a mechanism for computing an unburnt fraction correction amount based on the temperature difference, a mechanism for correcting the target air-fuel ratio corresponding amount according to the unburnt fraction correction amount, a mechanism for computing a fuel injection amount based on the basic fuel injection amount, the target air-fuel ratio corresponding amount after correction and the deposition rate after correction, and a mechanism for supplying fuel corresponding to the computed fuel injection amount, to the fuel injection valve.

The details as well as other features and advantages of this invention are set forth in the remainder of the specification and are shown in the accompanying drawings.

DESCRIPTION OF THE PREFERRED EMBODIMENTS

Figure 1:
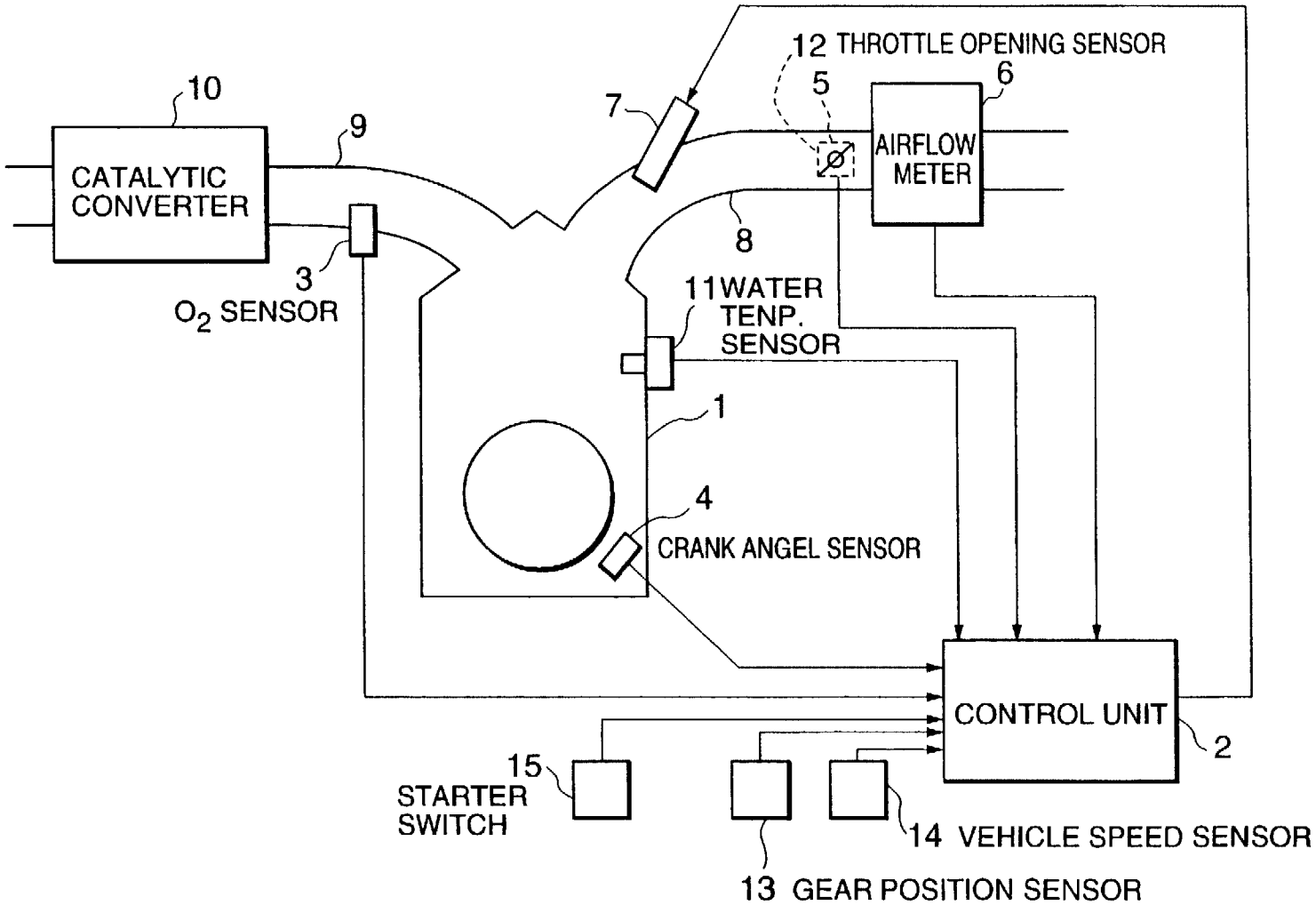
FIG. 1 is a schematic diagram of an air-fuel ratio controller according to a first embodiment of this invention.

Referring to FIG. 1 of the drawings, intake air for an engine 1 is supplied to engine cylinders via an intake passage 8. A throttle 5 which increases or decreases the intake air amount is provided midway in the intake air passage 8. Fuel is injected from a fuel injection valve 7 towards an air intake port of the engine 1 based on an injection signal output by a control unit 2 so as to obtain a predetermined air-fuel ratio according to running conditions of the engine.

The engine 1 is a four stroke cycle, four cylinder engine of a multipoint injection system (abbreviated hereafter as MPI system) wherein fuel injection is performed separately for each cylinder. In this fuel injection system, fuel is sequentially injected into each cylinder once every two rotations of the engine according to a cylinder ignition sequence.

A Ref signal and a unit angle signal from a crank angle sensor 4, an intake air volume signal from an air flow meter 6, an air-fuel ratio signal from an O2 sensor 3 installed in an exhaust passage 9 upstream of a three-way catalytic converter 10, a cooling water temperature signal from a water temperature sensor 11, a throttle opening signal from a throttle sensor 12, a gear position signal from a gear position sensor 13 of a transmission, and a vehicle speed signal from a vehicle speed sensor 14 are input to the control unit 2. The Ref signal is output for each 180° rotation of the crankshaft in a four cylinder engine, and for each 120° rotation of the crankshaft in a six cylinder engine. The unit angle signal is output for each 1° rotation of the crankshaft. The O2 sensor detects whether the air-fuel ratio is rich or lean from the oxygen concentration in the exhaust passage 9.

Based on these signals, the control unit 2 computes a basic injection pulse width Tp from an intake air volume Qa and engine rotation speed Ne. When the engine is accelerating or decelerating, a correction is made for wall flow by adding a transient correction amount Kathos to Tp.

The transient correction amount Kathos is not limited to acceleration and deceleration, and is also applied during startup of the engine when the wall flow is largely varying, during fuel recovery when fuel injection is restarted after fuel cut and when the target air-fuel ratio coefficient Tfbya is changed.

The control unit 2 corrects the fuel amount using this target air-fuel ratio coefficient Tfbya so as to maintain engine stability during a cold start and supply power requirements on high load. A change-over is made for example between a lean air-fuel ratio and the stoichiometric air-fuel ratio based on the gear position signal and vehicle speed signal.

When the engine is running with the stoichiometric air-fuel ratio, the three-way catalytic converter 10 reduces nitrogen oxides (NOx) in the exhaust and oxidizes hydrocarbons (HC) and carbon monoxide (CO) with maximum efficiency. When the engine is running with a lean air-fuel ratio, the three-way catalytic converter 10 oxidizes HC and CO, but its NOx reduction efficiency is low. However, the leaner the air-fuel ratio, the less NOx is produced, and at a predetermined level of leanness, the amount of NOx produced is the same as would be obtained by purification with the three-way catalytic converter 10. Fuel consumption performance is also improved the leaner the air-fuel ratio.

Therefore under predetermined engine running conditions when the load is not so high, the target air-fuel ratio coefficient Tfbya is set to a value less than 1.0 and the vehicle is driven with a lean air-fuel ratio. Under other engine running conditions, Tfbya is set to 1.0 in most cases and the air-fuel ratio is controlled to the stoichiometric air-fuel ratio. When the accelerator is depressed to obtain high power, however, the vehicle is driven in an air-fuel ratio region where the target air-fuel ratio coefficient Tfbya is greater than 1.0.

Hence the target air-fuel ratio coefficient Tfbya is changed over when the engine running conditions change, however if the transient correction amount Kathos is calculated for Tfbya=1.0, i.e. relative to the stoichiometric air-fuel ratio, an excess or deficiency will occur in Kathos when Tfbya is changed over such as when the vehicle decelerates from the power-oriented air-fuel ratio region or accelerates to the power-oriented air-fuel ratio region, the air-fuel ratio becomes overrich or overlean, and air-fuel ratio control response becomes poorer.

To deal with this problem, the computation takes into account both the steady state fuel deposition amount Mfh and the target air-fuel ratio coefficient Tfbya as parameters. The control performed by the control unit 2 will now be described with reference to the flowcharts of FIGS. 2, 3, 4, 7, 8 and 10.

Figure 2:
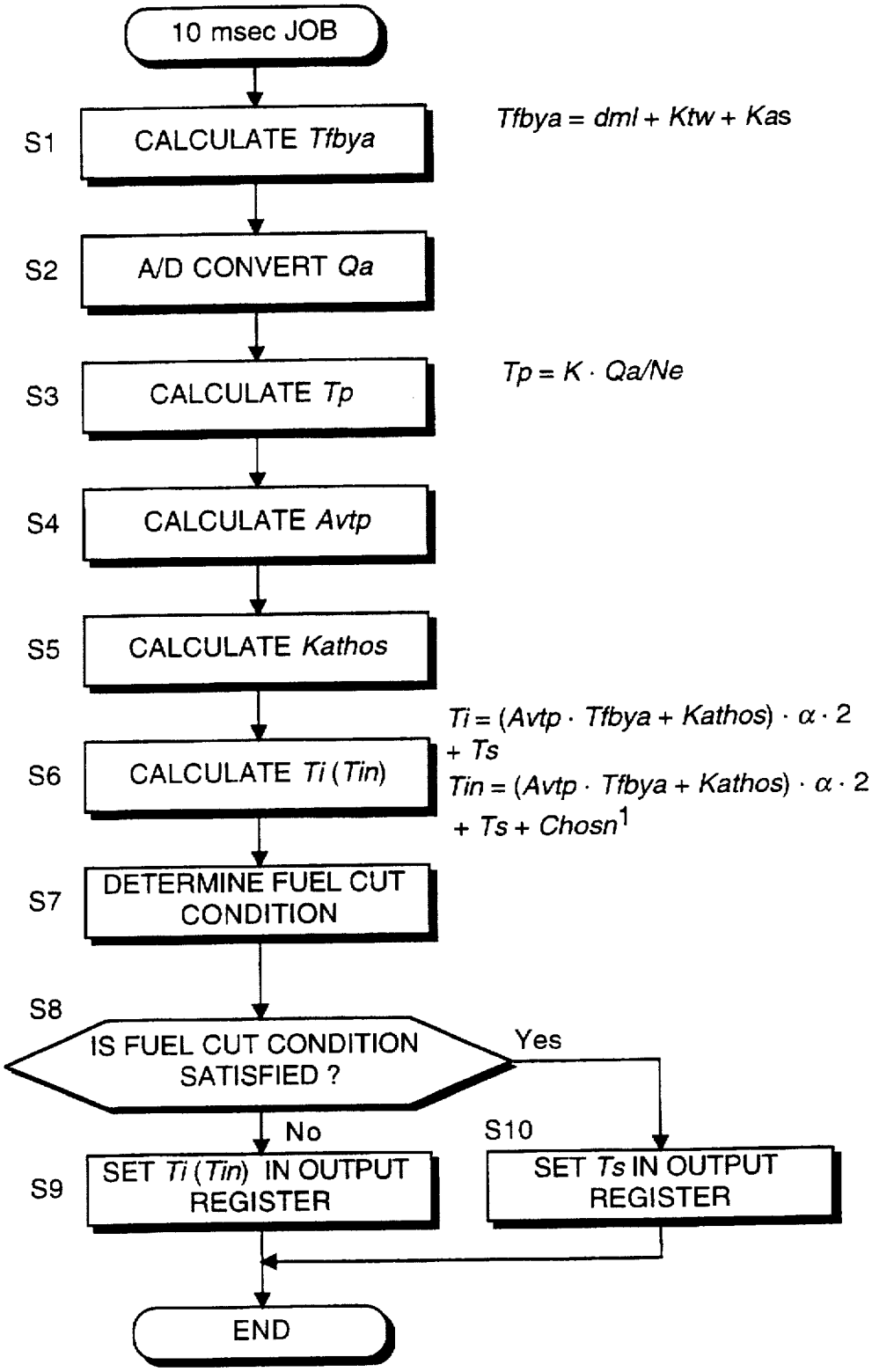
FIG. 2 is a flowchart describing a 10 msec job performed by the controller.

FIG. 2 shows a process which computes and outputs a basic injection pulse width. First, in a step S1, the target air-fuel ratio coefficient Tfbya is computed by the following equation.

$$Tfbya=Dml+Ktw+Kas \quad (1)$$

where,

Dml=air-fuel ratio correction coefficient,

Ktw=water temperature increase correction coefficient, and

Kas=post-startup increase correction coefficient.

The post-startup increase correction coefficient Kas has an initial value depending on the cooling water temperature Tw, and decreases as a fixed rate with elapsed time after startup to finally reach 0. The water temperature increase correction coefficient Ktw is a value depending on the cooling water temperature. When the engine is starting cold and Dml=1.0, the increase correction coefficients Kas, Ktw have positive values, so Tfbya is a value larger than 1.0. The air-fuel ratio is therefore maintained in a rich state, and Tfbya makes the air-fuel richer or leaner relative to a center value of 1.0 corresponding to the stoichiometric air-fuel ratio.

Figure 5:
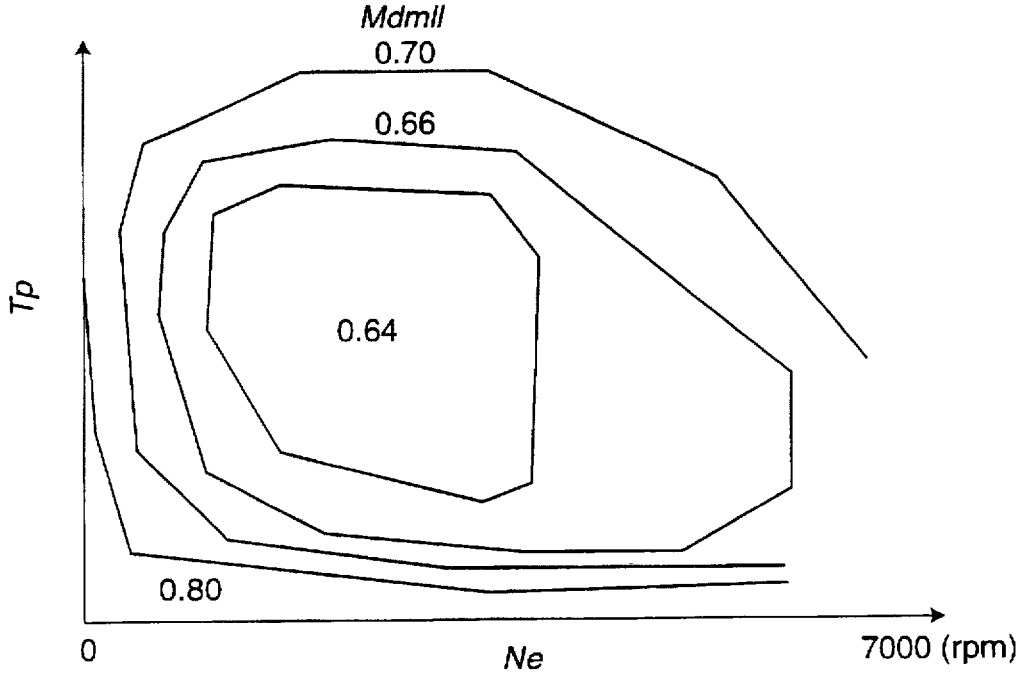
FIG. 5 is a diagram showing the contents of a lean map stored in the controller.
Figure 6:
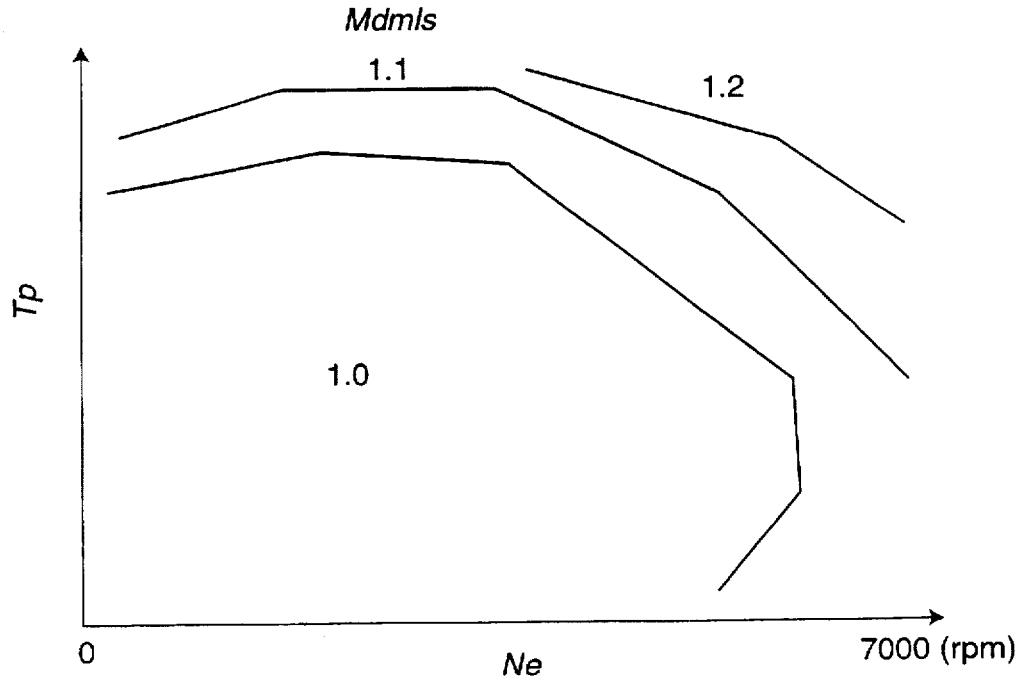
FIG. 6 is a diagram showing the contents of a non-lean map stored in the controller.

The air-fuel ratio correction coefficient Dml is found by searching an air-fuel ratio Mdmll or mdmls from maps shown in FIG. 5 or FIG. 6, and adding a predetermined damping to these values when the target air-fuel ratio is changed over. During lean burn conditions, the Mdmll map of FIG. 5 is used while in other cases, the mdmls map of FIG. 6 is used. These maps are known from U.k. Patent 227609.

Before proceeding to the flowchart of FIG. 2, the determination process of lean burn conditions will be described with reference to the flowcharts of FIG. 3 and FIG. 4.

These operations are performed as background jobs.

Figure 3:
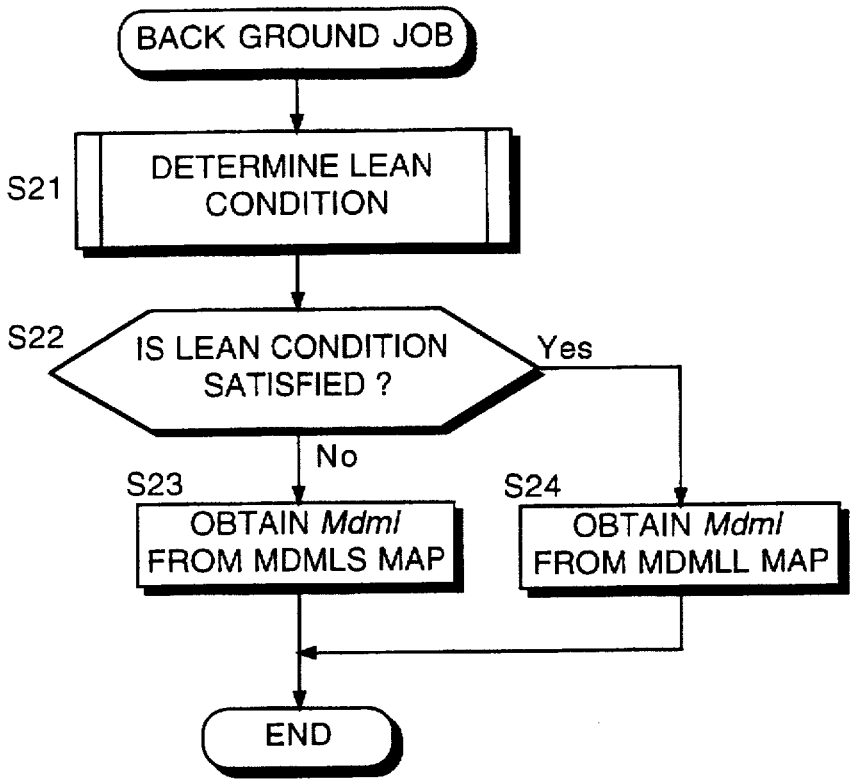
FIG. 3 is a flowchart describing a background job performed by the controller.
Figure 4:
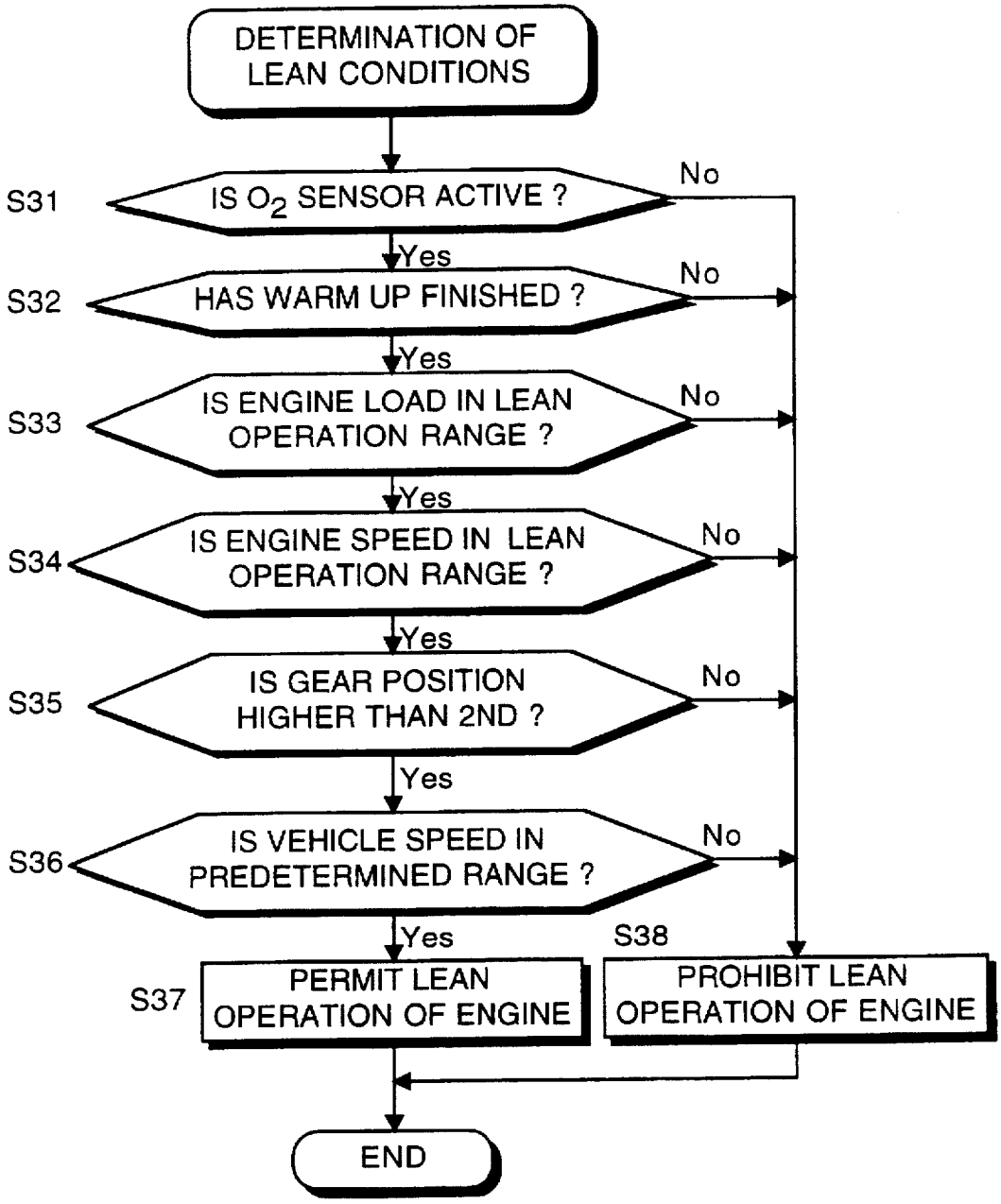
FIG. 4 is a flowchart describing a lean condition determining process performed by the controller.

In a step S20 of FIG. 3, it is determined whether the engine running conditions are lean or not. The details of this determination are shown in FIG. 4. Lean conditions are determined by checking each of the items in S31–S37 of FIG. 4. When all the items are satisfied, lean burn operation of the engine is permitted, and when even one of the items is not satisfied, lean burn operation is prohibited. The items to be determined are as follows:

Air-fuel ratio (O2) sensor is active (step S31), engine warmup is complete (step S32), basic injection pulse width Tp corresponding to engine load lies in a predetermined lean region (step S33), engine rotation speed Ne is in a predetermined lean region (step S34), gear position is second or higher (step S35), and vehicle speed lies within a predetermined range (step S36).

When all the above conditions are satisfied, lean burn operation is permitted in a step 337, otherwise lean burn operation is prohibited in a step S38. The above steps S31–S36 are necessary for stable lean burn operation of the engine without losing drivability.

When it is determined that conditions are such as to permit lean burn operation the routine returns to step S21 of FIG. 3. When it is determined that conditions are such as not to permit lean burn operation a map air-fuel ratio Mdmll of the stoichiometric air-fuel ratio or richer values is searched from a Mdmll map shown in FIG. 6 based on the engine rotation speed Ne and load Tp in a step S23. When it is determined that conditions are such as to permit lean burn operation, a map air-fuel ratio Mdm of values which are leaner by a predetermined range than the stoichiometric air-fuel ratio is searched from a mdmls map shown in FIG. 5 in a step S24 in the same way. These map values are relative to the stoichiometric air-fuel ratio as 1.0; when they are larger than 1.0, the air-fuel ratio is rich, and when they are smaller than 1.0, the air-fuel ratio is lean. The flowcharts of FIGS. 3 and 4 are known from the aforesaid U.k. Patent 2277609.

Figure 7:
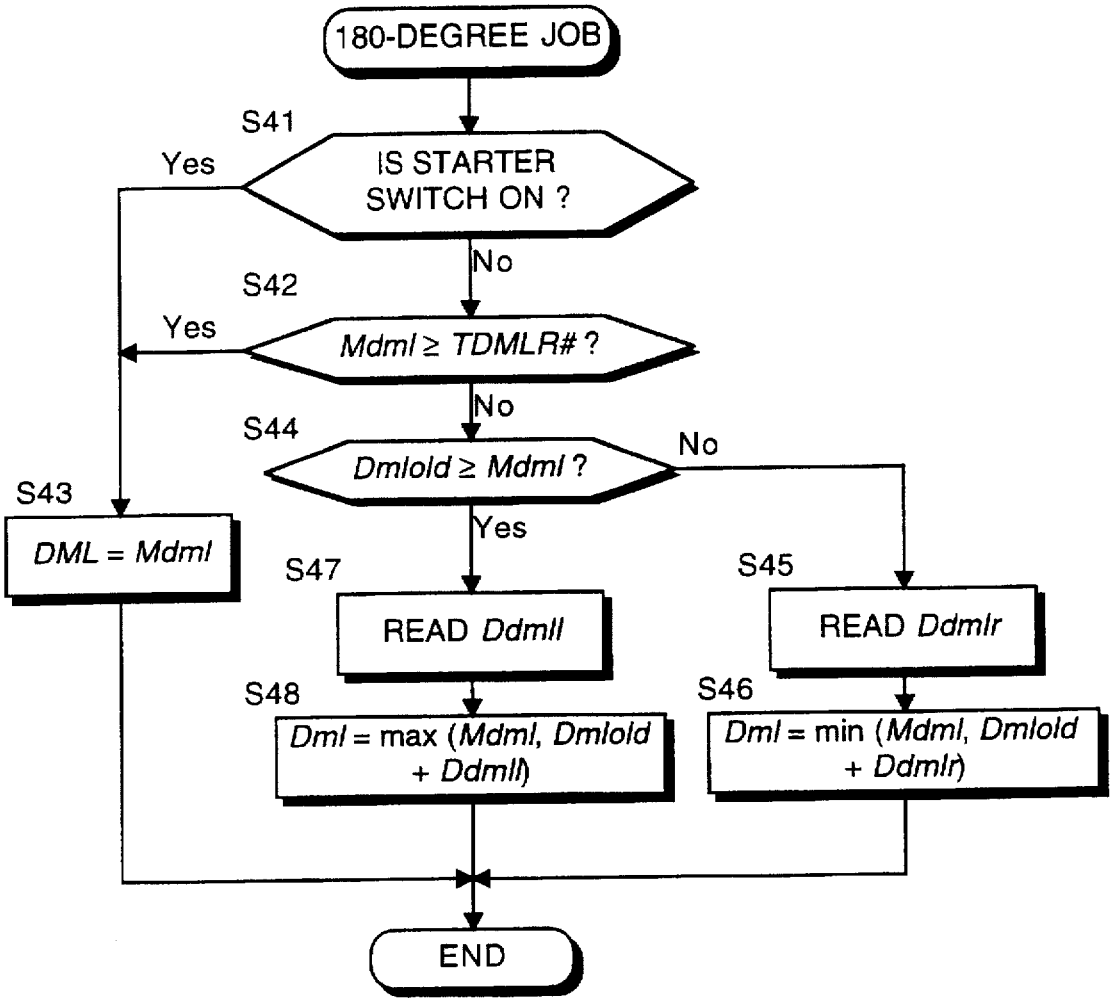
FIG. 7 is a flowchart describing a 180° job performed by the controller.

FIG. 7 is a flowchart showing a damping process used when the air-fuel ratio is changed over. This process is intended to avoid rapid changes of torque by changing the air-fuel ratio steadily, and render driving performance more stable.

In a step S41, it is determined whether or not a START switch is ON. In a step S42, it is determined whether or not the map air-fuel ratio Mdml is equal to or greater than an upper limit TDMLR#. When the START switch is ON and the map air-fuel ratio Mdml is equal to or greater than the upper limit TDMLR#, the map air-fuel ratio is set equal to an air-fuel ratio correction coefficient Dml in a step S43.

When the START switch is OFF and the map air-fuel ratio Mdml is less than the upper limit TDMLR#, the air-fuel ratio correction coefficient Dmlold on the immediately preceding occasion is compared with the map air-fuel ratio Mdml in a step S44. When Dmlold<Mdml, it is determined that the engine running conditions are changing over to running with the stoichiometric air-fuel ratio. In this case, an air-fuel ratio rich variation rate Ddmlr, described hereafter, is read in a step S45, and either the map air-fuel ratio Mdml or (Dmlold+Ddmlr), whichever is the smaller, is set as the air-fuel correction coefficient Dml in a step S46.

When Dmlold>Mdml, it is determined that the engine running conditions are changing over to lean burn conditions, and an air-fuel ratio lean increase rate, described hereafter, is read in a step S47. In a step S48, either the map air-fuel ratio Mdml or (Dmlold−Ddmll), whichever is the larger, is set as the air-fuel ratio correction coefficient Dml.

The aforesaid Ddmlr and Ddmll are set to larger values the more rapid the variation of throttle opening when the engine operating region is changed over.

Figure 8:
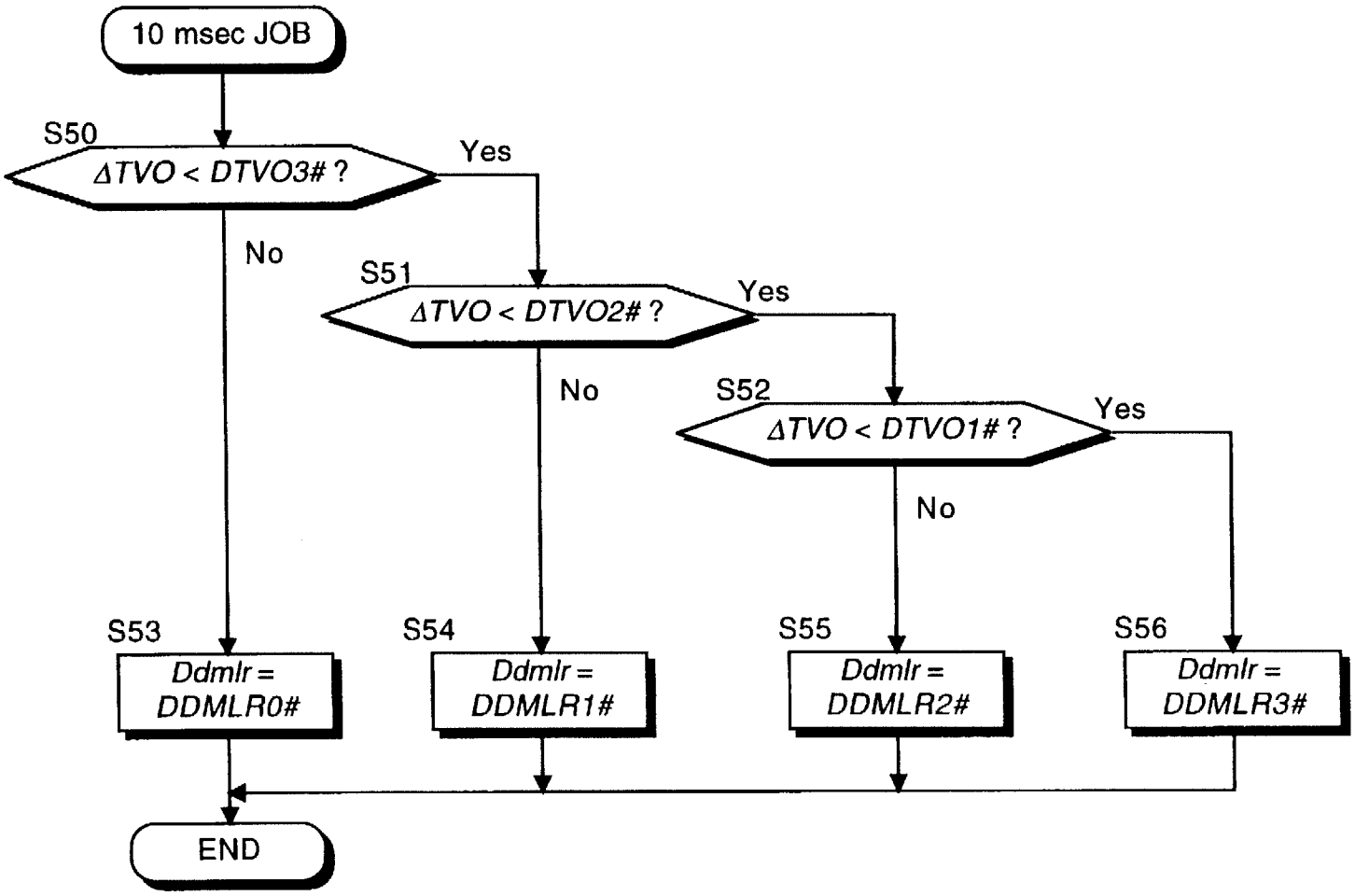
FIG. 8 is a flowchart describing a process for setting an air-fuel ratio rich variation rate Ddmlr performed by the controller.

The air-fuel ratio rich variation rate Ddmlr is set according to the flowchart of FIG. 8. In steps S50 . . . S52, a determination rate DTVO and determined values DTVO3#, DTVO#, DTVO1# of the throttle opening are compared. From the results, in the steps S53–S56, a predetermined value DDMLR0# is selected when DTVO≧DTVO3#, a predetermined value DDMLR1# is selected when DTVO3#>DTVO≧DTVO2, a predetermined value DDMLR2# is selected when DTVO2#>DTVO≧DTVO1#, and a predetermined value DDMLR3# is selected when DTVO1#>DTVO, as the air-fuel ratio rich variation rate Ddmlr.

Herein, DTVO3#>DTVO2#>DTVO1#, and DDMLR0>DDMLR1>DDMLR2>DDMLR3.

Figure 9:
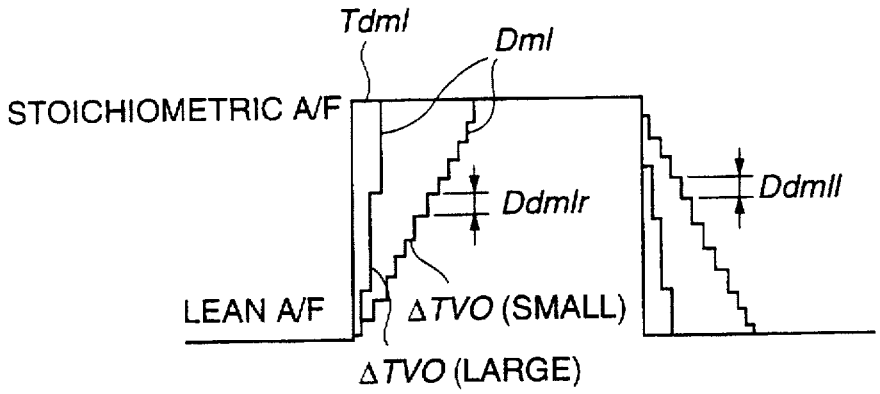
FIG. 9 is a timing chart describing a damping effect during target air-fuel ratio change-over by the controller.

Hence, by setting the variation rate Ddmlr of which the magnitude depends on the variation rate DTVO of the throttle opening in four stages, it has a sharp increase when DTVO is large and a smooth increase when DTVO is small as shown in FIG. 9.

The air-fuel ratio lean variation rate Ddmll is set in the same way. The flowcharts of FIGS. 7 and 8, and the timing chart of FIG. 9, are known from U.S. Pat. No. 5,529,043.

In the lean burn operating region, both Kas and Ktw are 0, so the air-fuel ratio correction coefficient Dml is a value less than 1.0, and the engine is driven with a lean air-fuel ratio. Kas and Ktw are also 0 when warmup is complete, however on high load after completion of warmup, the air-fuel ratio correction coefficient Dml is a value larger than 1.0 and the engine is driven with a rich air-fuel ratio. When the target air-fuel ratio coefficient Tfbya is a value other than 1.0, and the air-fuel ratio is feedback controlled to the stoichiometric air-fuel ratio, the air-fuel ratio does not reach a desired rich or lean value. Hence when Tfbya is a value other than 1.0, feedback control of the air-fuel ratio is terminated by fixing the air-fuel feedback coefficient α.

Returning to the flowchart of FIG. 2, the output of an air-flow meter is A/D converted in a step S2, and the result is linearized so as to compute an intake air flowrate Qa. In a step S3, the basic injection pulse width Tp which corresponds to the stoichiometric air-fuel ratio is calculated from $$T_p = \frac{K \cdot Qa}{Ne}$$

from the intake air flowrate Qa and engine rotation speed Ne. k is a constant. The method of computing the basic injection pulse width Tp is known from U.S. Pat. No. 5,529,043.

In a step S4, a fuel injection pulse width Avtp corresponding to a cylinder intake air volume is calculated by the following equation.

$$Avtp = Tp \cdot Fload + Avtp_{-1} \cdot (1 - Fload) \quad (2)$$

where,

Fload=weighting average coefficient, and $Avtp_{-1}$=Avtp on immediately preceding occasion.

The weighting average coefficient Fload is found by referring to a predetermined map from the product Ne·V of the engine rotation speed Ne and cylinder volume V, and the total flowpath cross sectional area Aa.

Aa is the result of adding the flowpath cross-sections of an idle regulating valve and an air regulator to the flowpath cross-section of the throttle 5. Equation (2) is known for example from U.S. Pat. No. 5,265,581. In a step S5, the transient correction amount Kathos is calculated. The calculation of this transient correction amount Kathos will be described with reference to the flowchart of FIG. 10.

The calculation of Kathos is performed without any distinction as to cylinder. As stated hereabove, the engine 1 is a four stroke cycle, four cylinder engine in which sequential injection is performed by an MPI system. The transient correction amount Kathos, deposition rate Vmf and deposition amount Mf are all calculated as values corresponding to one Ref signal, however, a cylinder-specific wall flow correction amount Chosn, described hereafter, is calculated as a value corresponding to a fuel injection in each cylinder every four Ref signals. The steady state deposition amount Mfh is a value for all cylinders.

First, in a step S61, the pulse width Avtp corresponding to the cylinder intake air volume obtained in the steps S1, S4 of FIG. 2 and the target air-fuel ratio coefficient Tfbya are read.

In a step S62, the steady state deposition amount Mfh is calculated by the following equation.

$$Mfh = Avtp \cdot Mfhtvo \cdot Tfbya \cdot CYLNDR\# \quad (3)$$

where,

Mfhtvo=deposition factor, and

CYLNDR#=number of cylinders=4.

Herein, the data used to calculate the deposition factor Mfhtvo is map data for a reference deposition factor load term $Mfhq_i$ and table data for a reference deposition factor rotation term $Mfhn_i$, described hereafter. As this is matching data for a target air-fuel ratio coefficient Tfbya=1.0, although the steady state deposition amount obtained using this data may be suitable for Tfbya=1.0, an error arises in the computation of the steady state deposition amount Mfh when the target air-fuel ratio coefficient Tfbya is a value other than 1.0.

Figure 11:
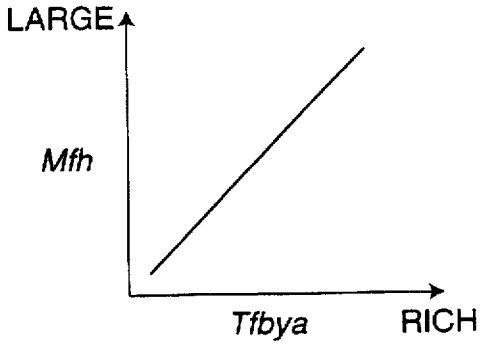
FIG. 11 is a graph showing a relation between a target air-fuel ratio coefficient Tfbya and a steady state deposition amount Mfh processed by the controller.

However, as the steady state deposition amount Mfh is effectively directly proportional to Tfbya as shown in FIG. 11, the steady state deposition amount Mfh is given without any excess or deficiency corresponding to Tfbya in the present injection cycle by multiplying the value (Avtp·Mfhtvo) relative to Tfbya=1.0 by Tfbya times. As a result, when the target air-fuel ratio coefficient Tfbya is 1.2 on high load after warmup is complete, the steady state deposition amount Mfh is also 1.2 times higher than in the case when Tfbya=1.0, and when the target air-fuel ratio coefficient Tfbya is 0.66 in the lean burn operating region, the steady state deposition amount Mfh is also 0.66 times lower than in the case when Tfbya=1.0.

The deposition factor Mfhtvo is a steady state deposition amount per Avtp per cylinder and known from Tokkai-Hei 3-111642 published by the Japanese Patent Office in 1991.

This is calculated using the load (pulse width Avtp), the engine rotation speed Ne and a predicted temperature Tf of the fuel deposition part.

The method of computing the predicted temperature value Tf of the fuel deposition part is known from Tokkai-Hei 1-305142 published by the Japanese Patent Office in 1989.

Specifically, Mfhtvo is calculated by interpolating between Tf, Tfi, $Tf_{i+1}$ using basic deposition factor data $Mfhtf_i$ and $Mfhtf_i$ for reference temperatures Tfi, $Tf_{i+1}$ above and below the predicted temperature Tf (where i is an integer from 1 to 4 or 5). For example, Mfhtvo is calculated by the following equation which is a linear interpolation using $Mfhtf_1$, $Mfhtf_2$, reference temperatures $Tf_1$, $Tf_2$ and the present predicted temperature Tf.

$$Mfhtvo = Mfhtf_1 + (Mfhtf_2 - Mfhtf_1) \cdot \frac{Tf_1 - Tf}{Tf_1 - Tf_2} \quad (4)$$

The above basic deposition factor data $Mfhtf_i$ are given by the following equation.

$$Mfhtf_i = MfhQ_i \cdot Mfhn_j \quad (5)$$

where, $Mfhq_i$=basic deposition factor load term, and $Mfhn_j$=basic deposition factor rotation term Herein, $Mfhq_i$ is found by referring to a predetermined map with an interpolation calculation using an air flowrate $Qh_o$ and the predicted temperature Tf $Qh_o$ is an air flowrate at a throttle position found from the throttle opening TVO and engine rotation speed Ne, and is already known from the aforesaid.

Tokkai-Hei 3-111642. $Mfhn_i$ is found by referring to a predetermined table with interpolation from the engine rotation speed Ne. A map of $Mfhq_i$ shown in FIG. 13 and a table of $Mfhn_i$ shown in FIG. 14 are stored in the control unit 2 together with a map of kmfat and a table of Kmfn described hereafter. It should be noted that all the data in these maps and tables are previously set for the stoichiometric air-fuel ratio.

Figure 10:
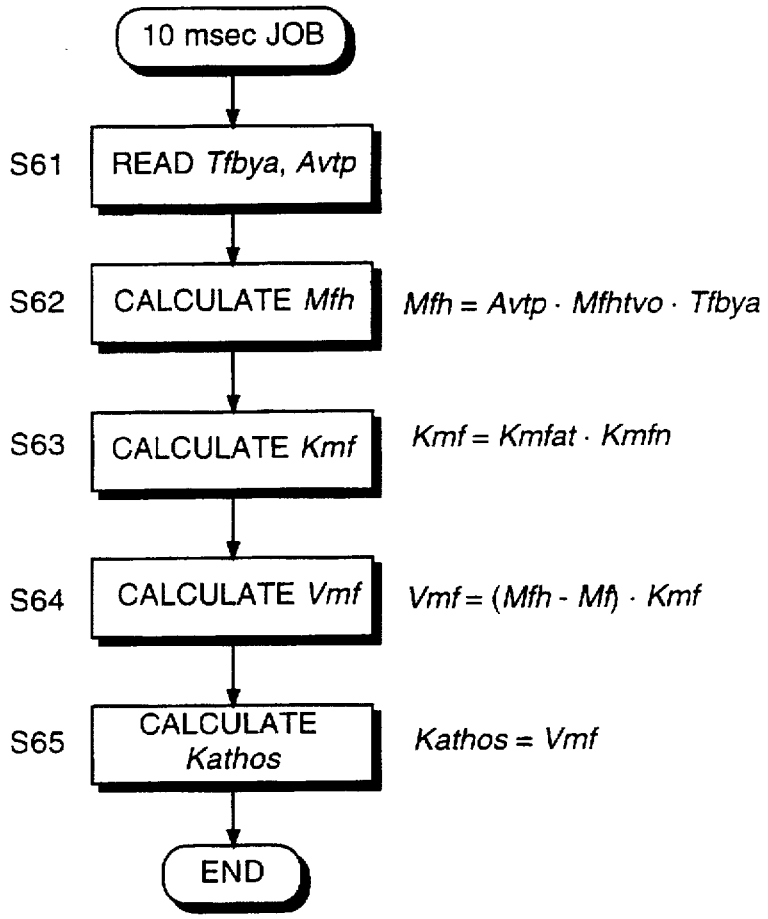
FIG. 10 is a flowchart describing a process for computing a transient correction amount Kathos performed by the controller.

Next, in a step S63 of FIG. 10, a coefficient expressing the extent to which the deposition amount Mf at the present time approaches the steady state deposition amount Mfh per rotation of the crankshaft, i.e. the quantity proportion Kmf, is computed from the product of the basic quantity proportion kmfat and quantity proportion rotation correction rate Kmfn.

Herein, kmfat is computed using the predicted temperature Tf. It may for example be found from a map shown in FIG. 15 and an interpolation calculation based on the flowrate $Qh_o$ and the predicted temperature Tf. Kmfn is found from a table shown in FIG. 16 and an interpolation calculation based on the engine rotation speed Ne.

Figure 13:
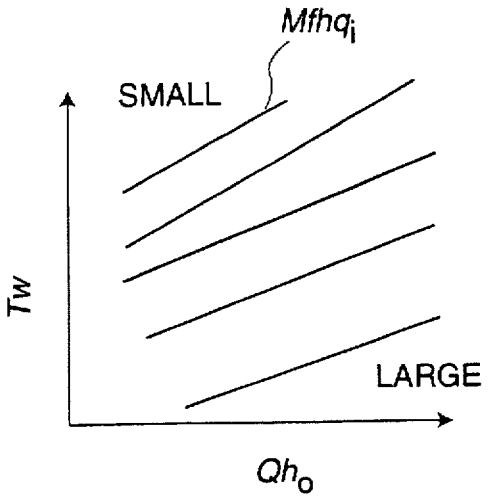
FIG. 13 is a graph showing the contents of a MfhQa1 map stored by the controller.
Figure 14:
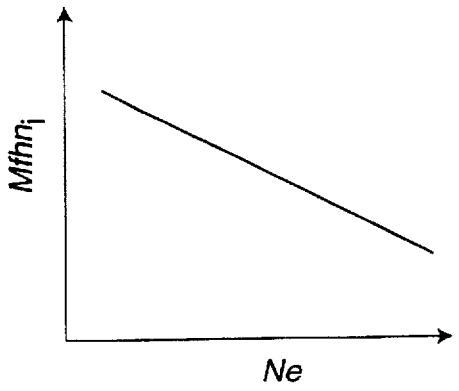
FIG. 14 is a graph showing the contents of a Mfhn1 table stored by the controller.
Figure 15:
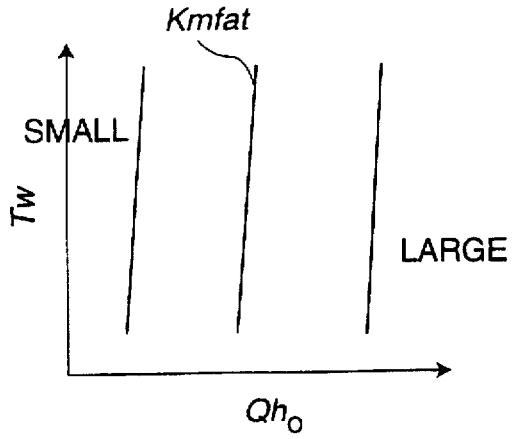
FIG. 15 is a graph showing the contents of a kmfat map stored by the controller.
Figure 16:
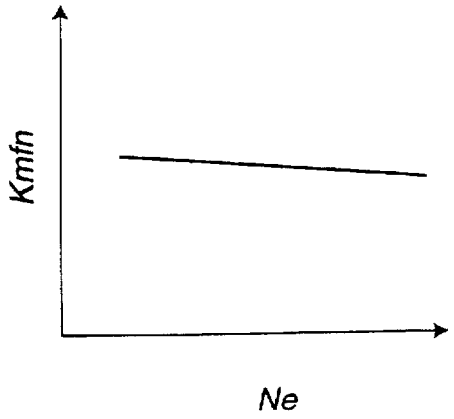
FIG. 16 is a graph showing the contents of a Kmfn table stored by the controller.

The map of $Mfhq_i$ of FIG. 13 and the map of kmfat of FIG. 15 are actually matched to the cooling water temperature Tw. When referring to these maps, the predicted temperature Tf may be used instead of the cooling water temperature Tw.

The suffix n appended to the basic deposition factor rotation term $Mfhn_i$ and the quantity proportion rotation correction rate Kmfn does not refer to the cylinder number, but to the engine rotation speed.

The deposition rate Vmf, i.e. the deposition amount per unit period, is calculated in a step S64 by multiplying the quantity proportion Kmf by the difference between Mfh and the deposition amount Mf at the present time.

$$Vmf = (Mfh - Mf) \cdot Kmf \quad (6)$$

Mf is the prediction parameter in the present injection cycle so the deposition amount (Mfh−Mf) represents an excess or deficiency from the steady state deposition amount in the present injection cycle. Thus, the deposition rate Vmf is found by further correcting this value (Mfh−Mf) by the quantity proportion Kmf.

In a step S65, this deposition rate Vmf is taken as the transient correction amount Kathos.

When calculation of the transient correction amount Kathos is complete, the routine returns to FIG. 2, and in a step S6, a fuel injection pulse width Ti is calculated.

$$Ti = (Avtp \cdot Tfbya + Kathos) \cdot \alpha \cdot 2 + Ts \quad (7)$$

where,

α=air-fuel ratio feedback correction coefficient, and

Ts=ineffectual injection pulse width.

As may be seen by comparing this equation (7) with the conventional equation (71), in this equation the transient correction amount Kathos is not multiplied by the target air-fuel ratio coefficient Tfbya. This is due to the fact that the target air-fuel ratio coefficient Tfbya is already used for calculating the steady state deposition amount Mfh in the above equation (3).

Herein, the air-fuel ratio feedback correction coefficient α of equation (7) is a value which is computed based on the output of the O2 sensor so that the control air-fuel ratio lies inside a window having the stoichiometric air-fuel ratio as center. The ineffectual pulse width Ts is a value which corrects for the response delay from when the injection valve receives an injection signal to when it actually opens. Also, unlike equation (71), equation (7) applies to sequential injection, i.e. in a four cylinder engine, one fuel injection every two rotations of the engine is performed in accordance with the cylinder ignition sequence, and it therefore contains the numeral 2.

Next, in a step S7, it is determined whether or not fuel cut should be performed. When the conditions are such as to permit fuel cut in a step S8, the ineffectual pulse width Ts is stored in an output register in a step S10, otherwise Tin is stored in the output register in a step S9.

In this way, fuel injection is performed with a predetermined timing corresponding to the output of the crank angle sensor.

Next, the updating process of the deposition amount Mf will be described with reference to the flowchart of FIG. 12. This process is performed in synchronism with the injection timing. The injection timing and the input timing of the Ref signal are not necessarily the same, however as the phase difference between them is constant, it shall be assumed in the following description that the process of updating the deposition amount Mf occurs in synchronism with the Ref signal.

After fuel injection is performed in a step S71 with the predetermined injection timing of each cylinder, the deposition amount Mf used in the next step is calculated by the following equation (8) using the deposition rate Vmf obtained in equation (6).

$$Mf=Mf_{-1Ref}+Vmf \quad (8)$$

where, Mf−1Ref=Mf for immediately preceding injection.

Mf−1Ref on the right-hand side of equation (8) is the deposition amount when the immediately preceding injection is complete, i.e. in this engine, 180° back from the present position. The value obtained by adding the deposition rate Vmf in the present injection to this, is the deposition rate Mf after the present injection is complete. The value of this deposition amount Mf is used in computing the Vmf on the next occasion. Whereas Mf−1Ref on the right-hand side of equation (8) is a value immediately before computing the deposition rate Vmf, Mf on the left-hand side of equation (8) is a value after computing the deposition rate Vmf. Therefore, the deposition rate Mf of equation (6) is substituted in Mf−1Ref on the right-hand side of equation (8) so as to compute the deposition amount Mf on the left-hand side of equation (8). The reason why deposition amount appears on both the left-hand and right-hand sides of equation (8) is because it is cyclically updated each time there is an injection. The initial value of the deposition amount Mf is preset depending on the cooling water temperature Tw, and Mf is updated on each fuel injection by the above equation (8).

Next, the variation of air-fuel ratio produced by this controller when the target air-fuel ratio coefficient Tfbya is changed from 1.2 to 1.0, will be described with reference to FIGS. 17A–17E. Herein to simplify the description, it shall be assumed that the target air-fuel ratio Tfbya varies abruptly.

Figure 17A:
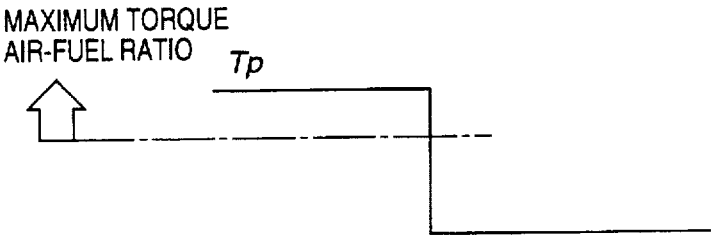
FIGS. 17A–17E are timing charts describing an example of control performed by the controller.
Figure 17B:
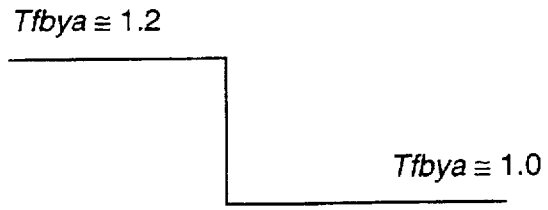
Figure 17C:
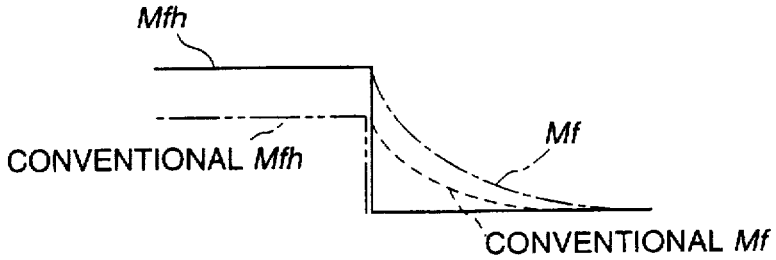
Figure 17D:
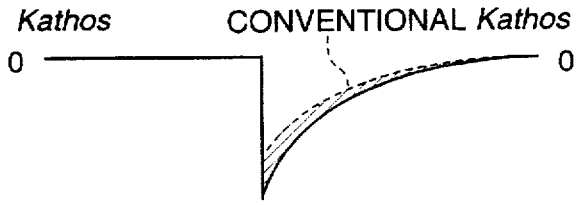
Figure 17E:
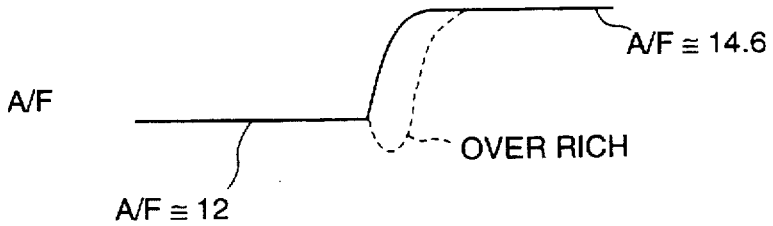

If as in the prior art, the steady state deposition amount Mfh and quantity proportion Kmf are found using matching data for the case where the target air-fuel ratio coefficient Tfbya=1.0, i.e. the stoichiometric air-fuel ratio, even when the target air-fuel ratio coefficient Tfbya is not 1.0, Mfh varies as shown by the double dotted line of FIG. 17C, and Mf varies as shown by the broken line of the same figure. As a result, when the target air-fuel ratio coefficient Tfbya is changed, Kathos is deficient as shown by the broken line of FIG. 17D, and overrich of the air-fuel ratio is produced as shown by the broken line in FIG. 17E.

However according to this controller, when the target air-fuel ratio coefficient Tfbya is 1.2, the steady state deposition amount is increased by 1.2 times by multiplying with this target air-fuel ratio coefficient Tfbya. Hence when the target air-fuel ratio coefficient Tfbya is changed to 1.0 as shown in FIG. 17B, the transient correction amount Kathos takes a highly negative value as shown by the solid line of FIG. 17D.

In this context, a highly negative value of Kathos means that its absolute value is large. As a result, overrichness of the air-fuel ratio when the target air-fuel ratio coefficient Tfbya is changed is avoided, and the air-fuel ratio soon returns to the stoichiometric air-fuel ratio.

Similarly, when the target air-fuel ratio Tfbya is changed to a richer value, such as when there is a change from a lean air-fuel ratio to the stoichiometric air-fuel ratio, Kathos is deficient and overleanness of the air-fuel ratio occurs in a conventional device. According to this controller, however, as the steady state deposition amount Mfh is computed by multiplying with the target air-fuel ratio coefficient Tfbya, this overleanness is avoided, and there is a rapid return from the lean air-fuel ratio to the stoichiometric air-fuel ratio.

Figure 18:
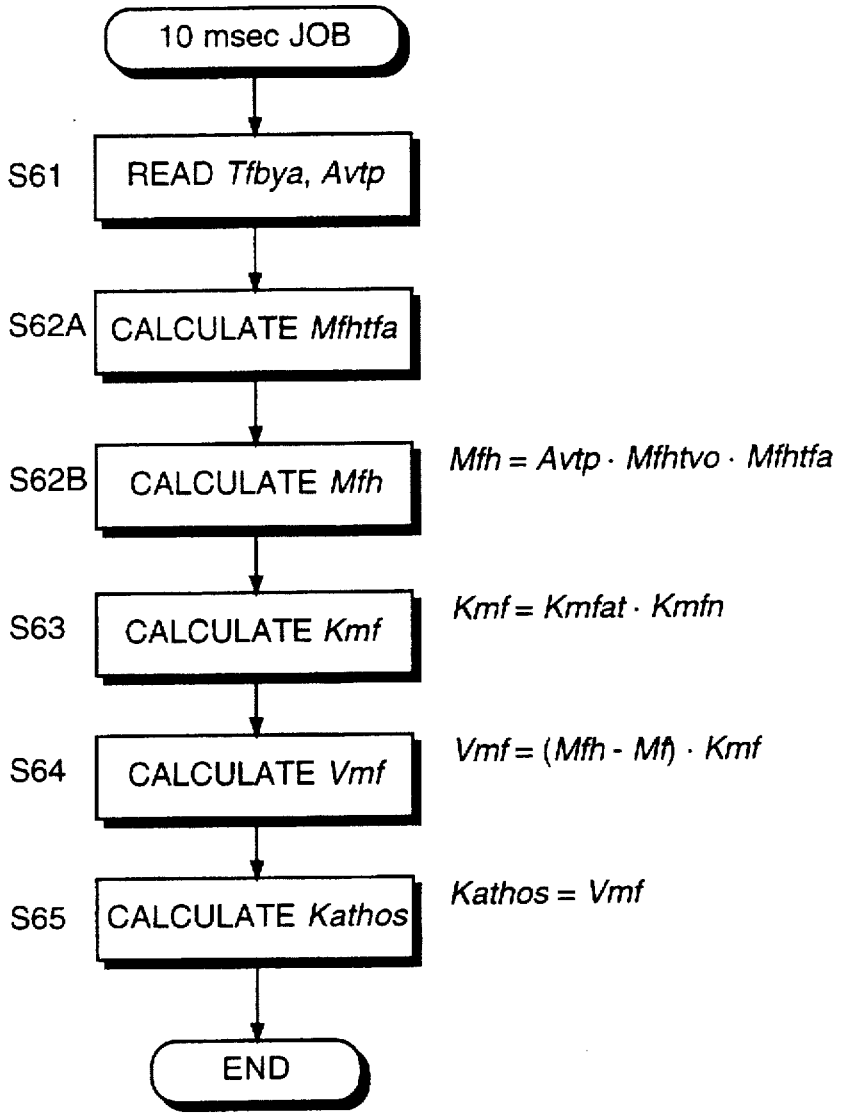
FIG. 18 is similar to FIG. 10, but showing a second embodiment of this invention.
Figure 19:
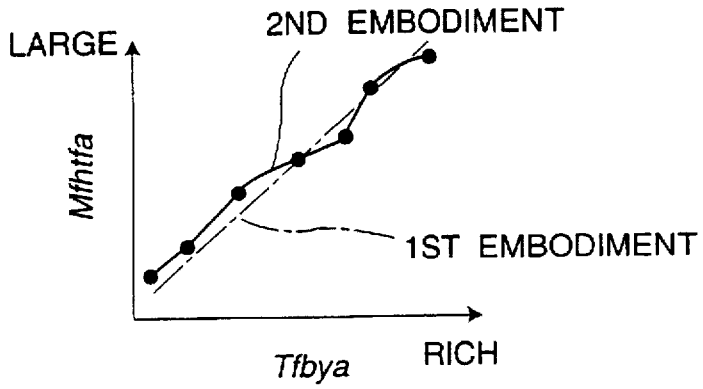
FIG. 19 is a graph showing the contents of a table of a gain Mfhtfa stored in a controller according to the second embodiment of this invention.
Figure 20:
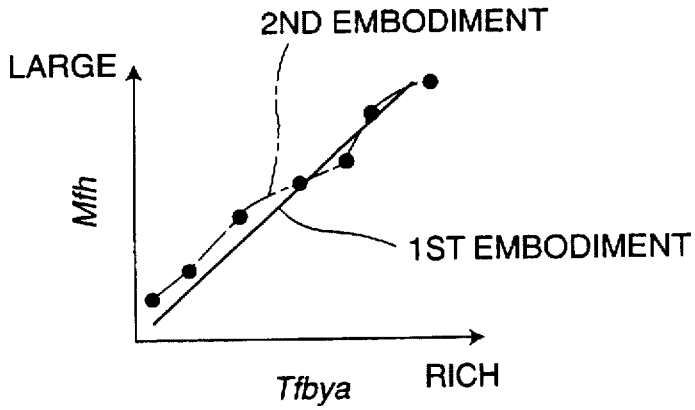
FIG. 20 is a graph describing a difference of the steady state deposition amount Mfh between the first embodiment and second embodiment.

FIGS. 18–20 show a second embodiment of this invention.

According to this embodiment, the flowchart of FIG. 18 is used instead of the flowchart of FIG. 10 of the aforesaid first embodiment to calculate the transient correction amount Kathos. Specifically, the method of computing the steady state deposition amount Mfh is different from that of the first embodiment.

In a step S62A, a table having the contents shown in FIG. 19 is searched from the target air-fuel ratio coefficient Tfbya, and a gain Mfhtfa is found.

In a step S62B, the steady state deposition amount Mfh is calculated by the following equation (9) using the gain Mfhta.

$$Mfh=Avtp\cdot Mfhtvo\cdot Mfhtfa \quad (9)$$

The installation position of the fuel injection valve, injection direction, injection amount, intake valve shape and intake port shape are factors which influence the steady state deposition amount Mfh. When these factors alter due to the type of engine, the desired characteristics of the steady state deposition amount also change. If, in this case, the steady state deposition amount Mfh is simply calculated by assuming it is directly proportional to the target air-fuel ratio coefficient Tfbya, the steady state deposition amount Mfh may be excessive or deficient.

According to this second embodiment, by slightly varying the gain Mfhtfa according to the target air-fuel ratio coefficient Tfbya as shown for example in FIG. 19, the characteristics of the steady state deposition amount Mfh vary as shown in FIG. 20, so a finer correction can be made than in the case of the first embodiment.

Figure 21:
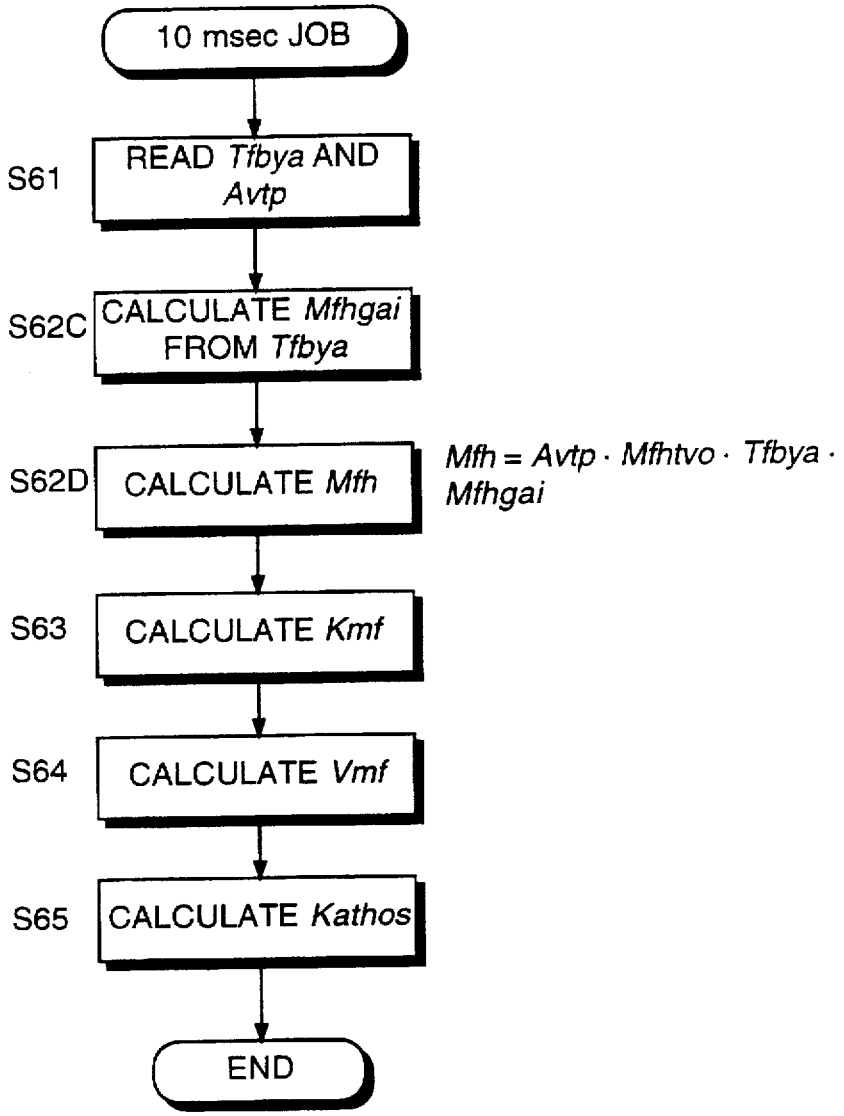
FIG. 21 is similar to FIG. 10, but showing a third embodiment of this invention.
Figure 22:
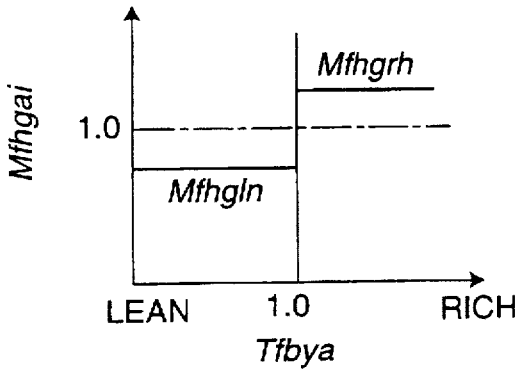
FIG. 22 is a graph showing the contents of a table of a gain Mfhgai stored in a controller according to the third embodiment.
Figure 23:
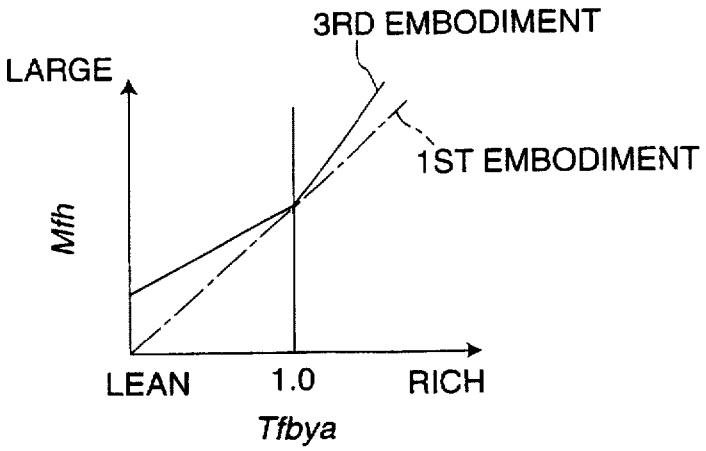
FIG. 23 is a graph describing a difference of the steady state deposition amount Mfh between the first embodiment and third embodiment.

FIGS. 21–23 show a third embodiment of this invention.

According to this embodiment, steps S62C and S62D shown in FIG. 21 are used instead of the step S62 in the flowchart of FIG. 10 of the aforesaid first embodiment.

In the step S62C, a table having the contents shown in FIG. 22 is searched from the target air-fuel ratio coefficient Tfbya so as to calculate a gain Mfhgai.

In the step S62D the steady state deposition amount Mfh is calculated by the following equation (10) using the gain Mfhgai. To find the gain Mfhgai, a table having the contents shown in FIG. 22 depending on the target air-fuel ratio coefficient Tfbya is first stored in the control unit 2.

$$Mfh=Avtp\cdot Mfhtvo\cdot Tfbya\cdot Mfhgai \quad (10)$$

In this case, the characteristics of the steady state deposition amount Mfh differs when the target air-fuel ratio coefficient Tfbya is larger and when it is smaller than the stoichiometric air-fuel ratio, as shown in FIG. 23. Also according to this embodiment, a finer correction of the air-fuel ratio is possible than in the case of the aforesaid first embodiment.

The first to third embodiments are based on Tokugan-Hei 8-96584 filed on Apr. 18, 1996 to Japanese Patent Office.

FIGS. 24–31C show a fourth embodiment of this invention.

According to this embodiment, a cylinder-specific fuel injection pulse width Tin, instead of the fuel injection pulse width Ti in the flowchart of FIG. 2, is calculated by the following equation (7A) in place of equation (7).

$$Tin=(Avtp\cdot Tfbya+Kathos)\cdot\alpha\cdot 2+Ts+Chosn^1 \quad (7A)$$

where, $Chosn^1$=wall flow high frequency correction amount.

Wall flow fuel has a low frequency component and a high frequency component, and correction cannot be made for the high frequency component using only Kathos, which is a wall flow correction for the low frequency component. According to this embodiment, therefore, the wall flow correction amount Chosn for the high frequency component is introduced into the correction of air-fuel ratio, and the fuel injection pulse width is calculated as a cylinder-specific value Tin.

The use of the cylinder-specific wall flow correction amount

Chosn in the calculation of the fuel injection pulse width Tin is known from Tokkai-Hei 1-305144 and Tokkai-Hei 3-111639, as described above. According to this embodiment, by reflecting the target air-fuel ratio coefficient Tfbya in Chosn, a suitable correction may be made also for the high frequency wall component of wall flow and over-lean or overrich may be prevented.

The cylinder-specific wall flow correction amount Chosn is calculated by the following equation (11).

$$Chosn^1=(\text{Kathos}-Kathos_{-4Ref})\cdot\frac{Gztwc-1}{A} \quad (11)$$

$$A=1-GL(1) \quad (12)$$

where, $Chosn^1$=Chosn in first injection cycle after Tfbya has changed, $Kathos_{-4Ref}$=Kathos in immediately preceding cycle, where 1 cycle=4 Ref signals, Gztwc=increase amount gain Gztwp or decrease amount gain Gztwm, and GL(1)=Response gain in first cycle for low frequency component.

Figure 24:
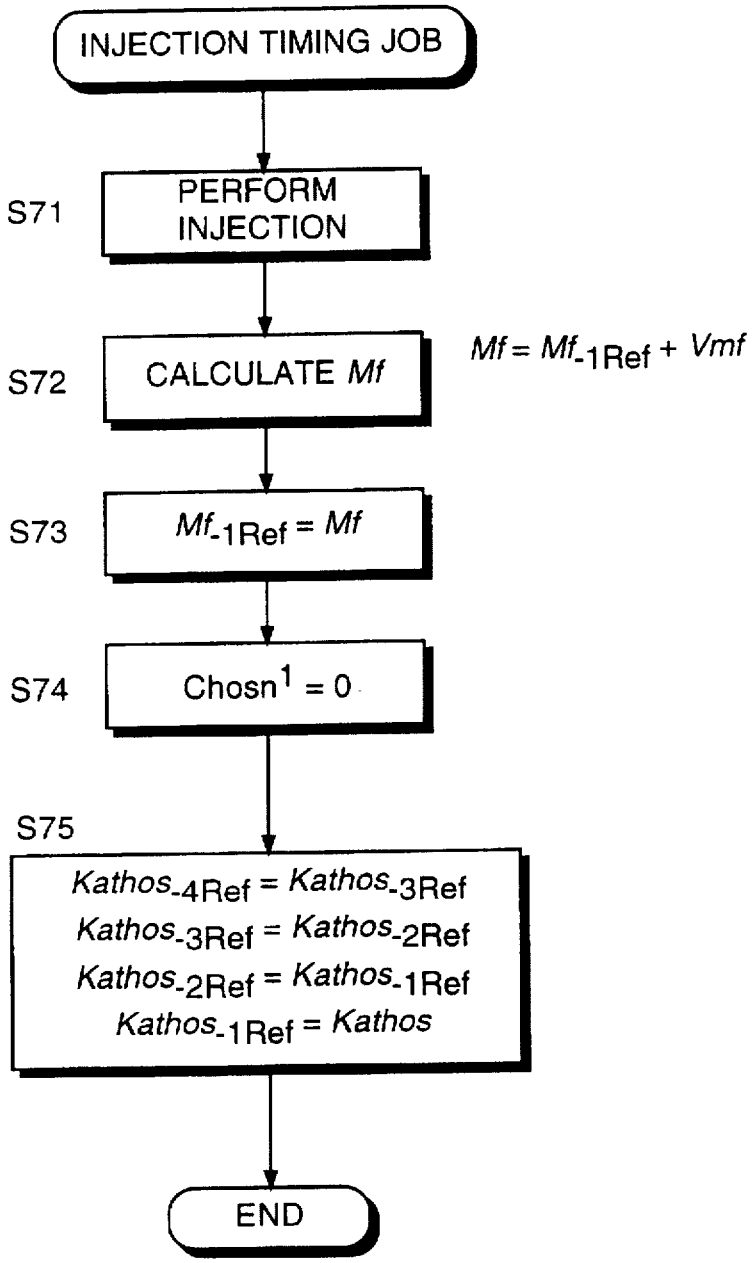
FIG. 24 is similar to FIG. 12, but showing a fourth embodiment of this invention.
Figure 25:
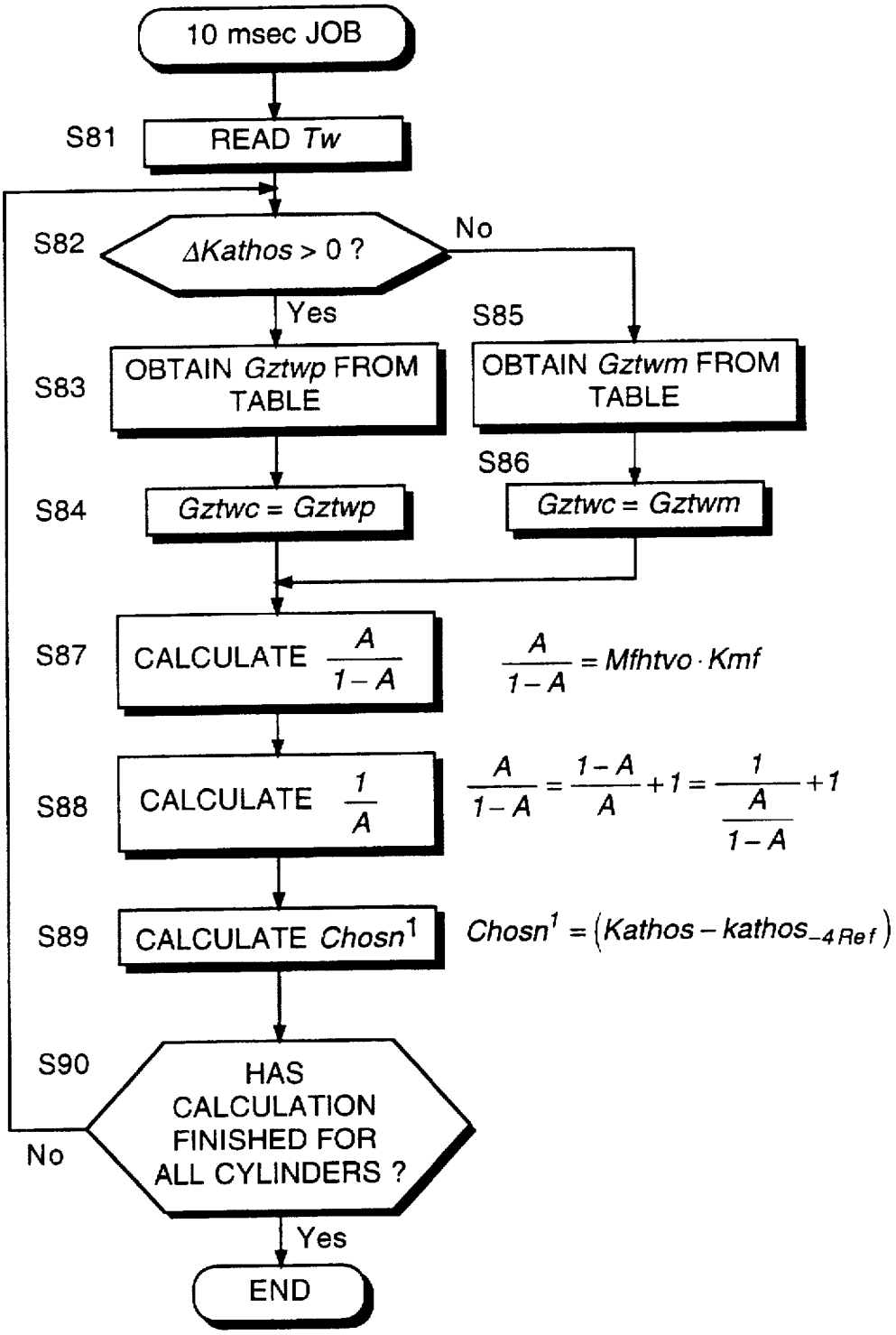
FIG. 25 is a flowchart describing a process for computing a cylinder-specific wall flow correction amount $Chosn^1$ in a first injection cycle performed by a controller according to the fourth embodiment.

Next, the cylinder specific fuel injection pulse width Tin is calculated by the above equation (7A). Specifically, the flowchart of FIG. 24 is used instead of the flowchart of FIG. 12 of the first embodiment, and a process shown in FIG. 25 is further provided for calculating $Chosn^1$.

Before describing this flowchart, an explanation will be given of how Equation (11) is theoretically derived. Since Vmf=Kathos as shown in the step S65 of FIG. 10, the following equation (13) may be used instead of the equation (11).

$$Chosn^1=(Vmf-Vmf_{-4Ref})\cdot\frac{Gztwc-1}{A} \quad (13)$$

where, $Vmf_{-4Ref}$=Vmf in the immediately preceding cycle, where 1 cycle=4Ref signals.

In the following description, however, the equation (11) will be used.

Figure 28A:
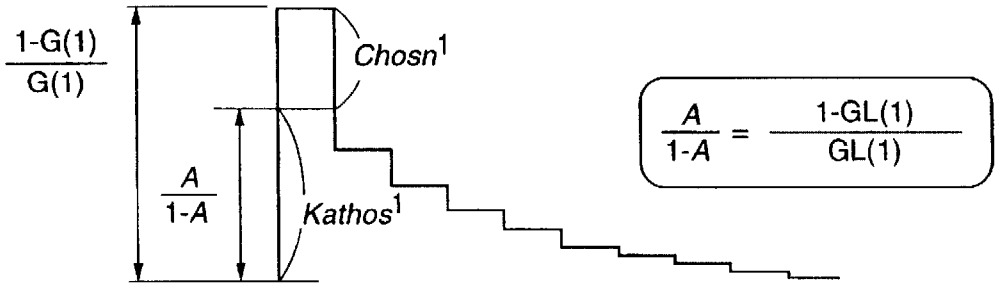
FIGS. 28A–28C are timing charts showing a relation between a low frequency component and high frequency component wall flow correction and response gain.
Figure 28B:
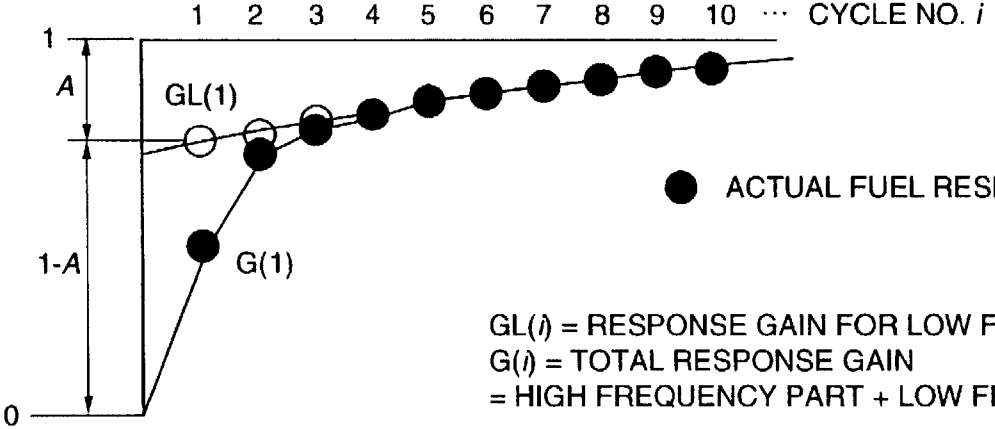
Figure 28C:
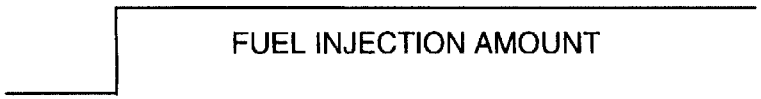

FIG. 28B shows the variation of a response gain GL(1) for the low frequency component when the target air-fuel ratio coefficient Tfbya is abruptly increased by 1, and the variation of the total response gain G(1) when the low frequency component and high frequency component are combined. FIG. 28A shows the variation of $Chosn^1$ and the cylinder-specific $Kathos^1$ at this time.

Herein, the cycle number i shows the number of injection cycles from the Tfbya variation.

GL(1) therefore shows the response gain in the first cycle for the low frequency component, and G(1) shows the total response gain in the first cycle.

In FIG. 28B, a part (1−A) of the low frequency component flows into the cylinder mixed with air, and a remaining part A deposits on the intake port walls and intake valve. Therefore, to make fuel 1 enter the cylinder as the low frequency component, the linear relation of equation (14) must hold.

$$\frac{1}{1-A}=\frac{1+Kathos^1}{1} \quad (14)$$

where, $Kathos^1$=Kathos in first cycle.

Rewriting equation (14), the following equation is obtained.

$$1+Kathos^1=\frac{1}{1-A}$$

This gives the relation of equation (15).

$$Kathos^1=\frac{1}{1-A}-1=\frac{A}{1-A} \quad (15)$$

In an actual fuel injection, only the total response gain G(1) in the first cycle enters the cylinder in the form of an air-fuel mixture, and the remaining part 1−G(1) deposits on the intake port walls and intake valve. Therefore, to supply one unit of fuel to the cylinder as the sum of the low frequency component and high frequency component, the following linear relation must hold.

$$\frac{1}{G(1)}=\frac{1+(Kathos^1+Chosn^1)}{1} \quad (16)$$

where, $Chosn^1$=Chosn in first cycle.

The following equation (17) may be derived from equation (16).

$$Kathos^1+Chosn^1=\frac{1}{G(1)}-1=\frac{1-G(1)}{G(1)}$$

$$Chosn^1=\frac{1-G(1)}{G(1)}-Kathos^1 \quad (17)$$

When Tfbya abruptly changes as shown in FIG. 28B, the wall flow correction amount ($Kathos^1$, $Chosn^1$) in the fuel injection cycle immediately after the change is easily taken into account. However, under actual transient conditions, both Avtp and Mfh vary continuously as shown in FIG. 29B and FIG. 29C.

Figures 29A, 29B, 29C, 29D:
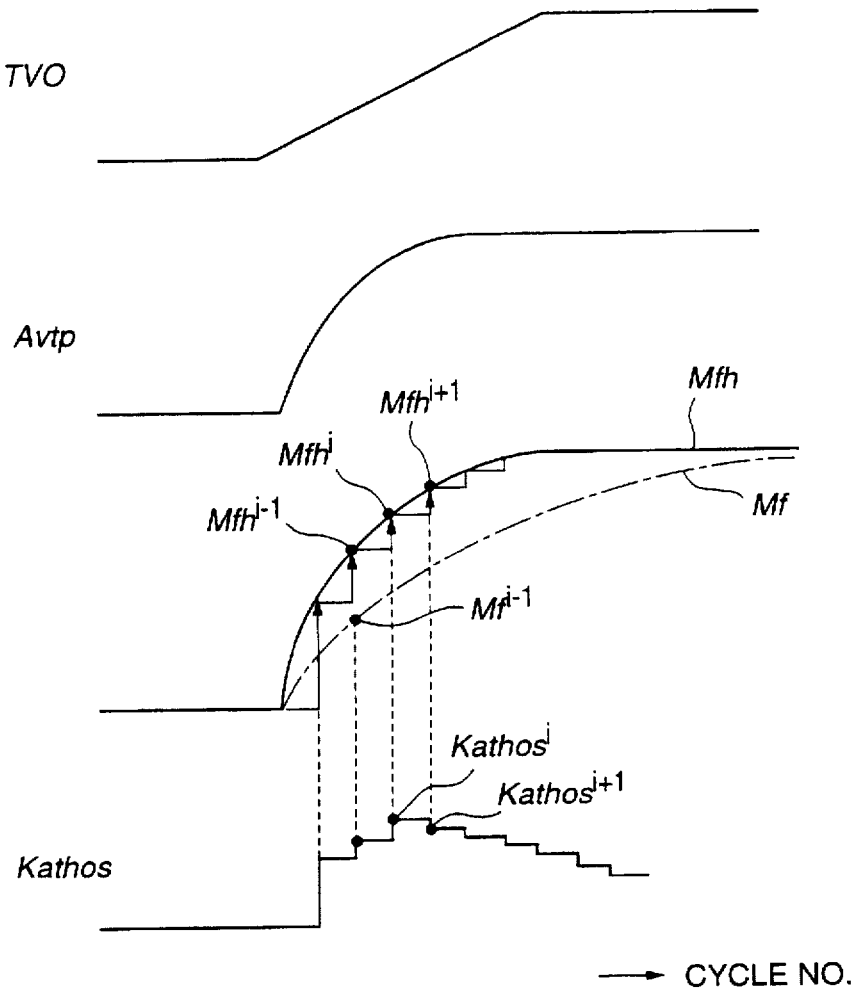
FIGS. 29A–29D are timing charts showing variations of TVO, Avtp, Mfh and Kathos in the transient state in the controller according to the fourth embodiment.
Figure 30:
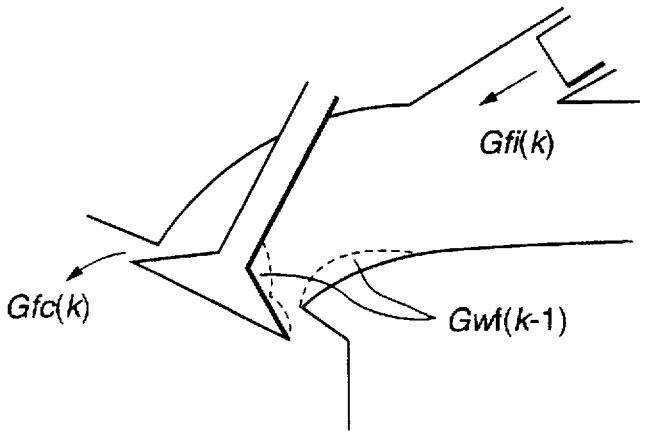
FIG. 30 PRIOR ART
FIG. 30 is a known simplified transient state wall flow model developed by H. Wu et al.

Therefore, Kathos in the ith cycle during the variation is considered as two parts in FIG. 29D, i.e.

1) A part due to variation of Mfh from the ith cycle to the (i+1)th cycle=$Kathos^{i\to i+1}$ 2) A part determined by the difference between Mf in the (i−1)th cycle and Mf in the ith cycle.

These parameters are defined as follows.

$$Kathos^{i\to i+1}=(Mfh^{i+1}-Mfh^i)\cdot Kmf \quad (18)$$

$$Kathos^i=(Mfh^i-Mfh^{i-1})\cdot Kmf \quad (19)$$

where, $Mfh^{i+1}$=Mfh in (i+1)th cycle, $Mfh^i$=Mfh in ith cycle, and $Mf^{-1}$=Mf in (i−1)th cycle.

Therefore, Kathos in the (i+1)th cycle is expressed by the following equation (20).

$$Kathos^{i+1}(Mfh^{i+1}-Mfh^i)\cdot Kmf+(Mfh^i-Mf^{i-1})\cdot Kmf \quad (20)$$

where, $Kathos^{i+1}$=Kathos in (i+1)th cycle.

Drawing an analogy with equation (6), the following equation is obtained.

$$Vmf^{i}=Kathos^{i}=(Mfh^{i}-Mf)\cdot Kmf$$

It would appear that the number of cycles in this equation and equation (19) is different. However, equation (6) is an equation for all cylinders which does not take individual cylinders into consideration, while equation (19) is a theoretical equation which applies to each cylinder, so there is no contradiction.

Shifting equation (20) by one injection cycle, Kathos for the ith cycle is expressed by the following equation (21).

$$Kathos^{i}=(Mfh^{i}-Mfh^{i-1})\cdot Kmf+(Mfh^{i-1}-Mfh^{i-2})\cdot Kmf \tag{21}$$

where, $Kathos^{i}$=Kathos for ith cycle.

For the first fuel injection after an abrupt change of Tfbya, the second term of equation (21) is unnecessary. Ignoring this term, equation (21) may be rewritten as follows.

$$Kathos^{1}=(Mfh^{1}-Mfh^{1-1})\cdot Kmf \tag{22}$$

If the continuous variation of Mfh is regarded as a sequence of minute steps in each cycle, Kathos for the first cycle may be obtained by writing i=1 in equation (22).

Equation (22) may also be rewritten as the following equation (23).

$$Kathos^{1}=(Mfh^{1}-Mf^{1-1})\cdot Kmf-(Mfh^{1-1}-Mf^{1-1})\cdot Kmf \tag{23}$$

The first term of equation (23) is Kathos in the first cycle, and the second term in equation (23) may be approximated by Kathos in the immediately preceding cycle. The following equation (24) is thereby obtained.

$$Kathos^{1}\cong Kathos-Kathos_{-1} \tag{24}$$

where, $Kathos_{-1}$=Kathos on immediately preceding occasion.

As stated hereabove, in equation (24), $Kathos^{1}$ is the correction amount for the first cycle required for each stepwise variation when the continuous variation of Mfh is regarded as a sequence of minute stepwise variations in each cycle. On the other hand, Kathos and $Kathos_{-1}$ are values computed from the difference between Mfh having a continuous variation as in the prior art, and Mf. The increase gain Gztwp is specified by the following equation (25).

$$Gztwp=\frac{GL(1)}{G(1)}=\frac{1-A}{G(1)} \tag{25}$$

As $$G(1)=\frac{1-A}{Gztwp}$$

from equation (25), this is substituted in equation (17).

$$\begin{aligned}
Chosn^{1} &= \frac{1-\frac{1-A}{Gztwp}}{\frac{1-A}{Gztwp}}-Kathos^{1} \\
&= \frac{Gztwp-(1-A)}{1-A}-\frac{A}{1-A} \\
&\quad \text{(substituting equation (15))} \\
&= \frac{Gztwp-1}{1-A}+\frac{A}{1-A}-\frac{A}{1-A} \\
&= \frac{Gztwp-1}{1-A}=\frac{Gztwp-1}{A}\cdot\frac{A}{1-A} \\
&= \frac{Gztwp-1}{A}\cdot Kathos^{1} \qquad (26) \\
&\quad \text{(substituting equation (15))} \\
&\cong \frac{Gztwp-1}{A}\cdot(Kathos-Kathos_{-4Ref}) \qquad (27) \\
&\quad \text{(substituting equation (20))}
\end{aligned}$$

Herein, for a four cylinder engine MPI system and sequential injection, $Kathos_{-1}$ which is Kathos for the immediately preceding cycle, is the value four Ref signals prior to the present time, so equation (27) may be expressed as equation (28).

$$Chosn^{1}\cong\frac{Gtwp-1}{A}\cdot(Kathos-Kathos_{-4Ref}) \tag{28}$$

Figure 31A:
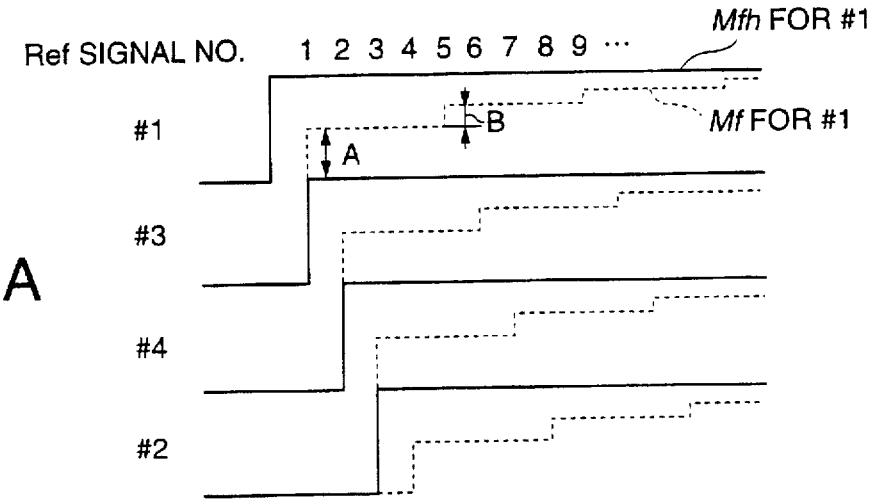
FIGS. 31A–31C are timing charts describing variations of the deposition amount Mf and transient correction amount Kathos in the controller according to the fourth embodiment.
Figure 31B:
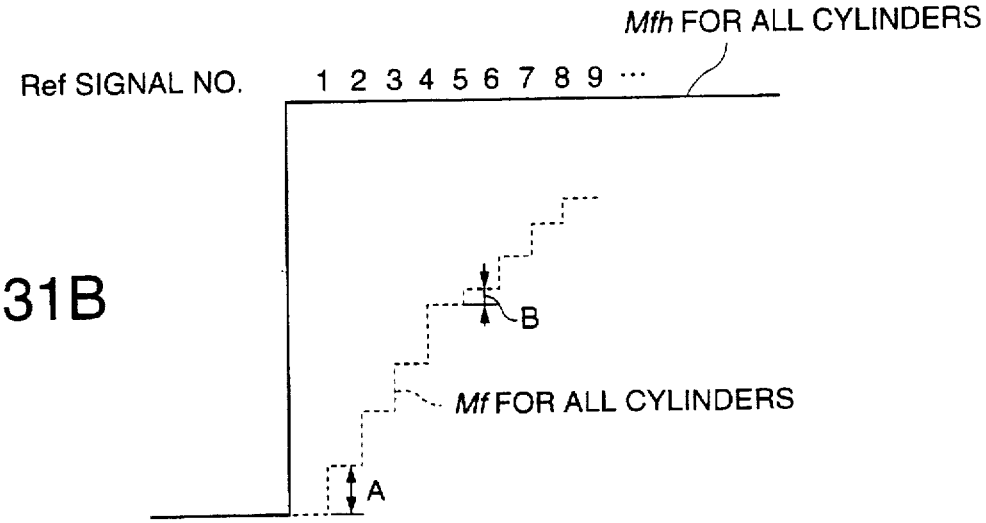
Figure 31C:
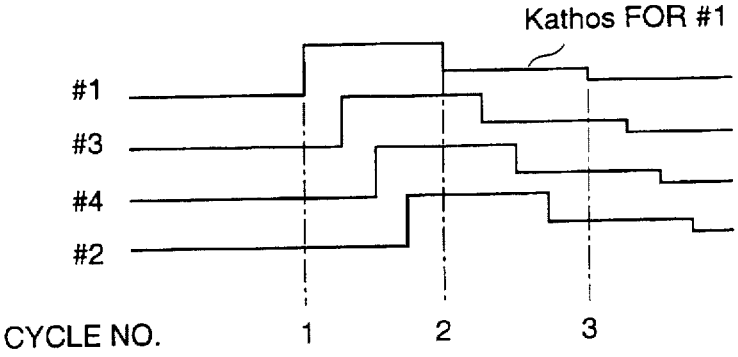

Kathos in FIG. 29D is a value specific for each cylinder, and it varies every 4Ref signals as shown in FIG. 31C. This is due to the fact that the value of Kathos for each cylinder in the immediately preceding cycle is the value 4Ref signals prior to the present time. FIG. 31A shows the stepwise variation of the cylinder-specific Mfh and the response of Mf, FIG. 31B shows the stepwise variation of Mfh for all cylinders and the response of Mf.

The approximation (28) thus obtained corresponds to the aforesaid calculation (11).

According to equation (11), $Chosn^{1}$ which is a wall flow correction for the high frequency component, is computed from the variation amount of Kathos, which is a wall flow correction for the low frequency component, relative to its value in the immediately preceding cycle, i.e. 4Ref signals previously, and from the response gain A in the first cycle for the low frequency component.

Next, the method of computing the response gain A in the first cycle for the low frequency component will be described. Equation (31) is an equation which expresses a fuel injection amount Gfi(k) from the fuel injection valve 7. Equation (32) is an equation which expresses a cylinder intake fuel amount Gfc(k).

$$Gfi(k)=(Gfst0+\Delta Gfst)\cdot Tfbya+Gftr(n) \tag{31}$$

$$Gfc(k)=(1-A)\cdot Gfi(k)+Gwf(k-1)\cdot\frac{\Delta t}{\tau} \tag{32}$$

where,

Gfi(k)=fuel injection amount in kth cycle (FIG. 30),

Gfst0=steady state injection amount,

ΔGfst=variation of steady state injection amount,

Tfbya=target air-fuel ratio coefficient,

Gftr(k)=transient state correction amount in kth cycle,

A=response gain for low frequency component,

Gfc(k)=cylinder intake fuel amount in kth cycle (FIG. 30),

Gwf(k−1)=wall flow fuel amount in (k−1)th cycle (FIG. 30), $\Delta t$=control period, and $\tau$=time constant of response for low frequency component.

Herein, equation (31) is a new model due to this invention, and it comprises a steady state part expressed by the first term and a transient state correction part expressed by the second term.

Equation (32) is a simplified model disclosed by H. Wu et al in "Analysis of Fuel Behavior in an Intake Port in a Fuel Injection Engine", page 76, Proceedings of the Institute of Automobile Technology, published in October 1990.

In this latter model, the cylinder intake amount due to wall flow is expressed with a first order delay, i.e. the second term of equation (32) expresses the fact that a part of the wall flow fuel represented by $\Delta t/\tau$ flows into the cylinder. In equation (32), the units of Gfst0, DGfst, Gftr(k), Gfi(k), Gwf(k−1) are fuel mass per cycle. Herein, the required cylinder intake fuel amount is given by the following equation (33).

$$Gbc(k)=(Gfst0+\Delta Gfst)\cdot Tfbya \tag{33}$$

where, Gbc(k)=required cylinder intake fuel amount in kth cycle.

In order that the fuel amount Gbc(k) is taken into the cylinder, it is necessary that Gbc(k)=Gfc(k). Substituting equations (31) and (32) into this relation, the following relation is obtained.

$$\begin{aligned}&(Gfst0+Gfst)\cdot Tfbya\\ =\ &(1-A)\cdot Gfi(k)+Gwf(k-1)\cdot\frac{\Delta t}{\tau}\\ =\ &(1-A)\cdot(Gfst0+\Delta Gfst)\cdot Tfbya+\\ &(1-A)\cdot Gftr(k)+Gwf(k-1)\cdot\frac{\Delta t}{\tau}\end{aligned}$$

Rearranging this equation in terms of Gftr(k), $$\begin{aligned}Gftr(k) &= \frac{1}{1-A}\cdot\left\{A\cdot(Gfst0+\Delta Gfst)\cdot Tfbya-Gwf(k-1)\cdot\frac{\Delta t}{\tau}\right\}\\ &= \left\{\left(A\cdot\frac{\tau}{\Delta t}\right)\cdot(Gfst0+\Delta Gfst)\cdot Tfbya-Gwf(k-1)\right\}\cdot\frac{1}{1-A}\cdot\frac{\Delta t}{\tau}\end{aligned} \tag{34}$$

By making the following substitutions in equation (34), equation (35) is obtained.

Gftr(k) is substituted by Kathos, $$A\cdot\frac{\tau}{\Delta t}$$

is substituted by Mfhtvo, (Gfst0+DGfst) is substituted by Avtp, Gwf(k−1) is substituted by Mf(i−1) and $$\frac{1}{1-A}\cdot\frac{\Delta t}{\tau}$$

is substituted by Kmf.

Then, $$\begin{aligned}Kathos^i &= (Mfhtvo\cdot Avtp\cdot Tfbya-Mf^{i-1})\cdot Kmf\\ &= (Mfh^i-Mf^{i-1})\cdot Kmf\end{aligned} \tag{35}$$

Calculating Mfhtvo·Kmf, the following equation (36) is obtained.

$$Mfhtvo\cdot Kmf=A\cdot\frac{\tau}{\Delta t}\cdot\frac{1}{1-A}\cdot\frac{\Delta t}{\tau}=\frac{A}{1-A} \tag{36}$$

From equation (36), equations (37) and (38) are obtained.

$$\frac{1}{A} = \frac{1-A}{A}+1 \tag{37}$$

$$= \frac{1}{MfhtVo\cdot Kmf}+1 \tag{38}$$

Using equation (38), the response gain for the low frequency component can be obtained without experimentally setting it.

In a single point injection (SPI) system, equations (36A), (38A) are used instead of equations (36), (38).

$$Mfhtvo\cdot Kmf\cdot CYLNDR\#=\frac{A}{1-A} \tag{36A}$$

$$\frac{1}{A}=\frac{1}{Mfhtvo\cdot Kmf\cdot CYLNDR\#}+1 \tag{38A}$$

Next, the flowcharts of FIGS. 24 and 25 according to the fourth embodiment will be described.

The flowchart of FIG. 25 shows a process for computing $Chosn^1$ using equation (11). This process is executed at an interval of 10 milliseconds.

Figure 12:
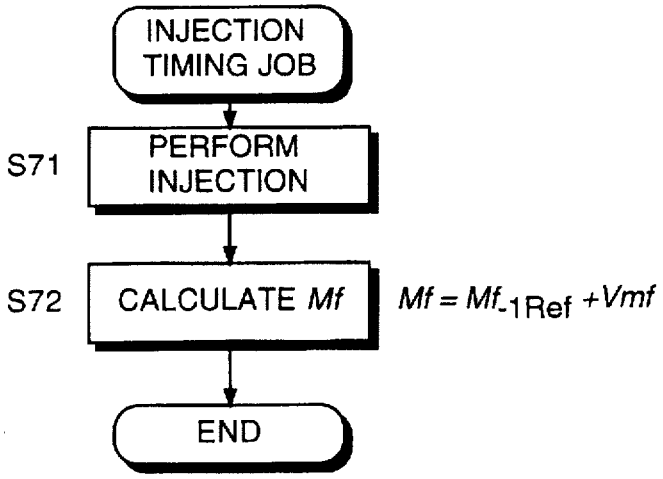
FIG. 12 is a flowchart describing a process for computing an deposition amount Mf performed by the controller.

The flowchart of FIG. 24 is provided to save current data to be used for calculating the next fuel injection amount as in the case of the flowchart of FIG. 12. The flowchart of FIG. 24 comprises additional steps S74, S75 for updating the transient correction amount of the flowchart of FIG. 12.

Herein, after fuel injection, the wall flow high frequency component correction amount $Chosn^1$ is reset to 0 in the step S74 via the steps S71–S73. Next, in a step S75, Kathos for 4Ref signals, i.e. one injection cycle, is stored in memory. In other words, the values stored in $Kathos_{-4Ref}$ to Kathos-2Ref are respectively replaced by those stored in $Kathos_{3Ref}$ to $Kathos_{-1Ref}$.

Then, the latest wall flow low component correction amount Kathos is stored in $Kathos_{-1Ref}$.

The process for computing $Chosn^1$ of FIG. 25 uses the stored value of $Kathos_{-4Ref}$. In addition to $Kathos_{-4Ref}$, the computation of $Chosn^1$ requires the deposition factor Mfhtvo, the quantity proportion Kmf and the transient correction amount Kathos. These were already obtained by the process for calculating Kathos of FIG. 10.

In the process of FIG. 25, the cooling water temperature Tw is read first in a step S81.

In a step S82, a variation ΔKathos of the wall flow low frequency component correction amount Kathos found from the next equation (41), is compared with 0.

$$\Delta Kathos=Kathos-Kathos_{-4Ref} \tag{41}$$

When ΔKathos>0, i.e. during acceleration, the routine proceeds to a step S83 to calculate an increase amount gain Gztwp, and this Gztwp is input to a gain Gztwc in a step S84.

When ΔKathos is not larger than 0, the routine proceeds to a step S85 where a decrease amount gain Gztwm is calculated, and this Gztwm is input to the gain Gztwc in a step S86.

Figure 26:
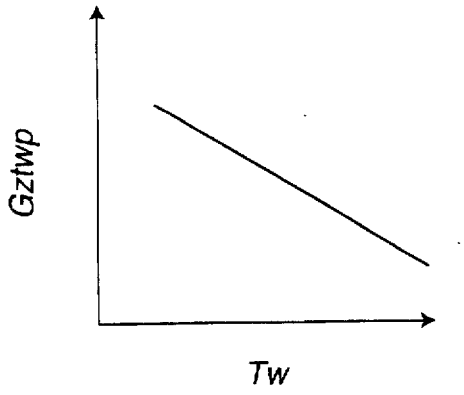
FIG. 26 is a graph showing the contents of a table of an increase amount gain Gztwp stored in the controller according to the fourth embodiment.
Figure 27:
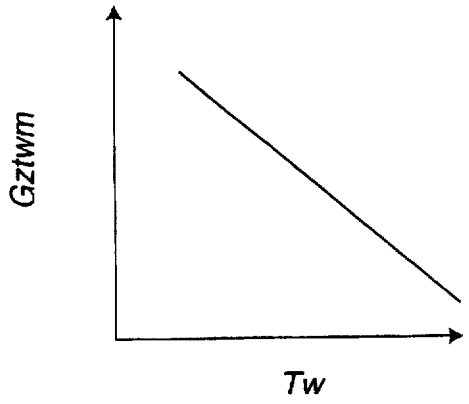
FIG. 27 is a characteristic diagram showing the contents of a table of a decrease gain Gztwm stored in the controller according to the fourth embodiment.

The gains Gztwp and Gztwm are used to perform water temperature corrections. They are found by from the cooling water temperature by looking up tables of which the contents are shown in FIG. 26 and FIG. 27, and performing interpolation calculations.

In a step S87, the value of $$\frac{A}{1-A}$$

is calculated by the aforesaid equation (36). The value of $$\frac{1}{A}$$

on the left-hand side of the equation $$\frac{1}{A}=\frac{1}{\frac{A}{1-A}}+1$$

is found by substituting this value of $$\frac{A}{1-A}$$

on the right-hand side in a step S88. Using this value of $$\frac{1}{A}$$

and Kathos, $Kathos_{-4Ref}$ and Gztwc, $Chosn^1$ is calculated by the above equation (11) in a step S89.

In a step S90, it is determined whether or not the calculation of $Chosn^1$ is complete for all cylinders, and if it is not complete, the steps S81–S90 are repeated. The time required to compute $Chosn^1$ for all cylinders is much shorter than 10 milliseconds, the computation interval of the process, so there is no risk that the process will begin executing again before computation of $Chosn^1$ has been completed for all cylinders.

According to this fourth embodiment, the steady state deposition amount Mfh is computed based also on the target air-fuel ratio coefficient Tfbya as a parameter. Kathos is computed based on this Mfh, and $Chosn^1$ which is a wall flow correction amount for the high frequency component is computed from the difference between Kathos and $Kathos_{-4Ref}$ for the immediately preceding cycle. $Chosn^1$ is therefore different from the wall flow high frequency component correction disclosed in the aforesaid Tokkai-Hei 1-305144 and Tokkai-Hei 3-111639 of the aforesaid prior art, and it varies with the variation of the target air-fuel ratio coefficient Tfbya. As a result, during for example deceleration from the power-oriented air-fuel ratio region, the absolute value of Chosn is greater than that of the prior art. Hence, temporary overrich due to deceleration from the output air-fuel ratio region can be more effectively prevented.

The situation is the same during acceleration when the target air-fuel ratio coefficient Tfbya is changing to a higher value, and temporarily overlean due acceleration from a lean air-fuel ratio region is also prevented.

Using the wall flow correction amounts for the high frequency component of the prior art, a correction is made by Gztwp and Gztwm depending on the cooling water temperature Tw. However since no correction is made for engine rotation speed or load, if the engine rotation speed or load are different from their values when Gztwp and Gztwm were matched, the wall flow correction amount for the high frequency component will no longer be suitable. An attempt may be made to correct for this by adding a new rotation correction term and load correction term, but the number of terms to be matched to each other then increases and the number of steps in the matching process increases.

Moreover as $Chosn^1$ is computed based on Kathos which varies according to engine rotation speed and load as shown in equation (11), the correction amount $Chosn^1$ automatically also corresponds to engine rotation speed and load. Consequently, when engine speed and load deviate from the engine speed and load when Gztwp, Gztwm were set, a value of $Chosn^1$ corresponding to the deviated engine rotation speed and load is obtained.

The response gain A for the low frequency component also has a value corresponding to the engine rotation speed and load, hence $Chosn^1$ closely follows the behavior of the high frequency component due to a change of engine rotation speed region. For example when the engine rotation speed increases, even for the same engine load, the reference deposition factor rotation term $Mfhn_i$ is less than that at low rotation speed as shown in FIG. 14. The deposition factor Mfhtvo(=MfhQi·Mfhni) is therefore less than at low rotation speed. Also, the quantity proportion rotation correction factor Kmfn is slightly less than at low rotation speed and Kmf (=Kmfat·Kmfn) is also slightly less than at low rotation speed. As a result, $$Mfhtvo \cdot Kmf=\frac{A}{1-A}$$

decreases, and the response gain A decreases. When the engine rotation speed is high, GL(1) and G(1) are both large, but $$Gztwp\left(\frac{GL(1)}{G(1)}\right)$$

do not vary much even at high engine rotation speed. Consequently at high rotation speed, $Chosn^1$ increases as the response gain A becomes smaller. In the high rotation speed region, the high frequency component increases as the low frequency component decreases which is why Chosn is applied. By applying a value of $Chosn^1$ which becomes larger as the engine rotation speed increases in this way, therefore, a proper correction for the high frequency component can be made.

It will moreover be understood that the fourth embodiment may be combined with the aforesaid second or third embodiments.

Figure 32:
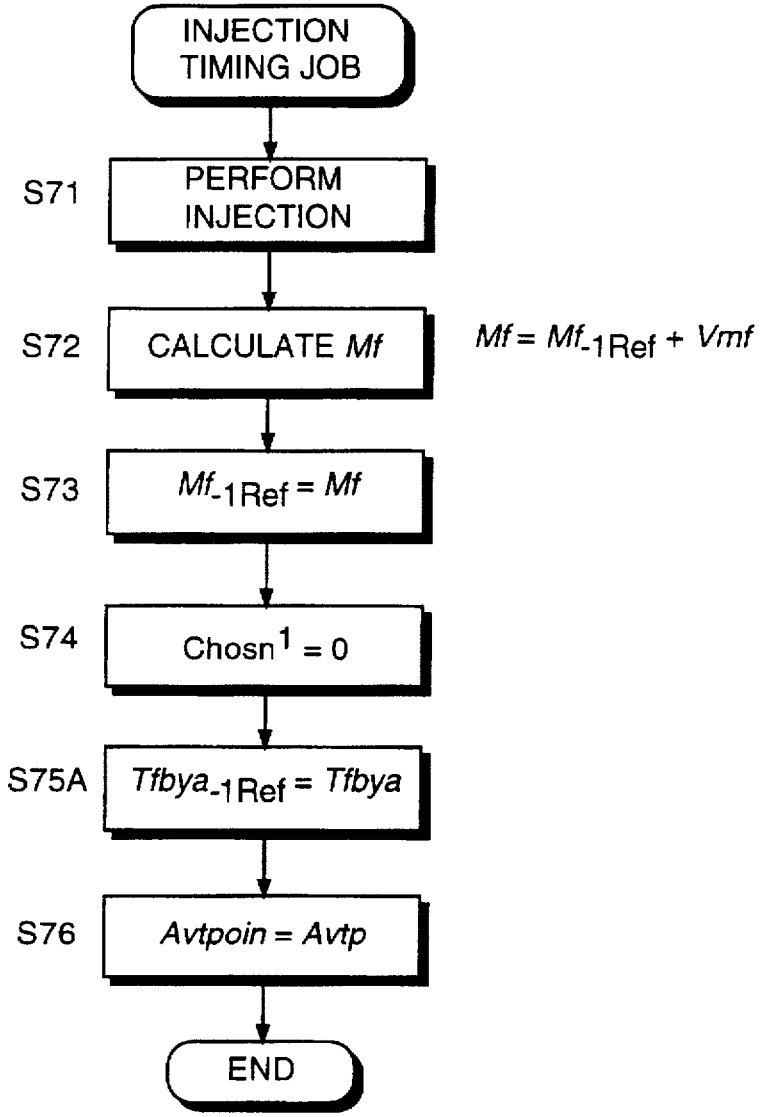
FIG. 32 is similar to FIG. 12, but showing a fifth embodiment of this invention.
Figure 33:
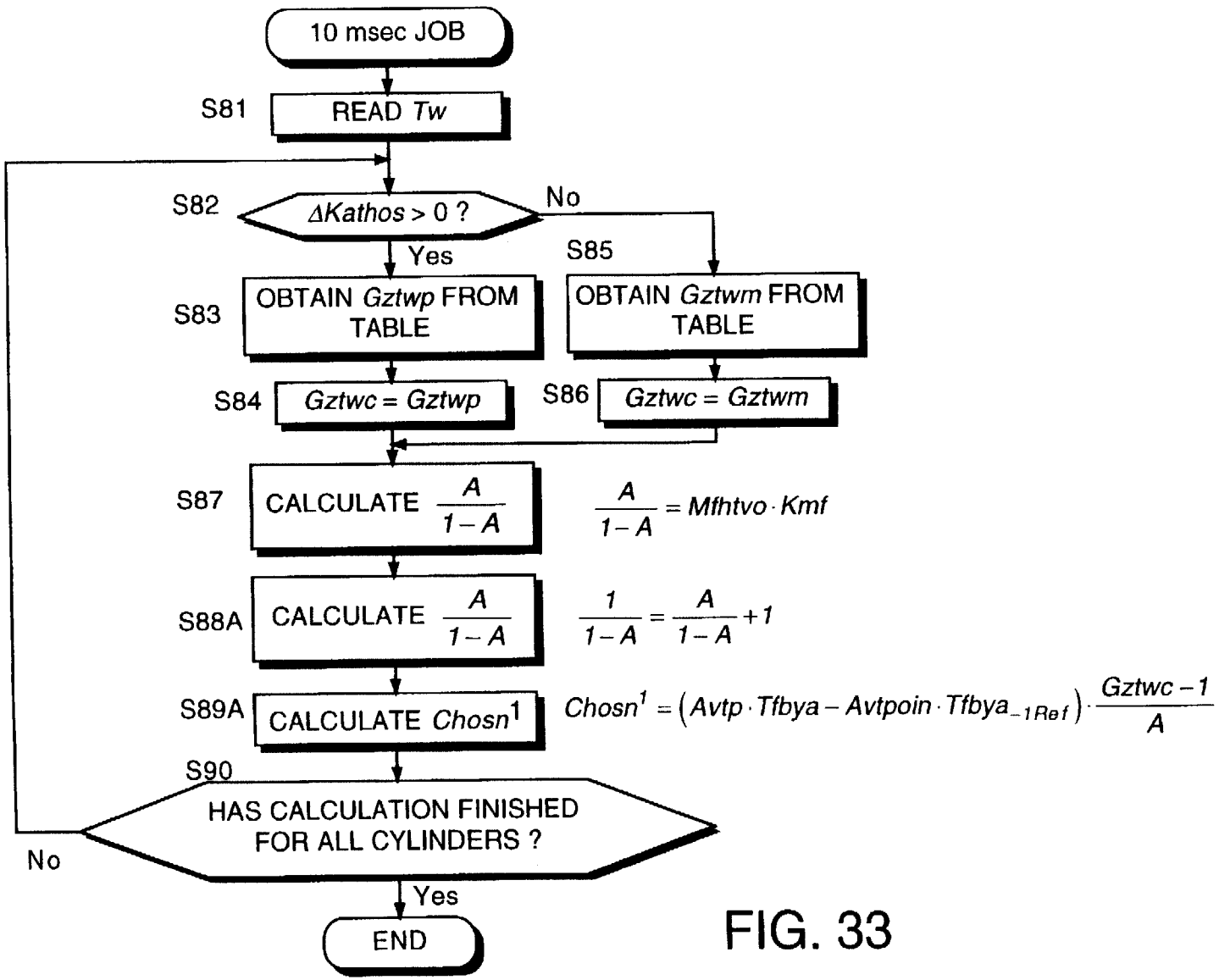
FIG. 33 is similar to FIG. 25, but showing the fifth embodiment of this invention.

FIGS. 32 and 33 show a fifth embodiment of this invention.

According to this embodiment, the flowchart of FIG. 32 is used instead of the flowchart of FIG. 24 of the fourth embodiment, and the flowchart of FIG. 33 is used instead of the flowchart of FIG. 25 of the fourth embodiment.

Differences from the fourth embodiment are that the step S75 is replaced by a step S75A, the steps S88, S89 are replaced by steps S88A, S89A, and a step S76 is added. Also whereas equation (11) used in the fourth embodiment was an approximation, the following equation (51) which is more precise is used in this embodiment.

$$Chosn^1=\frac{Gztwc-1}{1-A}\cdot(Avtp\cdot Tfbya-Avtpoin\cdot Tfbya_{-4Ref}) \quad (51)$$

where,

Avtpoin=value of Avtp in immediately preceding cycle and $Tfbya_{-4Ref}$=value of Tfbya in immediately preceding cycle.

Avtpoin and $Avtp_{-1}$ of equation (2) are both values for the immediately preceding occasion, however the former is the value in the process executed every injection cycle, and the latter is the value in the process executed every 10 milliseconds. These values are different.

Avtpoin is stored in the step S76 of FIG. 32.

Formula (51) is derived as follows. When the following equations (52) (53) are substituted in equation (22) and equation (27) is further substituted, equation (22) may be rewritten as equation (54).

$$Mfh^1 = Mfhtvo \cdot Kmf \cdot Avtp \cdot Tfbya \quad (52)$$

$$Mfh^{1-1} = Mfhtvo \cdot Kmf \cdot Avtpoin \cdot Tfbya_{-4Ref} \quad (53)$$

where, $Mfh^{1-1}$=value of $Mfh^1$ on the immediately preceding occasion.

$$\begin{aligned} Kathos^1 &= (Mfh^1 - Mfh^{1-1}) \cdot Kmf \quad (54) \\ &= Mfhtvo \cdot Kmf \cdot (Avtp \cdot Tfbya - Avtpoin \cdot Tfbya_{-4REF}) \\ &= \frac{A}{1-A} \cdot (Avtp \cdot Tfbya - Avtpoin \cdot Tfbya_{-4REF}) \end{aligned}$$

Substituting equation (54) into equation (26), the following equation (55) is obtained. This equation is identical to equation (51).

$$\begin{aligned} Chosn^1 &= \frac{Gztwp-1}{A} \cdot Kathos^1 \quad (55) \\ &= \frac{Gztwp-1}{A} \cdot \frac{A}{1-A} \cdot (Avtp \cdot Tfbya - Avtpoin \cdot Tfbya_{-4Ref}) \\ &= \frac{Gztwp-1}{1-A} \cdot (Avtp \cdot Tfbya - Avtpoin \cdot Tfbya_{-4Ref}) \end{aligned}$$

In a step S88A of FIG. 33, $$\frac{1}{1-A}$$

is calculated by the following equation (56) from the value of $$\frac{A}{1-A}$$

found in the step S87.

$$\frac{1}{1-A} = \frac{A}{1-A} + 1 \quad (56)$$

In a next step S89A, $Chosn^1$ is calculated by equation (51).

According to the fifth embodiment, $Chosn^1$ is calculated more precisely, so the control precision of the air fuel ratio is improved when the air-fuel ratio is changed over.

Figure 34:
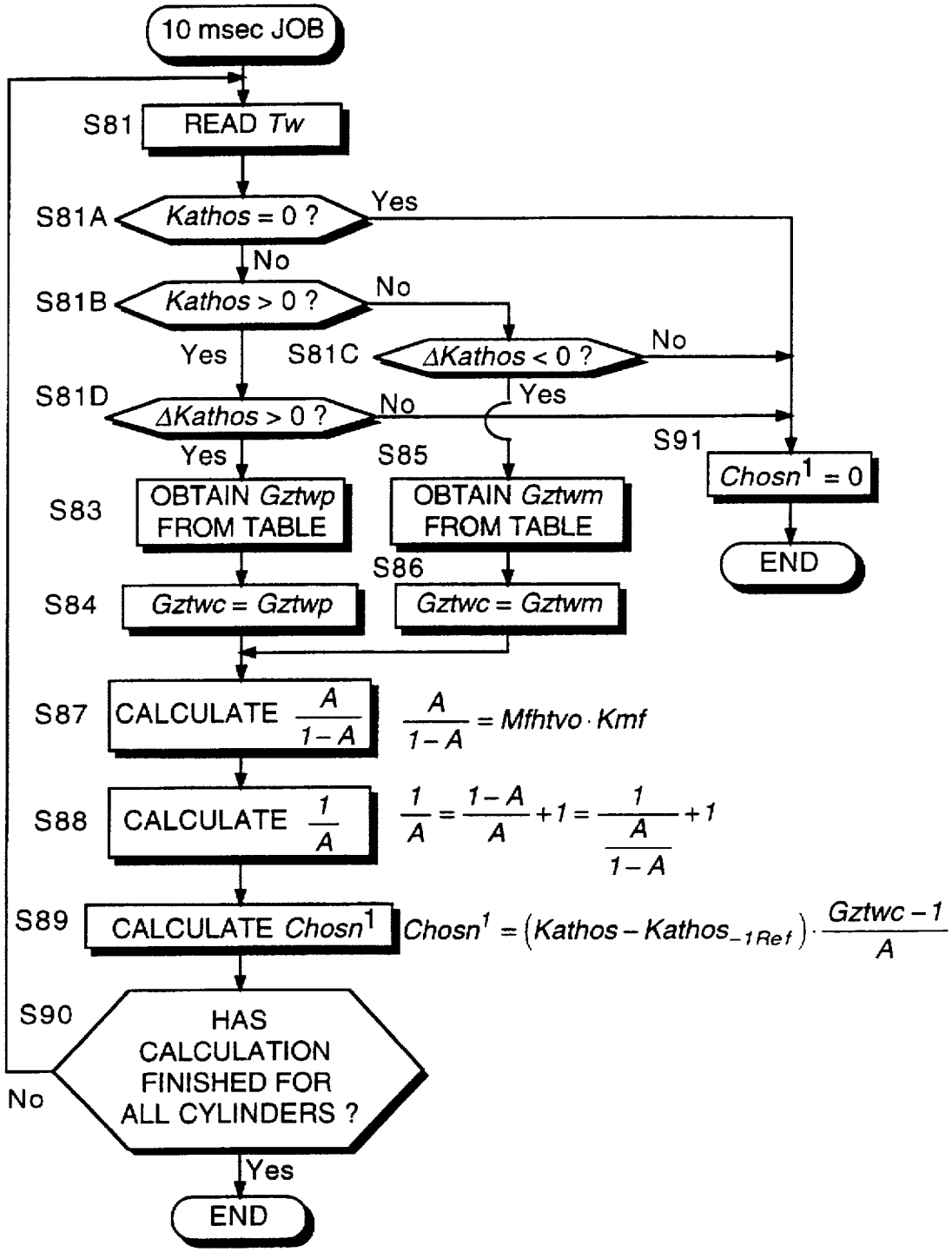
FIG. 34 is similar to FIG. 25, but showing a sixth embodiment of this invention.

FIG. 34 shows a sixth embodiment of this invention.

When the inventor performed experiments according to the fourth embodiment, he discovered a tendency for the air-fuel ratio to become slightly leaner during the latter half of acceleration, and a tendency for the air-fuel ratio to become slightly richer during the latter half of deceleration.

As a result of analysis of the situation when the accelerator was depressed to accelerate the vehicle when Tfbya was fixed, i.e. when for example Ne and Avtp were in a lean burn operation region or power-oriented air-fuel ratio region, the inventor reached the following conclusions.

Figures 36A, 36B, 36C:
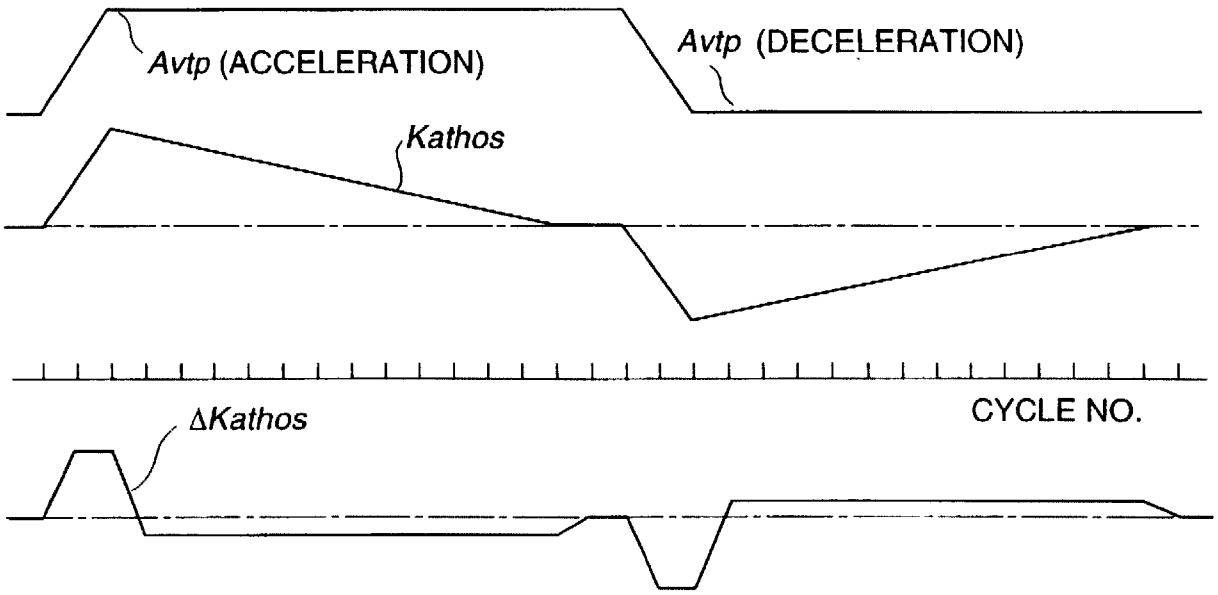
FIGS. 36A–36C are timing charts showing variations of Avtp, Kathos and ΔKathos in the controller according to the sixth embodiment.
Figures 37A, 37B, 37C:
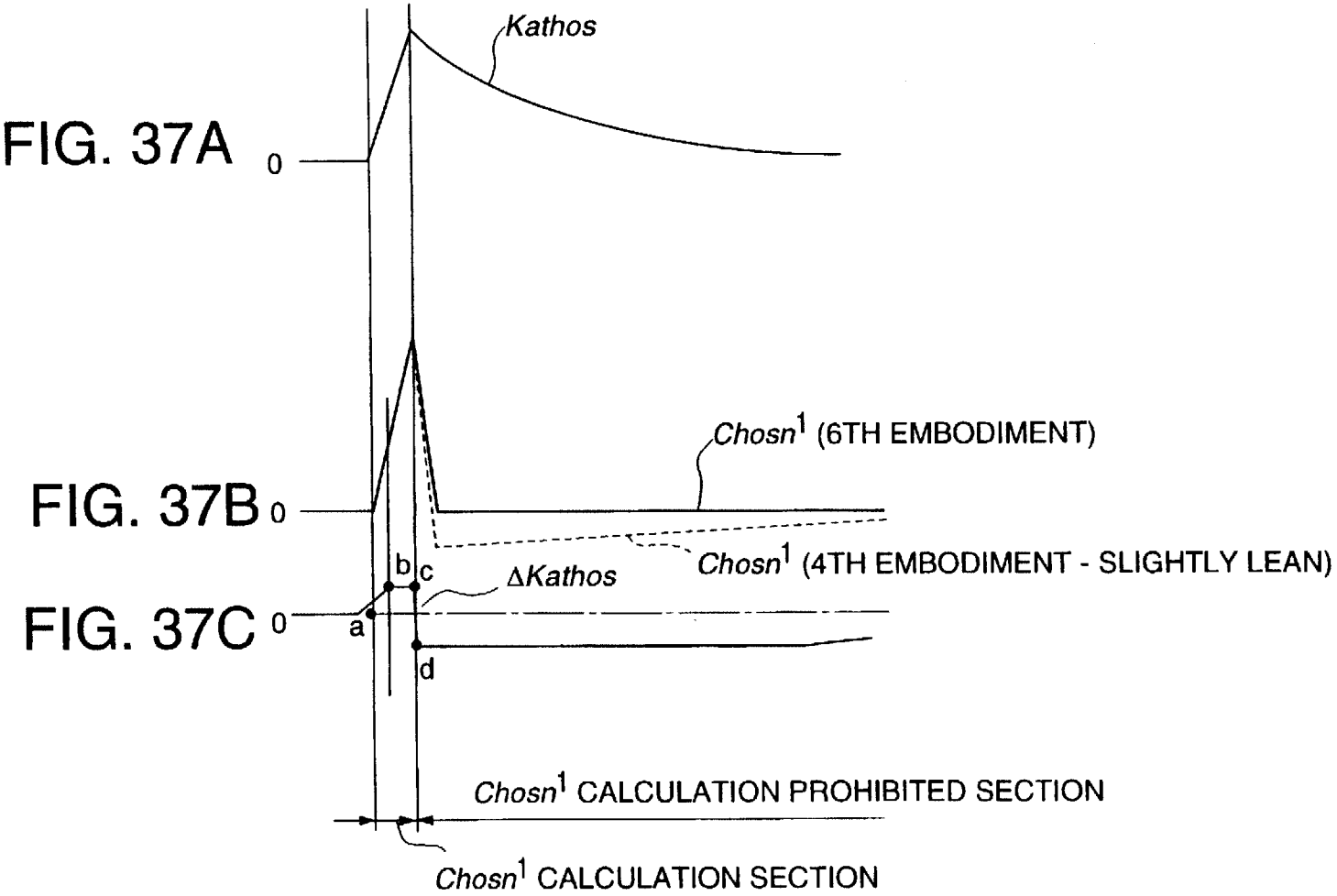
FIGS. 37A–37C are timing charts describing differences of $Chosn^1$ between the fourth embodiment and sixth embodiment.

In the initial stages of acceleration, Kathos is large, and then decreases as shown in FIG. 36B and FIG. 37A.

After Kathos has begun to decrease, i.e. in the latter half of acceleration, the variation amount ΔKathos from the immediately preceding injection is negative, and $Chosn^1$ also has a negative value.

This appears to be the reason why the air-fuel ratio becomes leaner in the latter half of acceleration.

Similarly, when Kathos has begun to increase during deceleration, ΔKathos takes a positive value and $Chosn^1$ also takes a positive value.

This appears to be the reason why the air-fuel ratio becomes richer in the latter half of deceleration.

Therefore according to the sixth embodiment, in the latter half of acceleration and deceleration, $Chosn^1$ is set to 0 under predetermined conditions.

FIG. 34 corresponds to FIG. 25, but comprises further steps S81A–S81D and a step S91.

Of these steps, the steps S81A–S81D are used to determine whether the computation of Chosn should be prohibited.

In the steps S81A, S81B, it is determined whether the value of Kathos itself is positive or negative.

In the steps S81C, S81D, it is determined whether the variation amount ΔKathos is positive or negative.

When either of the following two conditions is found to hold as a result of this process, the calculation of $Chosn^1$ is performed, otherwise $Chosn^1$ is set to 0 to prohibit calculation of $Chosn^1$.

1. Kathos>0 and ΔKathos>0
2. Kathos<0 and ΔKathos<0

Therefore, during acceleration when Kathos>0, $Chosn^1$ becomes 0 at a time when ΔKathos has reached 0 from a positive value.

Also, during deceleration when Kathos<0, $Chosn^1$ becomes 0 at a time when ΔKathos has reached 0 from a negative value.

This prevents the air-fuel ratio from tending to lean during the latter half of acceleration and to rich during the latter half of deceleration.

When the accelerator pedal is depressed and Tfbya also varies, i.e. for example during an acceleration when there is a variation from a lean burn operation region to the stoichiometric air-fuel ratio region, this sixth embodiment is still effective.

In this embodiment, it may occur that Avtp is constant, i.e. ΔAvtp is 0, and only Tfbya varies. In this case even when ΔAvtp is 0, either Gztwp and Gztwm will always be selected if either of the aforesaid constitutions 1 or 2 holds.

Figure 35:
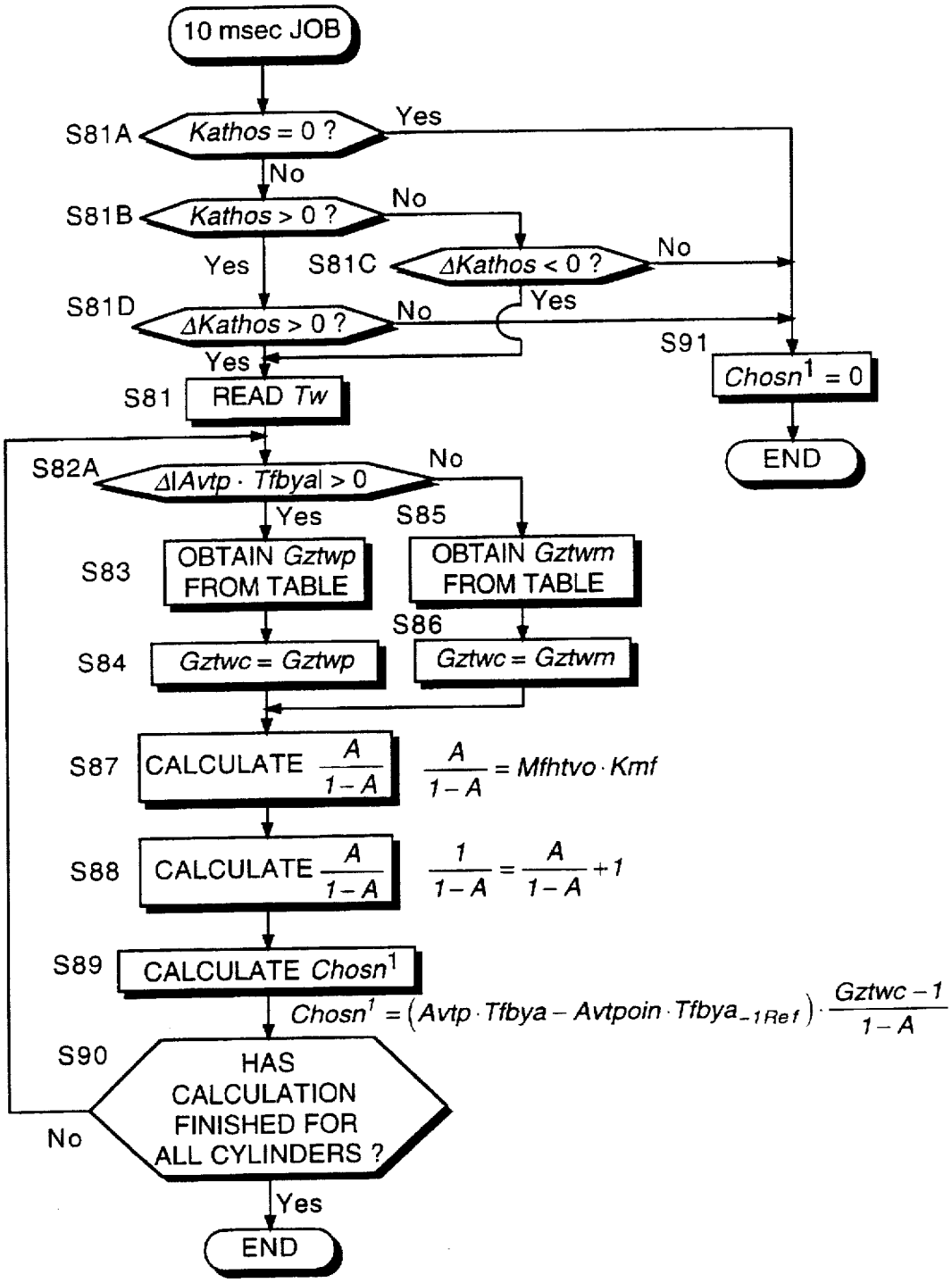
FIG. 35 is similar to FIG. 34, but showing another flowchart that can be applied to the controller according to the sixth embodiment.

In this regard, FIG. 35 shows a variation of the sixth embodiment. Herein, a step S82A is added to make this selection more precisely by comparing Δ|Avtgp·Tfbya| with 0.

The fourth to sixth embodiments are based on Tokugan-Hei 8-173802 filed on Jul. 3, 1996 to the Japanese Patent Office.

FIG. 38 to FIG. 42 show a seventh embodiment of this invention.

In a vehicle having an automatic transmission, when the engine rotation speed is equal to or greater than a predetermined value and the vehicle speed is within a predetermined range and the driver takes his foot OFF the accelerator pedal, fuel supply to a specific cylinder may be cut.

In this case, if the accelerator pedal is not depressed so that the vehicle speed decreases to or less than a predetermined value or if the accelerator pedal is depressed so that the vehicle again accelerates, fuel supply starts again and fuel recovery takes place.

In the above-mentioned embodiments, cylinder-specific fuel cut as in the above case is not considered in the calculation of $Chosn^1$.

Consequently when cylinder-specific fuel cut is performed, an optimum value of $Chosn^1$ cannot be obtained for fuel recovery.

The seventh embodiment concerns an engine wherein cylinder-specific fuel cut is performed.

In cylinders where fuel cut occurs, a decreasing wall flow is predicted and a deposition amount during fuel cut is calculated for each cylinder.

Then, using a cylinder-specific deposition amount Mfn during fuel cut, $Chosn^1$ is calculated during fuel recovery in the cylinders where fuel cut was performed.

Figure 38:
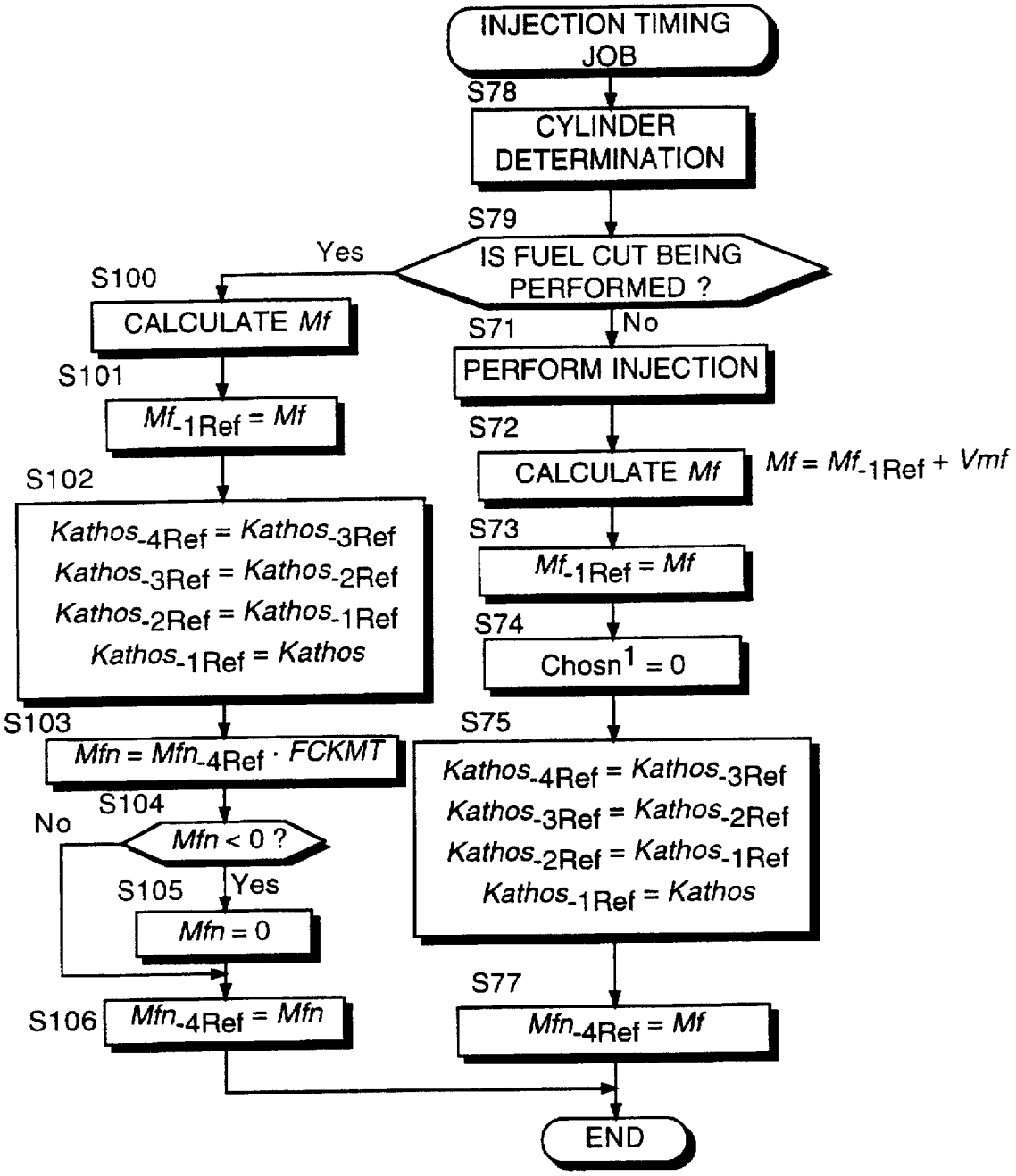
FIG. 38 is similar to FIG. 24, but showing a seventh embodiment of this invention.
Figure 39:
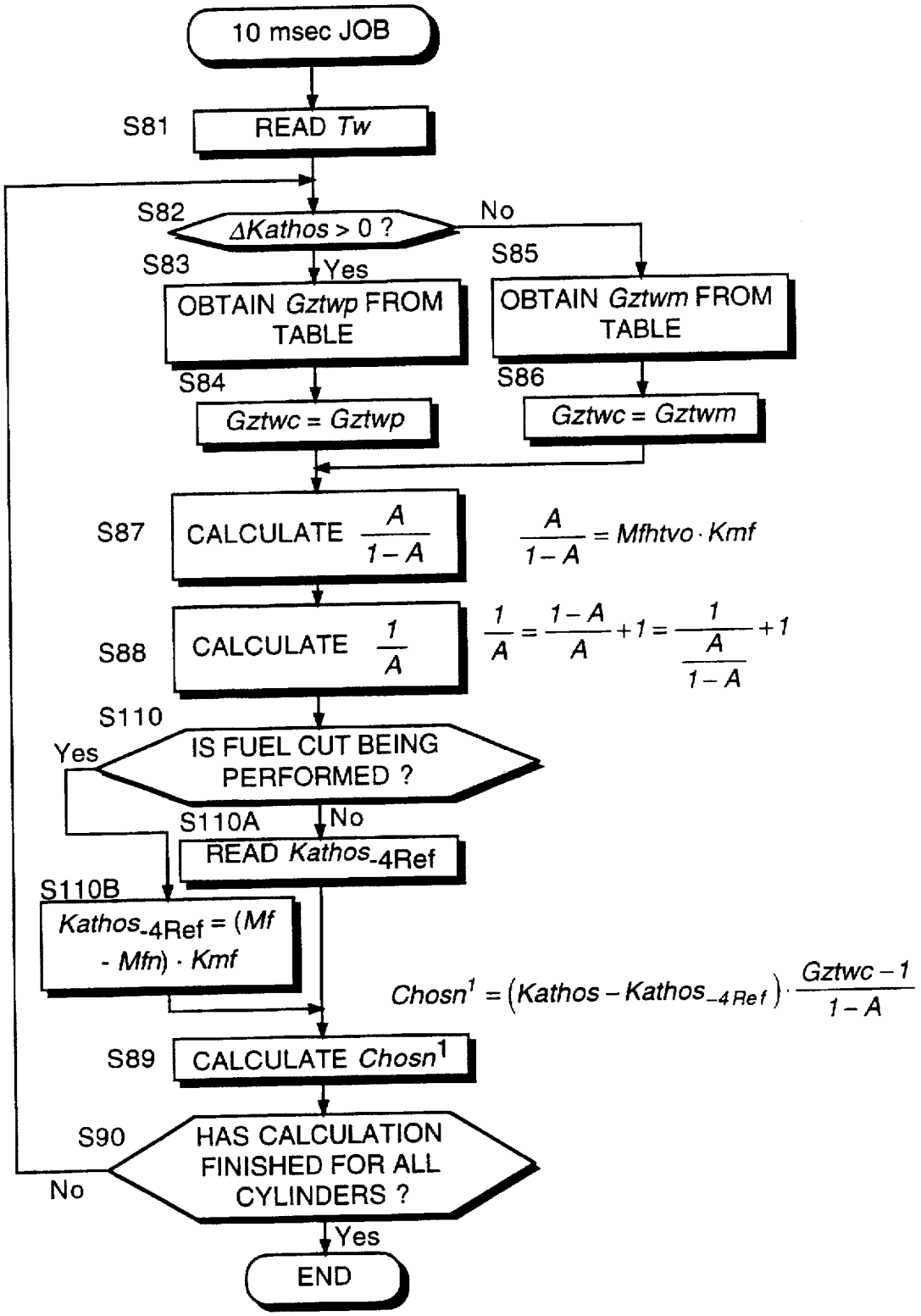
FIG. 39 is similar to FIG. 25, but showing a seventh embodiment of this invention.

Specifically, the steps S77–S79, S100–S107 are added to the flowchart shown in FIG. 24 of the above-mentioned fourth embodiment as shown in FIG. 38. Also, the steps S110, S110A and S110B are added to the flowchart shown in FIG. 25 of the above-mentioned fourth embodiment as shown in FIG. 39.

Figure 40:
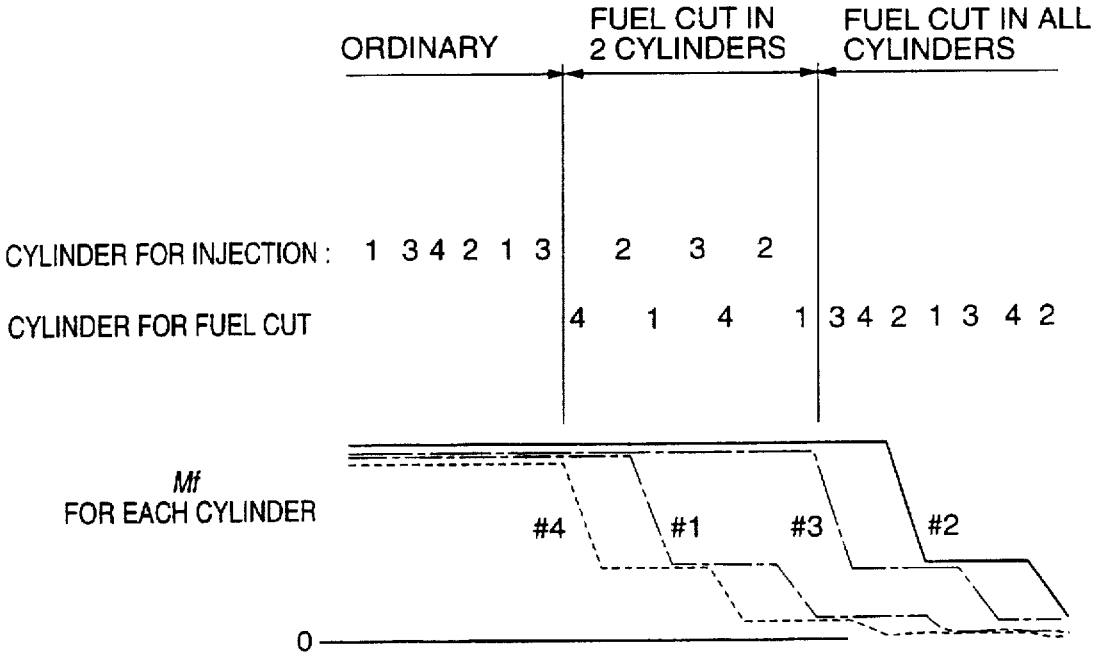
FIG. 40 is a timing chart showing a variation of the deposition amount Mf during fuel cut according to the seventh embodiment.

Herein, cylinder-specific fuel cut will be described taking a case shown in FIG. 40 as an example.

In this figure, when predetermined fuel cut conditions hold, fuel cut is first performed in cylinder #1 and cylinder #4, and fuel cut is then performed in all cylinders after a predetermined time has elapsed.

Conversely, when fuel recovery conditions hold, fuel recovery is first performed in cylinder #2 and cylinder #3, and fuel recovery is then performed in all cylinders after a predetermined time has elapsed.

Hence, during fuel cut, there may be some cylinders in which fuel cut is performed and some in which it is not.

According to the seventh embodiment, a cylinder determination is performed in step S78 of FIG. 38, and it is determined in a step S79 whether or not fuel cut is being performed in the determined cylinder.

When fuel cut is not being performed in the determined cylinder, after the steps S71–S75 are executed as in the case of the aforesaid fourth embodiment, the value of Mf is shifted to $Mfn_{-4Ref}$ in a step S77.

Mfn is a cylinder-specific fuel deposition amount during fuel cut, and the deposition amount Mf immediately prior to fuel cut is stored as $Mfn_{-4Ref}$ in the step S77.

When fuel cut is not being performed, therefore, Mf is sequentially stored as $Mfn_{-4Ref}$ in all cylinders.

Conversely when fuel cut is being performed, the routine proceeds from the step S79 to the step S100.

Even during fuel cut, the step S100 and steps S101, S102 are executed which are equivalent to the steps S72, S73, S75 which are executed when fuel cut is not performed.

Subsequently, in a step S103, a cylinder-specific fuel deposition amount Mfn during fuel cut is calculated by the next equation (57).

$$Mfn = Mfn_{-1Ref} FCKMF\# \tag{57}$$

where, $Mfn_{-1Ref}$=Mfn in the immediately preceding injection (immediately preceding cycle), and FCKMF#=decrease proportion.

Figure 41:
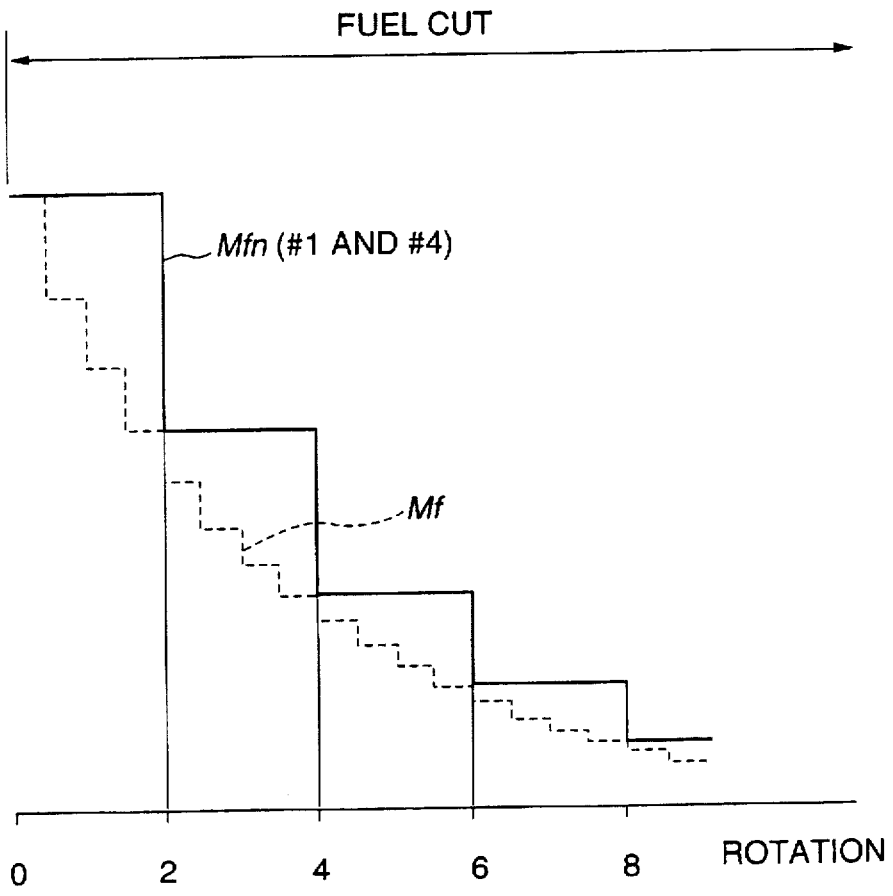
FIG. 41 is a timing chart showing a variation of the cylinder-specific deposition amount Mfn during fuel cut according to the seventh embodiment.

The cylinder-specific deposition amount Mfn during fuel cut is a deposition amount for each cylinder which decreases during fuel cut. It decreases with every injection, i.e. every 4Ref signals or two engine revolutions, as shown in FIG. 41. However, Mfn never takes a negative value, so when the calculated value of Mfn is negative in a step S104, Mfn is limited to 0 in a step S105.

In a step S106, the value of Mfn is transferred to the memory $Mfn_{-4Ref}$ to perform the next process, and the current process is terminated.

In the flowchart of FIG. 39, after performing steps S81–S88 as in the case of the aforementioned fourth embodiment, it is determined whether or not fuel cut is being performed in a step S110.

When fuel cut is being performed, the routine proceeds to a step S110B, the value of (Mf–Mfn)·Kmf is calculated using Mfn obtained in the step S103 of the process of FIG. 38, Mf obtained in the step S100 and Kmf obtained in the step S63 of FIG. 10, and the value is stored as $Kathos_{-4Ref}$. $Chosn^1$ is then calculated in a step S89.

In other words, during fuel cut, $Chosn^1$ is calculated by the next equation (58).

$$Chosn^1 = \{Kathos - (Mf - Mfn) \cdot Kmf\} \frac{Gztwc - 1}{A} \tag{58}$$

This $Chosn^1$ become a value for fuel recovery.

Also, since Kathos=Vmf, the next equation (59) may be used instead of equation (58) as shown in the step S65 of FIG. 10.

$$Chosn^1 = \{Vmf - (Mf - Mfn) \cdot Kmf\} \cdot \frac{Gztwc - 1}{A} \tag{59}$$

The reason why $Chosn^1$ is given by equation (58) during fuel recovery will now be explained.

When the aforesaid equation (11) is applied to a cylinder when fuel recovery occurs after fuel cut, a value required for fuel recovery in the cylinder where fuel cut was performed is input to Kathos on the right-hand side of equation (11). The value during fuel cut for the same cylinder is input to $Kathos_{-1Ref}$ on the right-hand side of equation (11).

During fuel cut, injection does not occur even if Kathos is calculated, so Kathos=0 and $Kathos_{-4Ref}$=0. $Chosn^1$ during fuel recovery may therefore be computed only from Kathos required for fuel recovery. Firstly, writing Kathos required for fuel recovery as Kathos(FCR), Kathos(FCR) is given by the following equation (60).

$$\begin{aligned} Kathos(FCR) &= (Mfn - Mfn) \cdot Kmf \\ &= \{(Mfn - Mf) + (Mf - Mfn)\} \cdot Kmf \\ &= (Mfn - Mf) \cdot Kmf + (Mf - Mfn) \cdot Kmf \\ &= Kathos + (Mf - Mfn) \cdot Kmf \end{aligned} \tag{60}$$

Also, equation (11) is transformed into the next equation (61).

$$\begin{aligned} Chosn^1 &= (Kathos - Kathos_{-4Ref}) \cdot \frac{Gztwc - 1}{A} \\ &= (Kathos(FCR) - 0) \cdot \frac{Gztwc - 1}{A} \\ &= Kathos(FCR) \cdot \frac{Gztwc - 1}{A} \\ &= \{Kathos + (Mf - Mfn) \cdot Kmf\} \cdot \frac{Gztwc - 1}{A} \end{aligned} \tag{61}$$

Comparing equation (61) with equation (11) for computing the value of $Chosn^1$ under normal conditions, it is seen that –(Mf–Mfn)·Kmf may be used as $Kathos_{-4Ref}$ during fuel recovery in a cylinder where fuel cut is performed. Herein, Mf<Mfn.

Figure 42:
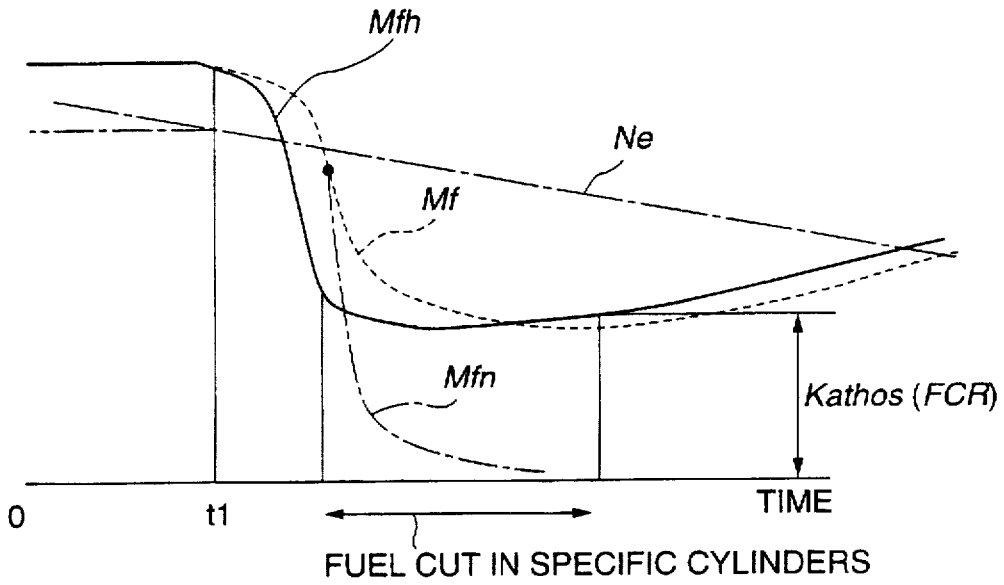
FIG. 42 is a timing chart showing variations of the deposition amount Mf, the cylinder-specific deposition amount Mfn and the steady state deposition amount Mfh according to the seventh embodiment.

Referring to FIG. 42, calculating the cylinder-specific deposition amount Mfn when fuel cut is performed in cylinder #1 and cylinder #4 using equation (57), Mfn in cylinder #1 and cylinder #4 decreases from Mf immediately prior to fuel cut shown by the black bullet in the figure.

Further, $Chosn^1$ during fuel recovery in cylinder #1 and cylinder #4 is given correctly by the aforesaid equation (60)

incorporating the variation of the deposition amount Mfn which decreases during fuel cut.

Accordingly, even when there is fuel recovery involving a change of the target air-fuel ratio coefficient Tfbya after fuel cut, there is no shift of the air-fuel ratio to lean due to insufficiency of $Chosn^1$ in a cylinder where fuel recovery occurs.

Figure 43:
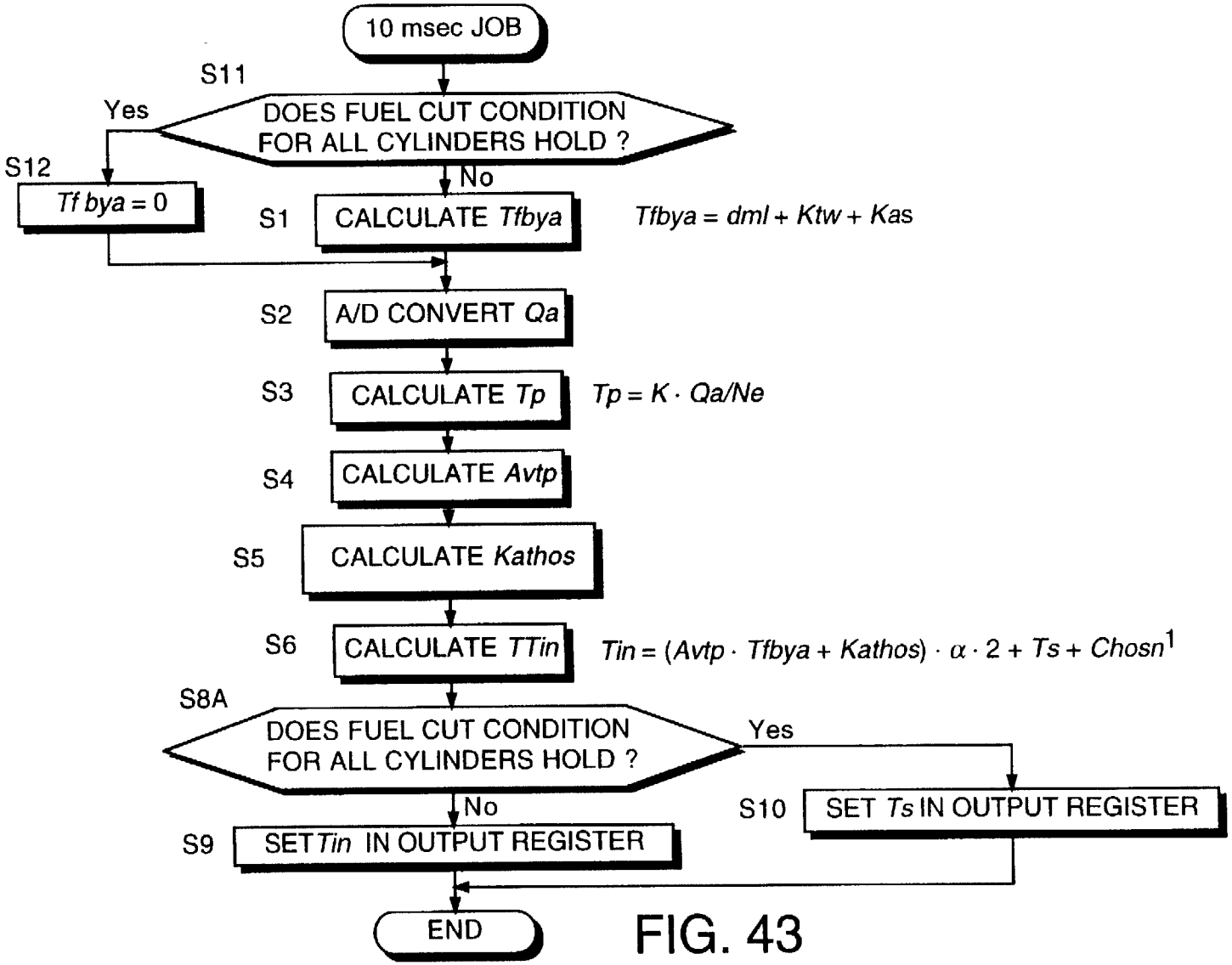
FIG. 43 is similar to FIG. 2, but showing an eighth embodiment of this invention.
Figure 44:
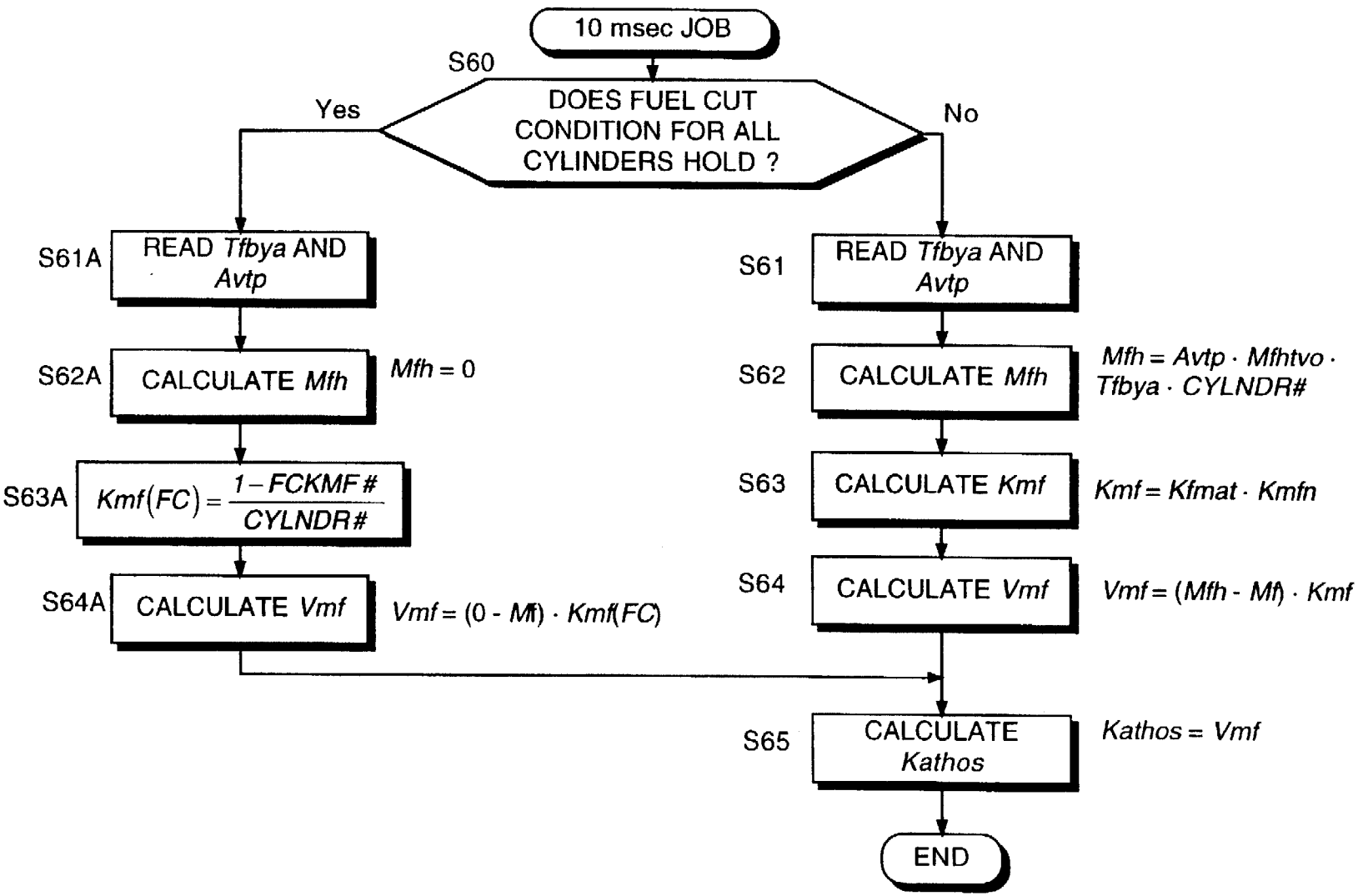
FIG. 44 is similar to FIG. 10, but showing the eighth embodiment of this invention.

FIGS. 43 and 44 show an eighth embodiment of this invention.

Whereas according to the seventh embodiment, fuel cut is performed separately in each cylinder, according to the eighth embodiment, fuel cut is performed in all cylinders together.

In this case, the fuel injection device may for example be of the following type. When sequential injection is performed in an MPI system and fuel cut conditions hold, fuel supply to all cylinders is immediately cut in the ignition sequence starting with the cylinder in which an injection is due.

When fuel cut conditions are released, fuel supply to all cylinders is immediately recommenced in the ignition sequence starting with the cylinder in which an injection is due.

The control algorithm of the eighth embodiment is shown in the flowcharts of FIGS. 43 and 44.

FIG. 43 corresponds to FIG. 2 of the first embodiment and FIG. 44 corresponds to FIG. 10 of the first embodiment.

Hereinbelow, the differences between the eighth embodiment and seventh embodiment will be described.

In FIG. 43, it is first determined in a step S11 whether or not the conditions hold for all-cylinder fuel cut.

When the conditions hold for all-cylinder fuel cut, 0 is entered in the target air-fuel ratio coefficient Tfbya in a step S12, and the steps S2 and beyond are executed.

In a step S8A which replaces the step S8, it is determined whether or not the conditions hold for all-cylinder fuel cut as in the step S11.

If the conditions for all-cylinder fuel cut holds, the ineffectual pulse width Ts is stored in the output register in a step S10, otherwise Tin is stored in the output register in a step S9.

In FIG. 44, it is first determined in a step S60 whether or not the conditions hold for all-cylinder fuel cut.

When the conditions for all-cylinder fuel cut do not hold, i.e. when fuel injection is performed in all cylinders, the steps S61–S65 are executed as in the aforesaid first embodiment.

When the conditions for all-cylinder fuel cut do hold, after executing the steps S61A–S64, the routine proceeds to a step S65.

In steps S61A and S62A, Mfh is calculated as in the steps S61 and S62. However Tfbya during all-cylinder fuel cut is set to 0 in the step S12 of FIG. 43, so Mfh calculated in the step S62 becomes 0.

In S63A, Kmf(FC) which is Kmf during all-cylinder fuel cut, is calculated in the following equation (62).

$$Kmf(FC) = \frac{1 - FCKMF\#}{CYLNDR\#} \tag{62}$$

where, CYLNDR#=number of cylinders.

The reason why Kmf during all-cylinder fuel cut is equal to equation (62) is as follows.

When fuel cut is performed separately in each cylinder, FCKMF# is a decrease proportion of the deposition amount Mfn in a cylinder where fuel cut is performed.

In other words, when fuel cut is performed for example in cylinders #1 and #4, the fuel deposition amount Mfn in cylinders #1 and #4 decreases in steps of FCKMF# on each injection, i.e. every 4Ref signals.

On the other hand, when fuel cut is performed in all cylinders together, the computation of the deposition amount Mf is performed every time there is an injection in each cylinder, i.e. every 4Ref signals.

Therefore, computation of the deposition amount Mfn for the whole engine is performed for each Ref signal as shown by the broken line of FIG. 41.

In this case, a deposition amount $Mf^i$, i.e. Mf for the ith cycle, is expressed by the following equation (63) by applying the equation (19).

$$\begin{aligned} Mf &= Mf^{i-1} + Vmf \\ &= Mf^{i-1} + Kathos^i \\ &= Mf^{i-1} + (Mfh^i - Mf^{i-1}) \cdot Kmf \end{aligned} \tag{63}$$

During all-cylinder fuel cut, the steady state deposition amount Mfh finally becomes 0.

Therefore, assuming that Mfh is 0 during all-cylinder fuel cut, $Mf^i$ during all-cylinder fuel cut is expressed by the following equation (64).

$$Mf = Mf^{i-1} + (0 - Mf^{i-1}) \cdot Kmf(FC) \tag{64}$$

Further, Kmf(FC) on the right-hand side of equation (64) gives the decrease proportion of Mf during all-cylinder fuel cut.

On the other hand, rewriting equation (57), the following equation (65) is obtained.

$$\begin{aligned} Mfn &= Mfn_{-4Ref} \cdot FCKMF\# \\ &= Mfn_{-4Ref} + (0 - Mfn_{-4Ref}) \cdot (1 - FCKMF\#) \end{aligned} \tag{65}$$

Therefore, (1–FCKMF#) on the right-hand side of equation (65) gives the decrease proportion of Mfn during all-cylinder fuel cut.

For the same engine, it may be considered that the decrease rate of deposition amount during fuel cut is the same for both Mfn and Mf as shown in FIG. 41.

Considering that Kmf(FC) shows a change for each 1Ref signal, and (1–FCKMF#) shows a change for every 4Ref signals, the following approximate expression holds.

$$Kmf(FC) \cong \frac{1 - FCKMF\#}{CYLNDR\#}$$

This is the basis for equation (62). When cylinder-specific fuel cut is performed and FCKMF# is first obtained experimentally, even when the setting is such that fuel cut is simultaneously performed in all cylinders for the same engine, the quantity proportion during all-cylinder fuel cut may be found approximately using equation (62). There is therefore no need to repeat experiments to set the quantity proportion during all-cylinder fuel cut.

In the step S64A of FIG. 44, Vmf during all-cylinder fuel cut is calculated by the following equation (66).

$$Vmf = (Mfh - Mf) \cdot Kmf(FC) \tag{66}$$

After calculating Kathos in the step S65, the routine of FIG. 44 is terminated.

According to this eighth embodiment, the negative approximate amount Mf and transient correction amounts Kathos, Chosn are not updated by the process of FIG. 38 used in the seventh embodiment, but by the process of the fourth embodiment shown in FIG. 24. In other words, updating is performed regardless of whether fuel cut is performed or not.

According to the eighth embodiment, Tfbya and Mfh during all-cylinder fuel cut are set to 0 and the quantity proportion during all-cylinder fuel cut is calculated by the above equation (62) for the case where fuel cut is simultaneously performed in all cylinders. The values of $Chosn^1$ and Vmf are therefore optimized during all-cylinder fuel recovery when the target air-fuel ratio coefficient Tfbya is changed after all-cylinder fuel cut.

For example, calculating Vmf during all-cylinder fuel cut using equation (62), the following equation (67) is obtained.

$$\begin{aligned} Vmf &= (Mfh - Mf) \cdot Kmf(FC) \\ &= (0 - Mf) \cdot \frac{1 - FCKMF\#}{CYLNDR\#} \\ &= -Mf \cdot \frac{1 - FCKMF\#}{CYLNDR\#} \end{aligned} \quad (67)$$

Herein, $Mf \geqq 0$, and $(1-FCKMF\#) \geqq 0$. Therefore, $Vmf \leqq 0$. In the step S72 of the process of FIG. 24 which is also performed during all-cylinder fuel cut, Mf decreases for every injection in each cylinder, and finally reaches 0.

This Mf matches the real behavior of the wall flow during all-cylinder fuel cut very well. Therefore, the deposition rate Vmf during fuel recovery can be precisely computed, and tendency of the air-fuel ratio to lean due to insufficiency of Vmf during all-cylinder fuel recovery may be prevented.

When the deposition rate Vmf during all-cylinder fuel recovery is accurately computed, $Chosn^1$ during all-cylinder fuel recovery which is computed using this Vmf(=Kathos) is also optimum. Hence, tendency of the air-fuel ratio to lean due to insufficiency of $Chosn^1$ during all-cylinder fuel recovery is also prevented.

All the aforesaid embodiments were described in the case of a four cylinder engine in which sequential injection is performed by an MPI system. The invention may however also be applied to other types of engine, for -example a six cylinder engine in which case the following equation (68) may be used instead of equation (57).

$$Mfn = Mfn_{-6Ref} FCKMF\#$$

where,

Mfn=cylinder-specific deposition amount during fuel cut, $Mfn_{-6Ref}$=Mfn for immediately preceding cycle (6Ref signals beforehand) in each cylinder, and FCKMF=decrease proportion This invention may be applied to cases other than when there is a change from the power-oriented air-fuel ratio to the stoichiometric air-fuel ratio and when there is a change from a lean air-fuel ratio to the stoichiometric air-fuel ratio. For example, when the water temperature increase correction coefficient Ktw is not 0 and has a positive value due to a cold start, and the vehicle is driven with an air-fuel ratio on the rich side, air-fuel ratio feedback control begins immediately when the O2 sensor is activated so as to perform air-fuel ratio as soon as possible.

In such an engine, when activation of the O2 sensor is complete, the water temperature increase correction coefficient Ktw returns to 0. In other words, the water temperature increase correction coefficient Ktw changes to 0 from a positive value which is not 0, and as a result, the target air-fuel ratio coefficient Tfbya changes to a small value as is seen from equation (1). In this case also, overrichness due to decrease of the target air-fuel ratio coefficient Tfbya may be prevented by applying, for example, any of the first–sixth embodiments.

There are also some cases where it is necessary to make the value of the post-startup increase correction coefficient Kas different according to whether the idle switch is ON or OFF. When the idle switch is switched from ON to OFF or from OFF to ON, the target air-fuel ratio coefficient Tfbya changes. This invention is also effective in preventing temporary overleanness or overrichness due to this change of the target air-fuel ratio coefficient Tfbya.

According to the above embodiments, the steady state deposition amount is calculated using the deposition factor Mfhtvo. This invention may however be applied to the case where the steady state deposition amount relative to the stoichiometric air-fuel ratio is directly computed from the engine load, rotation speed and temperature.

Further, according to the aforesaid embodiments, the predicted temperature value Tf was used to find the steady state deposition amount Mfh and quantity proportion Kmf, however the steady state deposition amount Mfh and quantity proportion Kmf may be calculated using the cooling water temperature, or the wall flow correction temperature Twf as disclosed in the aforesaid Tokkai-Hei 3-134237.

In the above embodiments, in the course of obtaining the fuel injection pulse width Ti or Tin, correction of Avtp by Tfbya constitutes a first correcting means, correction of Avtp by Kathos constitutes a second correcting means, and correction of Avtp by Chosn constitutes a third correcting means.

The seventh and eighth embodiments are based on Tokugan-Hei 9-64391 filed on Mar. 18, 1997 to the Japanese Patent Office.

FIGS. 45–64D show a ninth embodiment of this invention.

Figure 45:
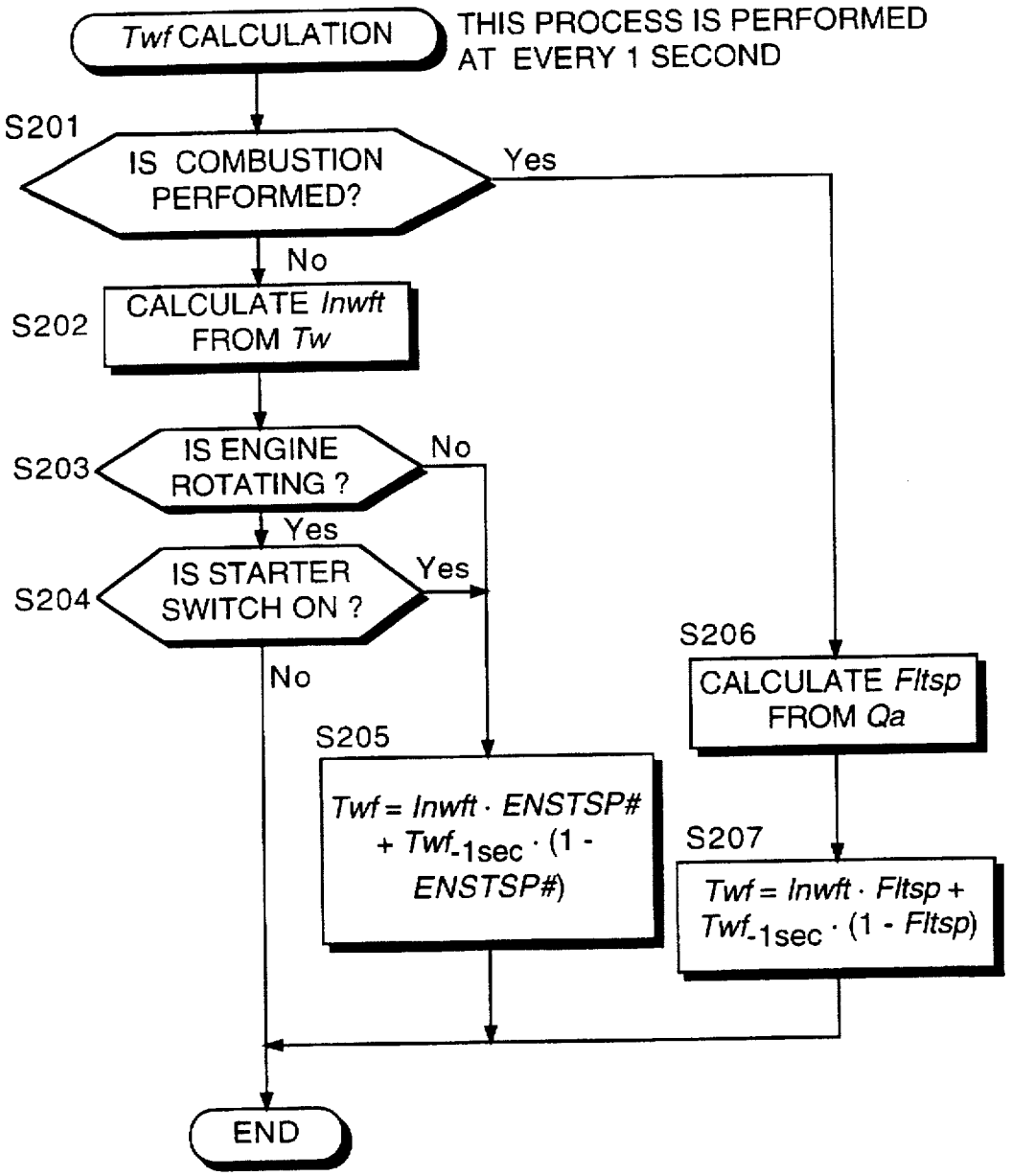
FIG. 45 is a flowchart describing a process for computing a wall flow correction temperature Twf according to a ninth embodiment of this invention.

According to this embodiment, a correction amount related to the unburnt fraction of the fuel is added to the target air-fuel ratio coefficient Tfbya obtained in the construction of the first embodiment. Part of the fuel supplied to the engine is discharged as unburnt HC, and leaks to a crank case via a gap between a cylinder and piston ring. This is different from wall flow in that it does not contribute to combustion. According to this embodiment, an air-fuel ratio correction is made for this unburnt fraction. This embodiment particularly concerns engines in which fuel is injected towards an intake valve. The flowchart of FIG. 45 shows a process for computing a wall flow correction temperature Twf. This process is executed for example every one second.

In a step S201, it is determined whether or not the engine is burning fuel and when it is not, the routine proceeds to a step S202.

Figure 46:
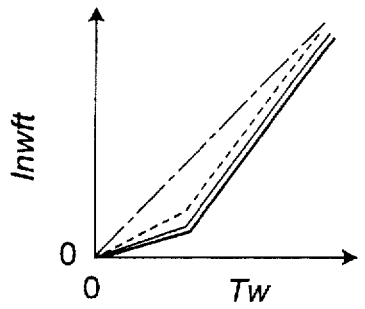
FIG. 46 is a graph showing the contents of a table of initial values Inwft of the wall glow correction temperature according to the ninth embodiment.

In the step S202, an initial value Inwft of the wall flow corrected temperature is found by referring to a table having characteristics as shown in FIG. 46 from the present cooling water temperature Tw. In this figure, the single dotted line is the line Inwft=Tw, and in an engine which injects fuel toward the intake valve, the initial value Inwft is set to a value lower than Tw as shown by the solid line in the figure. It is also dependent on the proportion of fuel injected towards the valve.

In steps S203, S204, it is determined whether or not the engine is rotating, and it is determined whether or not a START switch 15 is ON. When the engine is not rotating in the step S203, the routine proceeds to a step S205. Alternatively, when the engine is rotating and the START switch is ON in the step S203, the engine is in a condition immediately before startup. In this case, the routine also proceeds to the step S205.

In the step S205, the wall flow correction temperature Twf is calculated by the following equation (101) using the temperature initial value Inwft for wall flow correction.

$$Twf=Inwft\cdot ENSTSP\#+Twf_{-1sec}\cdot(1-ENSTSP\#) \quad (101)$$

where, $Twf_{-1sec}$=Twf one second previously, and

ENSTSP#=temperature variation proportion before startup or when engine is not rotating.

Figure 47:
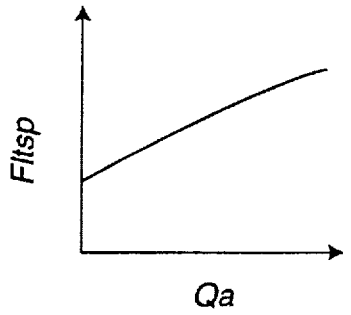
FIG. 47 is a graph showing the contents of a table of a temperature change proportion Fltsp during firing according to the ninth embodiment.

When it is determined in the step S101 that the engine is burning fuel, a temperature variation proportion Fltsp when the engine is burning fuel is found in a step S206 by referring to a table in FIG. 47 from an intake air volume Qa. In a step S207, a wall flow correction temperature Twf is calculated using the present cooling water temperature Tw by the following equation (102).

$$Twf=Tw\cdot Fltsp+Twf_{-1sec}\cdot(1-Fltsp) \quad (102)$$

The reason why the value of Fltsp increases the larger Qa in FIG. 47, is that the heat of combustion per unit time increases the larger Qa, and heat transfer to the fuel deposition part is more rapid.

Figure 48:
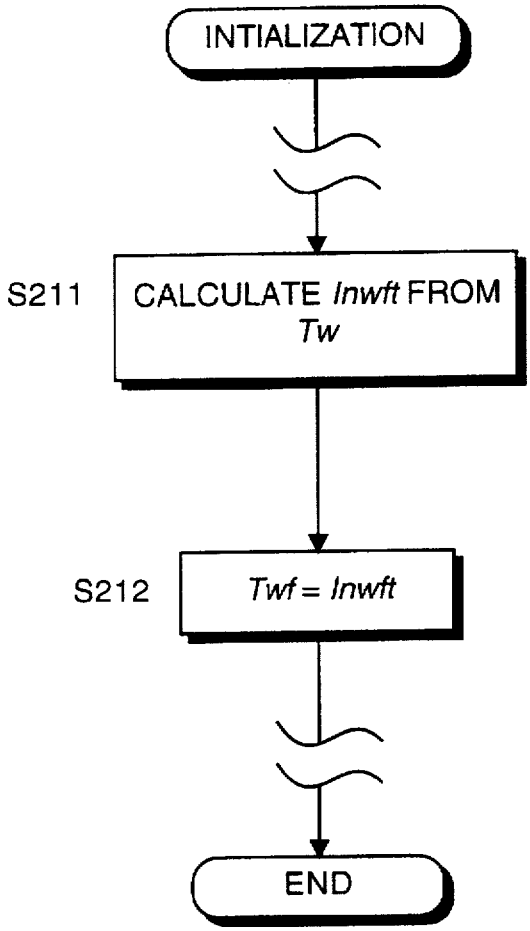
FIG. 48 is a flowchart describing an initializing process of a wall flow correction temperature according to the ninth embodiment.

The flowchart of FIG. 48 shows a process for initializing the wall flow correction temperature. In a step S211, the initial value Inwft of the wall flow correction temperature is calculated from the present cooling water temperature Tw, and in a step S212, Twf is set equal to Inwft. During warmup, the wall flow correction temperature Twf obtained in this way is set to coincide with the cooling water temperature Tw as shown in FIG. 49H.

Figures 49A, 49B, 49C, 49D, 49E, 49F, 49G, 49H, 49I:
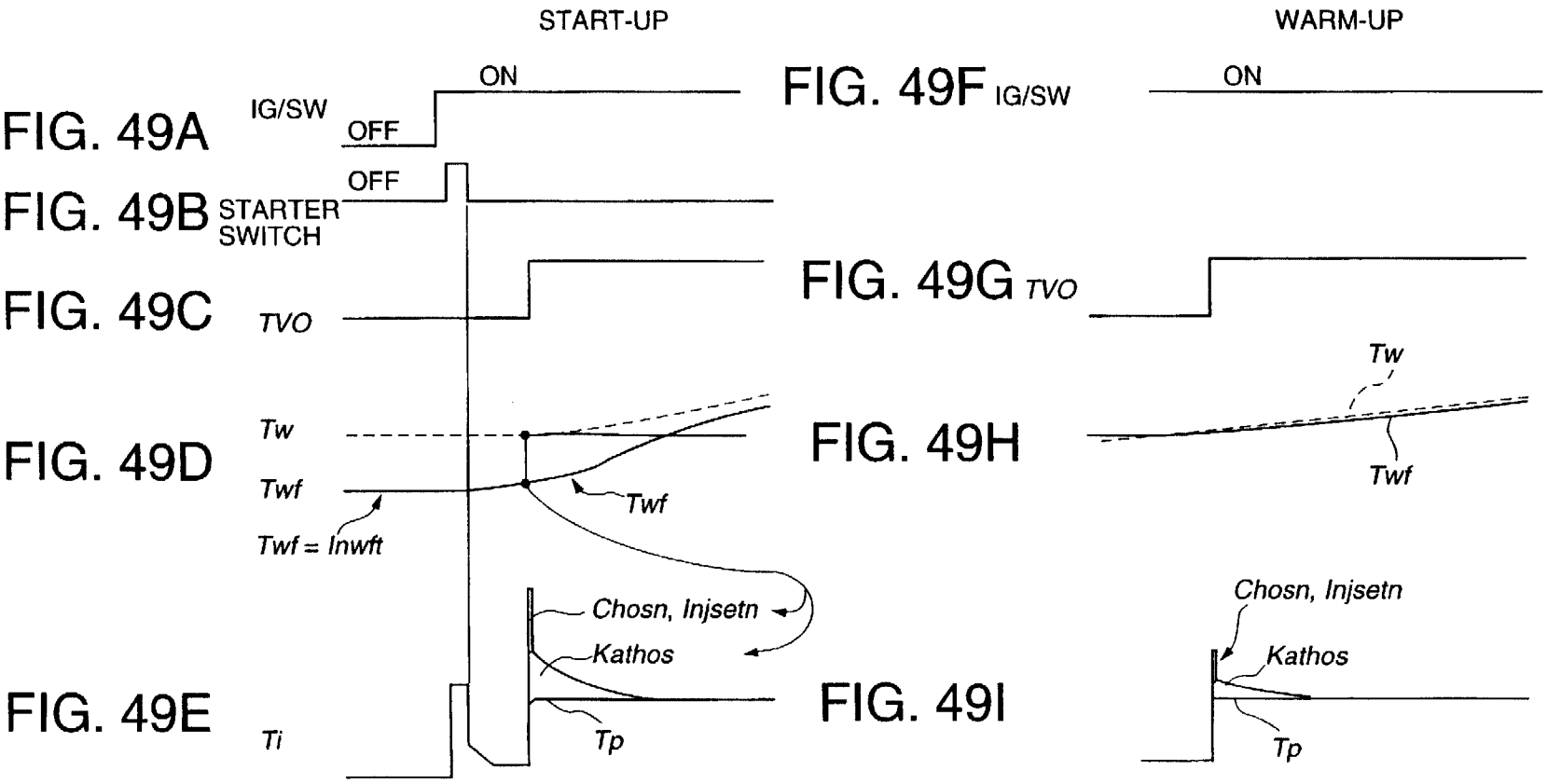
FIGS. 49A–49I are timing charts describing a change of the wall flow correction temperature Twf immediately after engine startup and during warmup according to the ninth embodiment.

On the other hand, Twf immediately after startup converges to the cooling water temperature Tw with a first order delay starting from the initial value Inwft of the wall flow correction temperature as shown in FIG. 49D.

FIGS. 49A–49E show variations of various values immediately after startup, while FIGS. 49F–49I show variations of various values during warmup when the vehicle accelerates after startup.

IG/SW in FIG. 49A denotes ignition switch, and ST/SW in FIG. 49B denotes starter switch.

Figure 50:
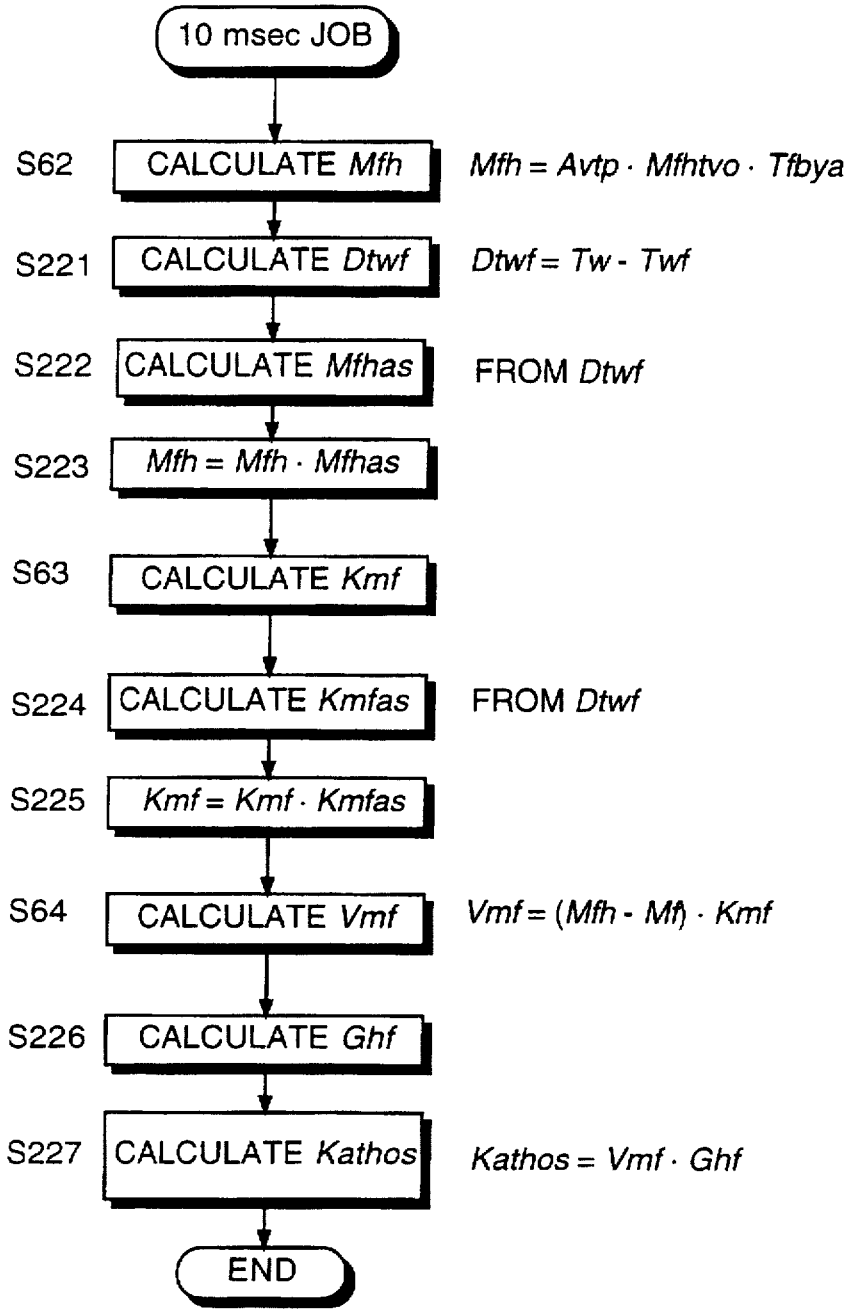
FIG. 50 is a flowchart describing a process for computing a transient correction amount Kathos according to the ninth embodiment.

The flowchart of FIG. 50 shows a process for computing the transient correction amount Kathos. This routine corresponds to the flowchart of FIG. 10 of the aforesaid first embodiment.

After calculating Mfh in a step S62 as in the aforesaid first embodiment, a temperature difference Dtwf between Tw and Twf is computed in a step S221.

Figure 53:
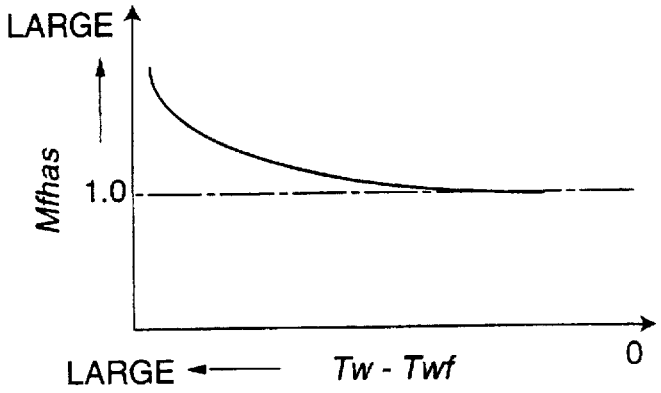
FIG. 53 is a graph showing the contents of a table of a non-steady state temperature correction factor Mfhas according to the ninth embodiment.

Next, in a step S222 an interpolation is performed by referring to the table of FIG. 53 from this temperature difference Dtwf, and a correction factor Mfhas for non-steady state temperature conditions is calculated for Mfh.

In a step S223, Mfh is corrected by multiplying the value of Mfh obtained in the step S62 by this correction factor Mfhas. The value after correction is then set equal to Mfh.

In a step S63, the quantity proportion Kmf is found in the same way as in the first embodiment. In a step S224, a correction factor Kmfas relative to Kmf for non-steady state temperatures is calculated by referring to a table in FIG. 54 from the temperature difference Dtwf, and Kmf is corrected by multiplying Km by this correction factor Kmfas. The value after correction is set equal to Kmf in a step S225.

Figure 54:
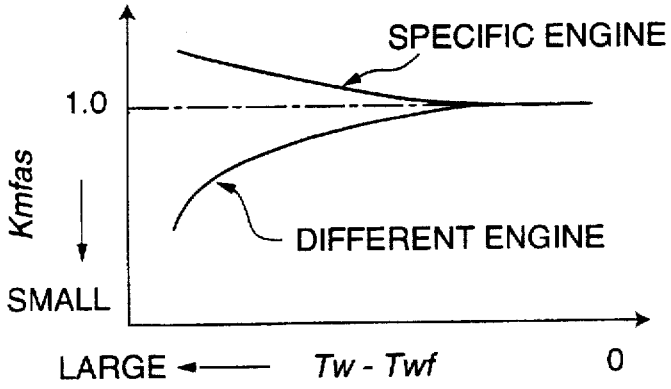
FIG. 54 is a graph showing the contents of a table of a non-steady state temperature correction factor Kmfas according to the ninth embodiment.

Herein, the correction factor Mfhas takes a larger value the larger the temperature difference Dtwf as shown in FIG. 53, and the correction factor Kmfas takes a value nearer to 1 the smaller the temperature difference Dtwf as shown in FIG. 54.

Figures 55A, 55B:
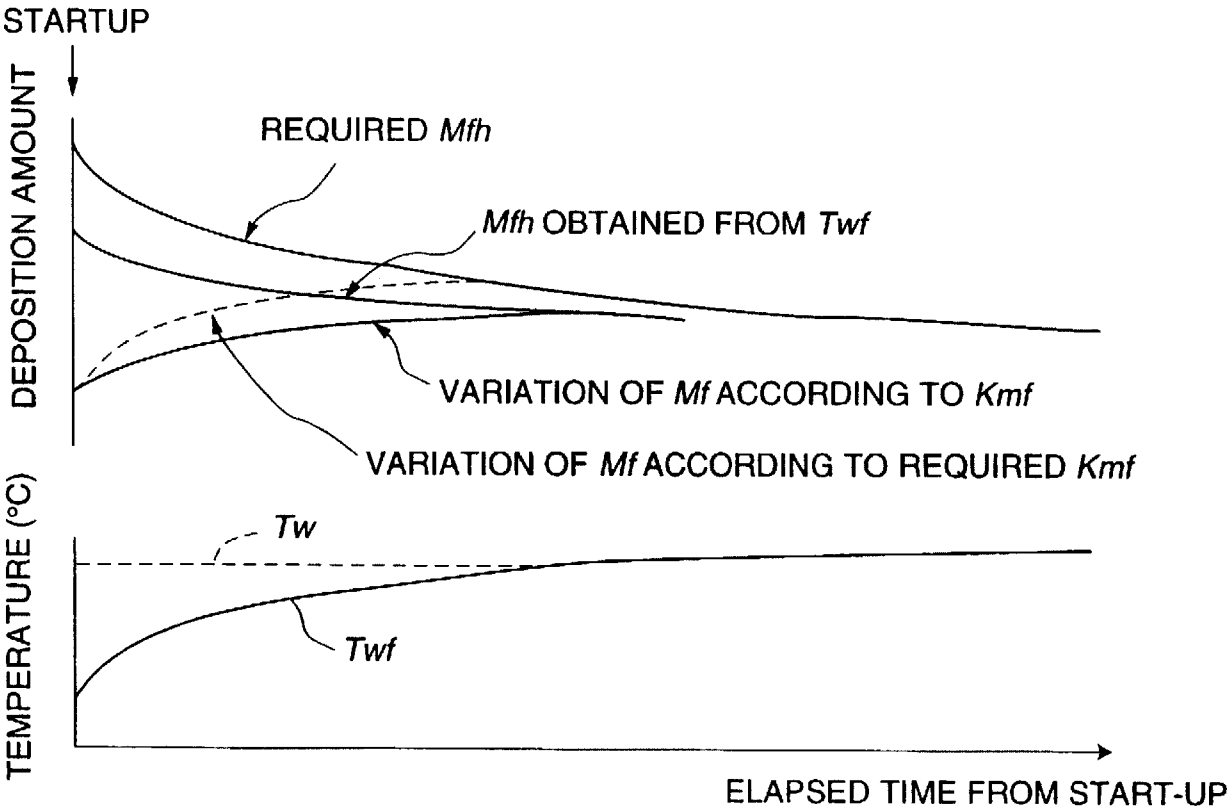
FIGS. 55A and 55B are timing charts showing deposition rate and water temperature variation when the correction factor according to the ninth embodiment is applied.

These characteristics of Mfhas, Kmfas, may be deduced by FIGS. 55A and 55B.. According to these figures, the discrepancy between Mfh using Twf and the required Mfh is largest immediately after startup, and it decreases the smaller the temperature difference between Tw and Twf. Likewise, the discrepancy between Kmf using Twf and the required Kmf is largest immediately after startup, and it decreases the smaller the temperature difference between Tw and Twf. This is due to the fact that the temperature difference between Tw and Twf is largest immediately after startup, and it gradually decreases with elapsed time after startup. It may therefore be inferred that, according to this embodiment, the non-steady state character of the intake valve temperature is more pronounced the larger the temperature difference between Tw and Twf.

The data for calculating Mfhtvo and Kmf, and more specifically, map data for a reference deposition factor load term $Mfhq_i$ and map data for a basic quantity proportion kmfat, are set relative to the cooling water temperature in the steady state. It is substantially impossible to obtain $Mfhq_i$ and kmfat for the transient state temperature.

Therefore, the value of the wall flow correction temperature Twf used for the calculation of Mfhtvo and Kmf should be a temperature in the steady state.

When data set for the cooling water temperature in the steady state is consulted using the wall flow correction temperature instead of the cooling water temperature, the following problem arises. That is, the engine temperature state is different for conditions under which data was obtained to calculate Mfhtvo or Kmf, and conditions when Mfhtvo or Kmf are actually computed, and this difference is not taken into account in the calculation.

To cope with this, in the process for computing Kathos according to this embodiment, the steps S221–S223 and steps S224, S225 are provided. The data for calculating Mfh, Kmf are set based on the cooling water temperature in the temperature steady state, therefore this data is first consulted using the wall flow correction temperature Twf instead of the cooling water temperature to compute Mfh, Kmf. Next, a correction factor for the non-steady temperature state is computed according to the temperature difference Dtwf between Tw and Twf, and the computed values of Mfh, Kmf are corrected by this non-steady state correction factor. Further, in steps S226, S227, the transient correction amount Kathos is calculated by adding a correction by a correction factor Ghf for preventing overleanness during deceleration when light fuel is used. The correction of these steps S226, S227 is known from Tokkai-Hei 1-305142 of the aforesaid prior art.

Figure 51:
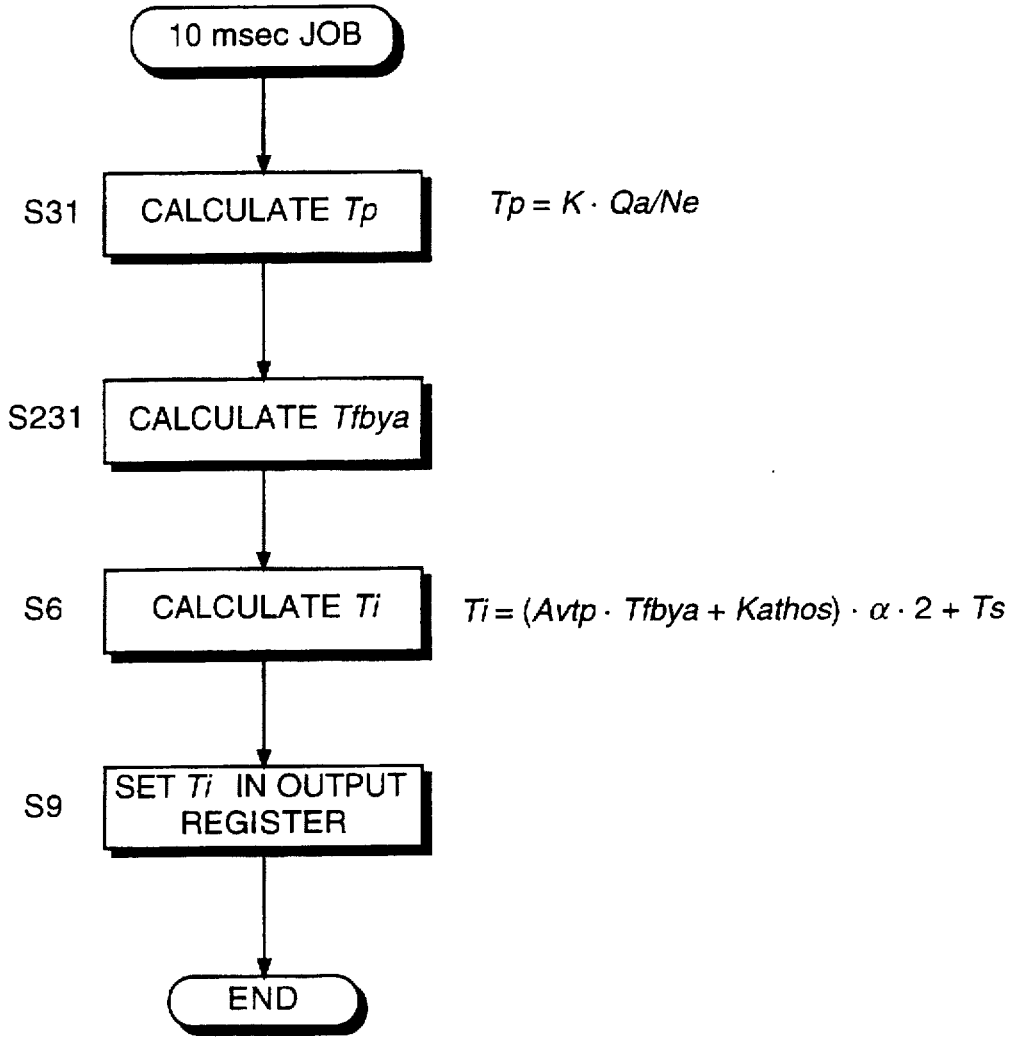
FIG. 51 is a flowchart describing a process for computing a fuel injection pulse width Ti according to the ninth embodiment.

The flowchart of FIG. 51 shows a process for computing a final fuel injection pulse width Ti using the transient correction amount Kathos found in this way. This process corresponds to the process of FIG. 2 of the first embodiment, but the details of the process are omitted. The difference from the first embodiment is the process for computing the target air-fuel ratio coefficient Tfbya performed in a step S231.

This process will be described using the flowchart of FIG. 52. In steps S241, S242, S243, an air-fuel ratio correction coefficient Dml, water temperature increase correction coefficient Ktw and post-startup increase correction coefficient Kas are respectively calculated by the same method as in the prior art.

In a step S244, an unburnt fraction correction coefficient Kub is calculated.

Figure 57:
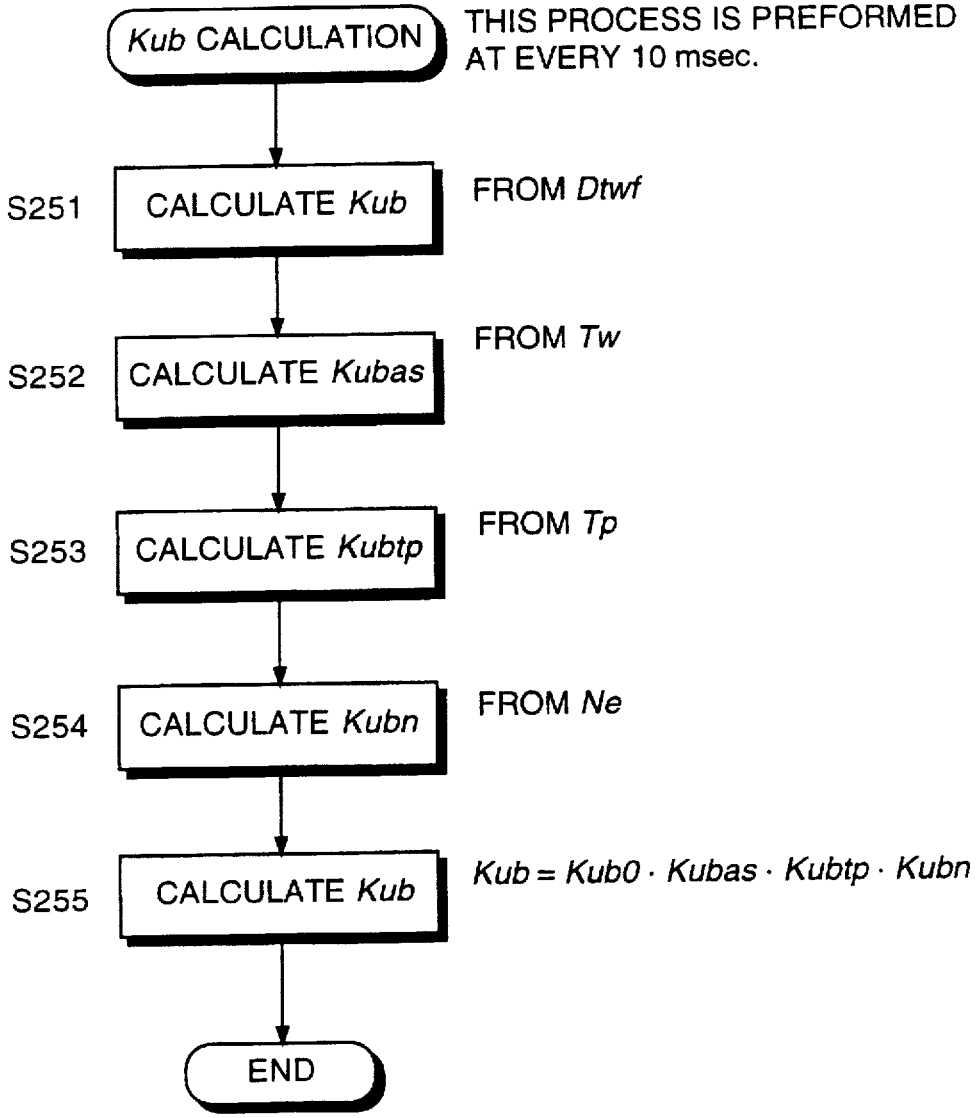
FIG. 57 is a flowchart describing a process for computing an unburnt fraction correction coefficient Kub according to the ninth embodiment.

The computation of Kub will be described with reference to the flowchart of FIG. 57. This process is executed at an interval of 10 milliseconds.

Figure 58:
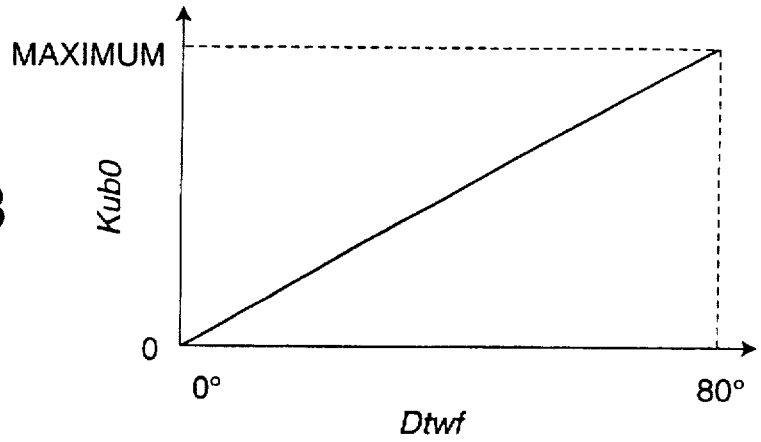
FIG. 58 is a graph showing the contents of a table of basic values Kub0 of an unburnt correction coefficient according to the ninth embodiment.

First, in a step S251, a table shown in FIG. 58 is looked up from the temperature difference Dtwf=(Tw−Twf), and a basic value Kub0 of the unburnt fraction correction coefficient is found by performing an interpolation.

Figure 59:
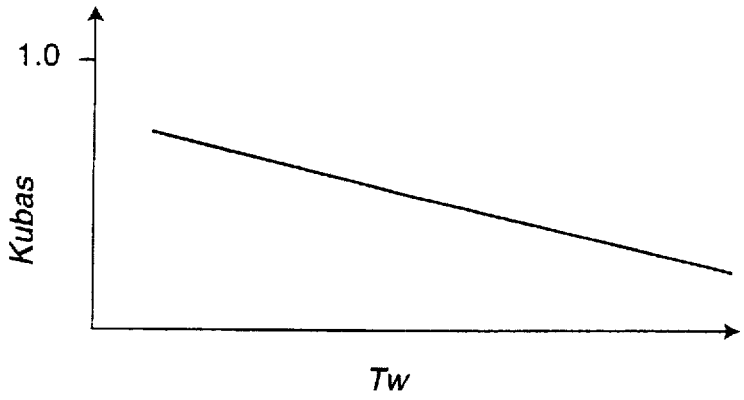
FIG. 59 is a graph showing the contents of a table of a water temperature correction term Kubas according to the ninth embodiment.
Figure 60:
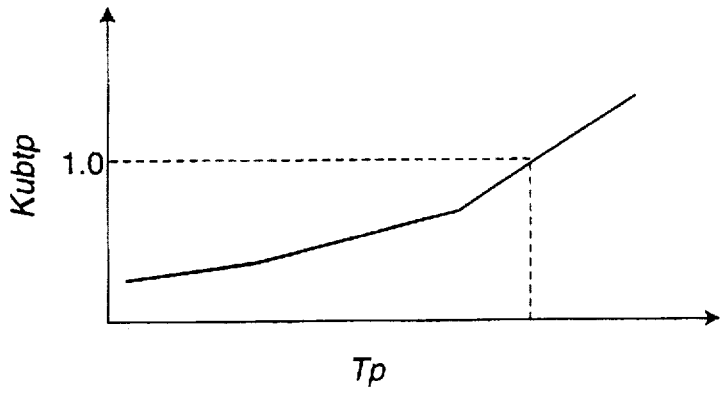
FIG. 60 is a graph showing the contents of a table of a load correction term Kubtp according to the ninth embodiment.
Figure 61:
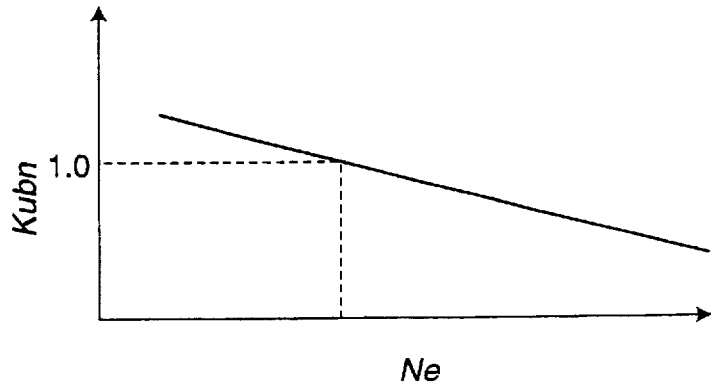
FIG. 61 is a graph showing the contents of a table of a rotation correction term Kubn according to the ninth embodiment.
Figures 62A, 62B, 62C, 62D, 62E, 62F:
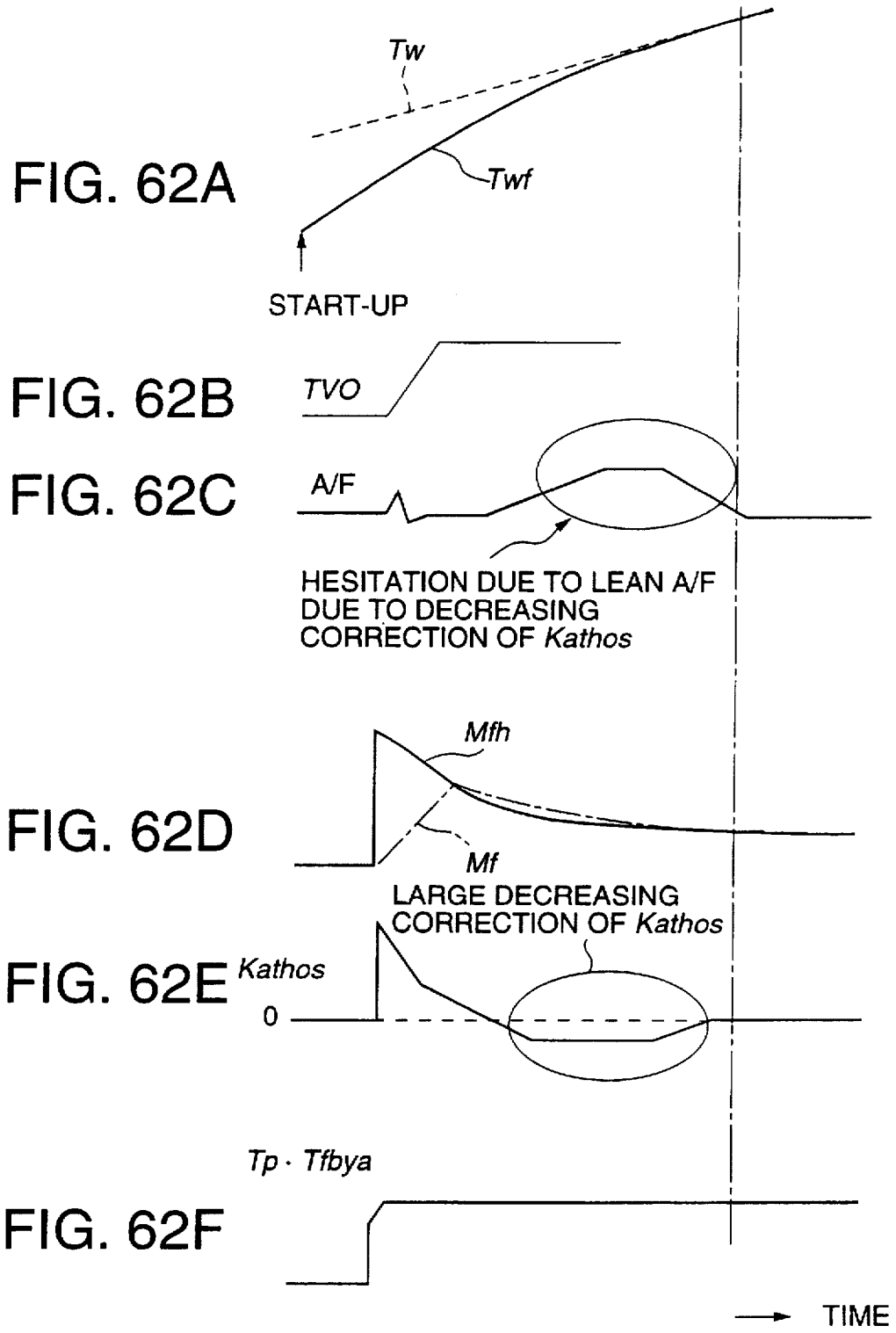
FIGS. 62A–62F are timing charts for describing the result of correction by only a correction factor.

The difference between the intake valve temperature (=fuel deposition part temperature Twf) and the cooling water temperature Tw is largest immediately after startup, and it decreases with elapsed time after startup. Immediately after startup the temperature difference is approximately 80° C., therefore as shown in FIG. 58, Kub0 is set relative to the temperature difference Dtwf such that it is a maximum immediately after startup, decreases as the temperature difference Dtwf decreases, and becomes 0 for a steady state temperature, i.e. when Dtwf=0. In steps S252, S253, S254, tables of which the characteristics are shown in FIGS. 59, 60, 61 are looked up respectively from the cooling water temperature Tw, basic injection pulse width Tp and rotation speed Ne, and interpolations are performed so as to find a water temperature correction factor Kubas, load correction factor Kubtp and rotation correction factor Kubn.

In a step S255, the unburnt fraction correction factor Kub is calculated by the following equation (103).

$$Kub=Kub0\cdot Kubas\cdot Kubtp\cdot Kubn \quad (103)$$

The basic value Kub0 of the unburnt fraction correction coefficient is set according to a predetermined cooling water temperature, load and rotation speed, so for a cooling water temperature, load and rotation speed different from the set conditions, the value of Kub0 is unsuitable.

Therefore, since for example the unburnt fraction decreases when the cooling water temperature is higher than the set condition, the value of Kubas is arranged to be smaller the higher the cooling water temperature Tw as shown in FIG. 59. Likewise, Kubtp is given characteristics as shown in FIG. 60 due to the decrease of the unburnt fraction with decreasing load, and Kubni is given characteristics as shown in FIG. 61 due to the decrease of the unburnt fraction with increasing rotation speed.

Figure 52:
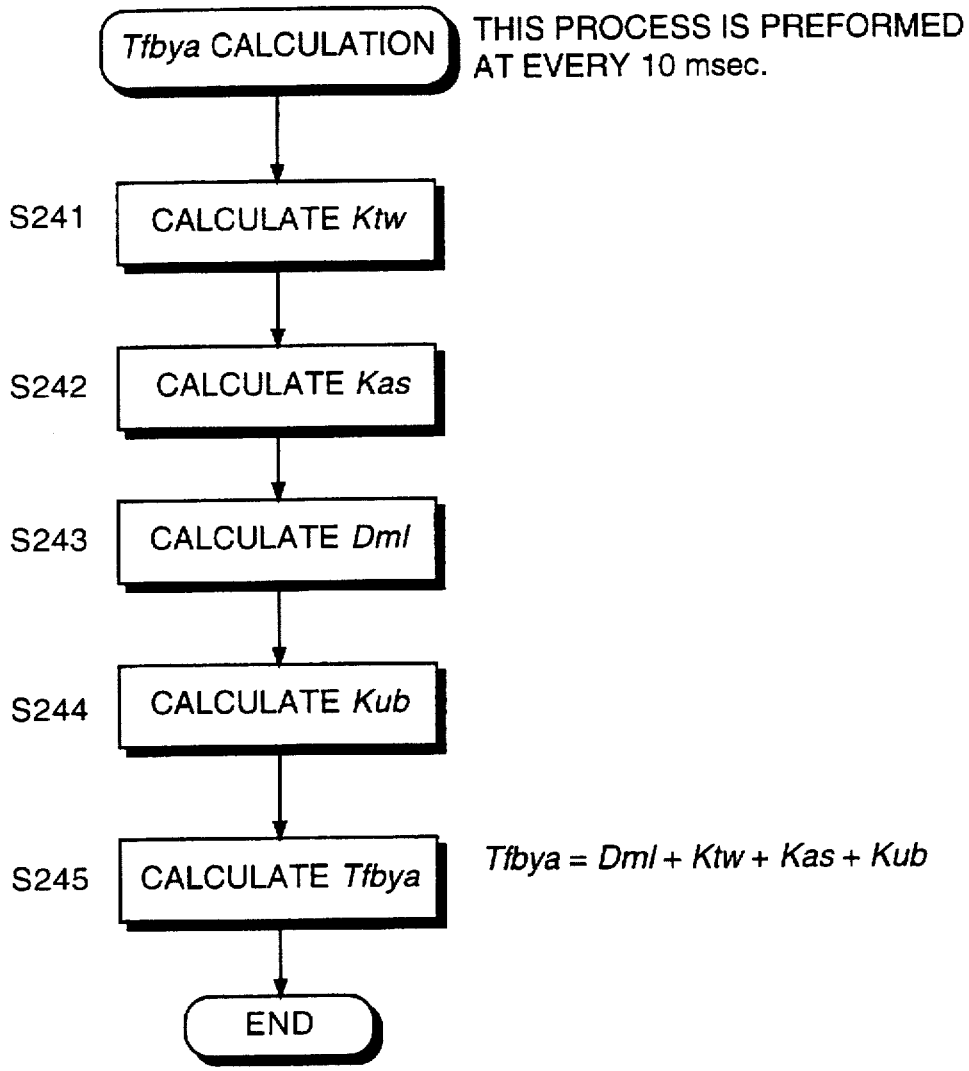
FIG. 52 is a flowchart describing a process for computing a target air-fuel ratio coefficient Tfbya according to the ninth embodiment.

When the computation of the unburnt fraction correction coefficient Kub is complete, the target air-fuel ratio coefficient Tfbya is calculated by the following equation (104) in a step S245 of FIG. 52.

$$Tfbya=Kml+Ktw+Kas+Kub \quad (104)$$

Tfbya and Tp determine the steady state injection amount, and in the non-steady temperature state during a cold start, the temperature difference Dtwf is a positive value which is not 0. Therefore, by adding the unburnt fraction correction Kub to the calculation expression for Tfbya, the steady state injection amount is increased.

After computing the target air-fuel ratio coefficient Tfbya in this way, the routine returns to the process of FIG. 51, the fuel injection pulse width Ti is calculated in the step S6, and this Ti is registered in an output register in the step S9. After performing fuel injection, the same process is performed as that of FIG. 12 of the first embodiment, and the deposition amount Mf is updated.

Herein, control with regard to the correction factors Mfhas, Kmfas of this ninth embodiment when the demand for Mfh in the non-steady state exceeds the demand in the steady state, will be described with reference to FIGS. 56A–56D.

Figure 56A:
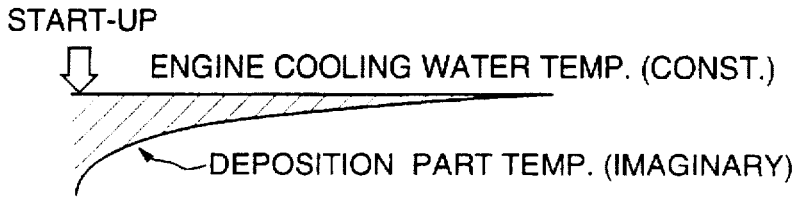
FIGS. 56A–56D are timing charts showing a variation of the air-fuel ratio, etc., when the correction factor according to the ninth embodiment is applied.
Figure 56B:
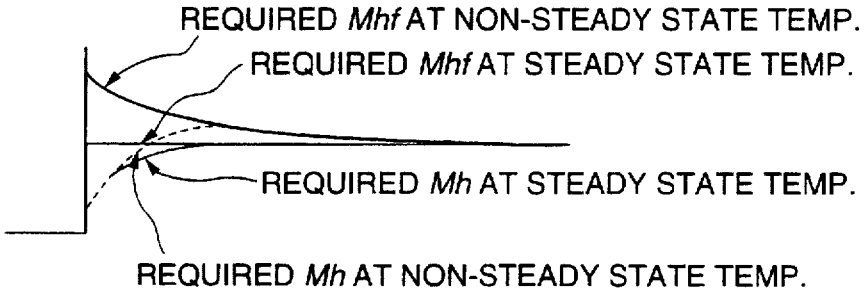
Figure 56C:
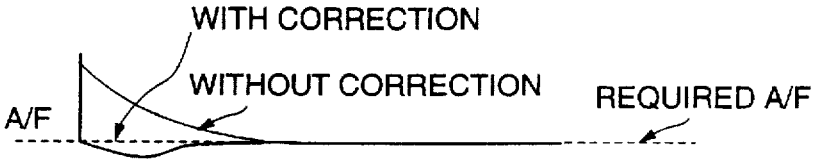
Figure 56D:
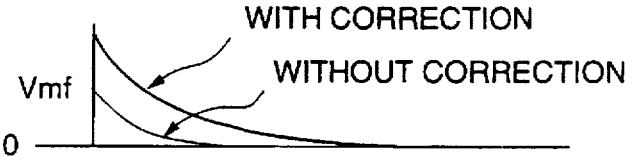

In FIGS. 56C and 56D, the thin solid lines show characteristics of Tokkai-Hei 3-134237 of the aforesaid prior art, and the solid lines show characteristics according to the ninth embodiment when the correction factors Mfhas, Kmfas are applied.

In the prior art, Mfh is calculated under steady state temperature conditions using Twf, and Mfh in the non-steady temperature state is insufficient. Further, there is a delay in the variation of the deposition amount Mf calculated from Kmf using Twf compared to the actual deposition amount variation in the non-steady temperature state. Consequently, the deposition rate Vmf is insufficient in the non-steady temperature state, and the air-fuel ratio immediately after startup tends towards lean as shown in FIG. 56C.

According to the ninth embodiment, a correction is applied, using the correction factors Mfhas, Kmfas for the non-steady temperature state, to Mfh and Kmf which are obtained using Twf instead of Tw. As a result, the steady state deposition amount Mfh is corrected by Mfhas to be larger than the steady state deposition amount in the steady temperature state. Likewise, the quantity proportion Kmf is corrected by Kmfas to be larger than the response characteristic of Mf in the steady temperature state. Therefore, Mfh and Mf both satisfy requirements for the non-steady temperature state, and Vmf approaches the required value for the non-steady temperature state. Overleanness of the air-fuel ratio immediately after engine startup can thus be prevented.

As shown in FIG. 54, there is a case where Kmfas is less than 1. Even in this case, the response of Mf is more rapid due to Mfh increased by Mfhas. In practice, immediately after startup, a large amount of fuel becomes intake port wall flow and Mf does vary rapidly.

However when a correction is applied using only Mfhas and Kmfas, during the first half of acceleration in the non-steady temperature state the air-fuel ratio is flat, but during the latter half the air-fuel ratio is lean as shown in FIGS. 62A–62F.

To deal with this problem, according to the ninth embodiment, the unburnt fraction correction coefficient Kub is introduced. The target air-fuel ratio coefficient Tfbya is corrected by this unburnt fraction correction coefficient Kub, and the steady state deposition amount Mfh is computed using this corrected Tfbya as a parameter.

When a correction is made only by correction factors, the effect of the unburnt fraction in the non-steady temperature state is corrected only by Kathos, as shown in FIGS. 63A–63F. Therefore, even if the air-fuel ratio during the first half of acceleration in the non-steady temperature state is flat, the air-fuel ratio in the latter half of acceleration in the non-steady temperature state tends to lean.

Figures 63A, 63B, 63C, 63D, 63E, 63F:
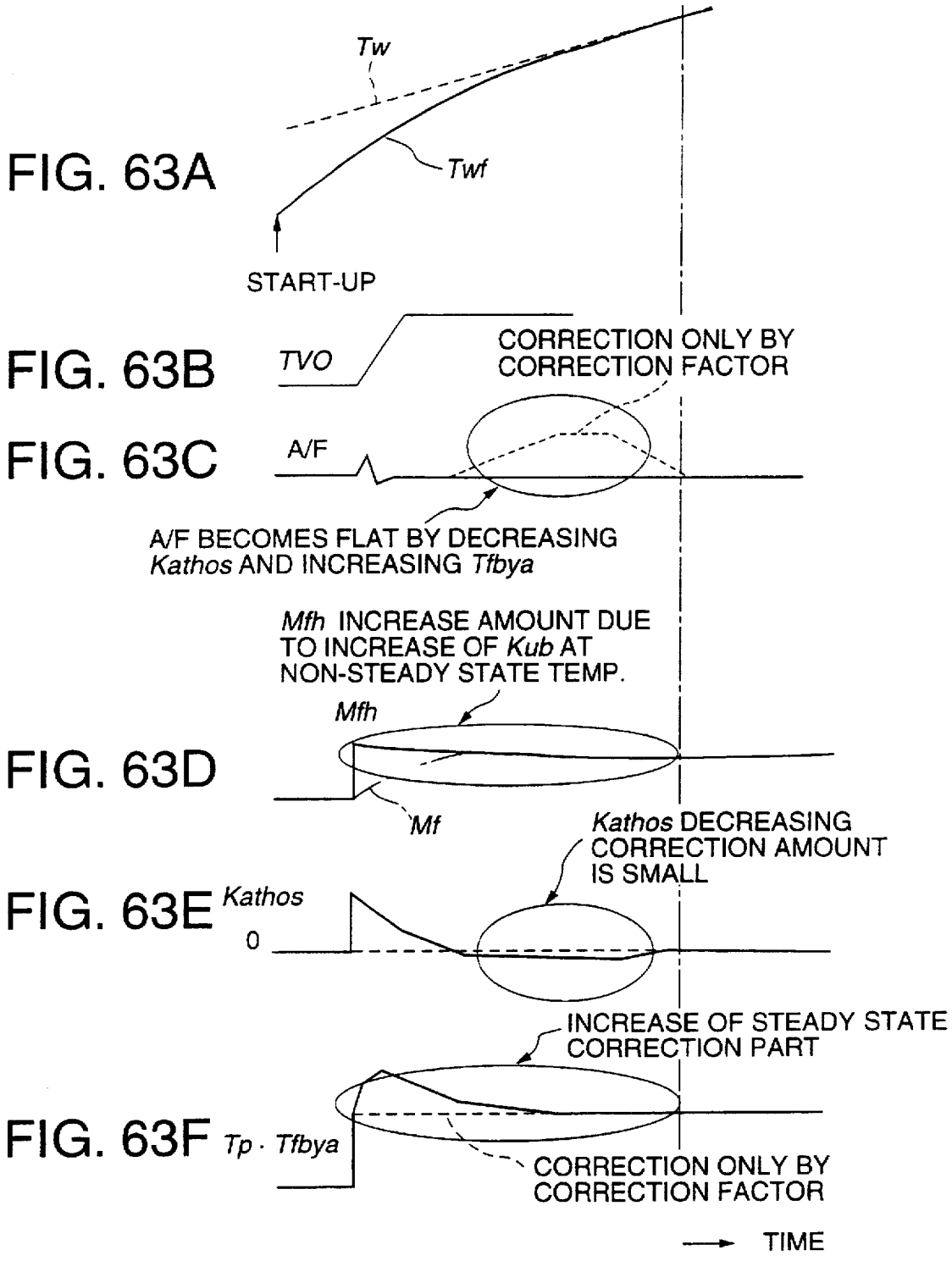
FIGS. 63A–63F are timing charts during acceleration for describing the result of correction by the correction factor and an unburnt fraction, according to the ninth embodiment.
Figures 64A, 64B, 64C, 64D:
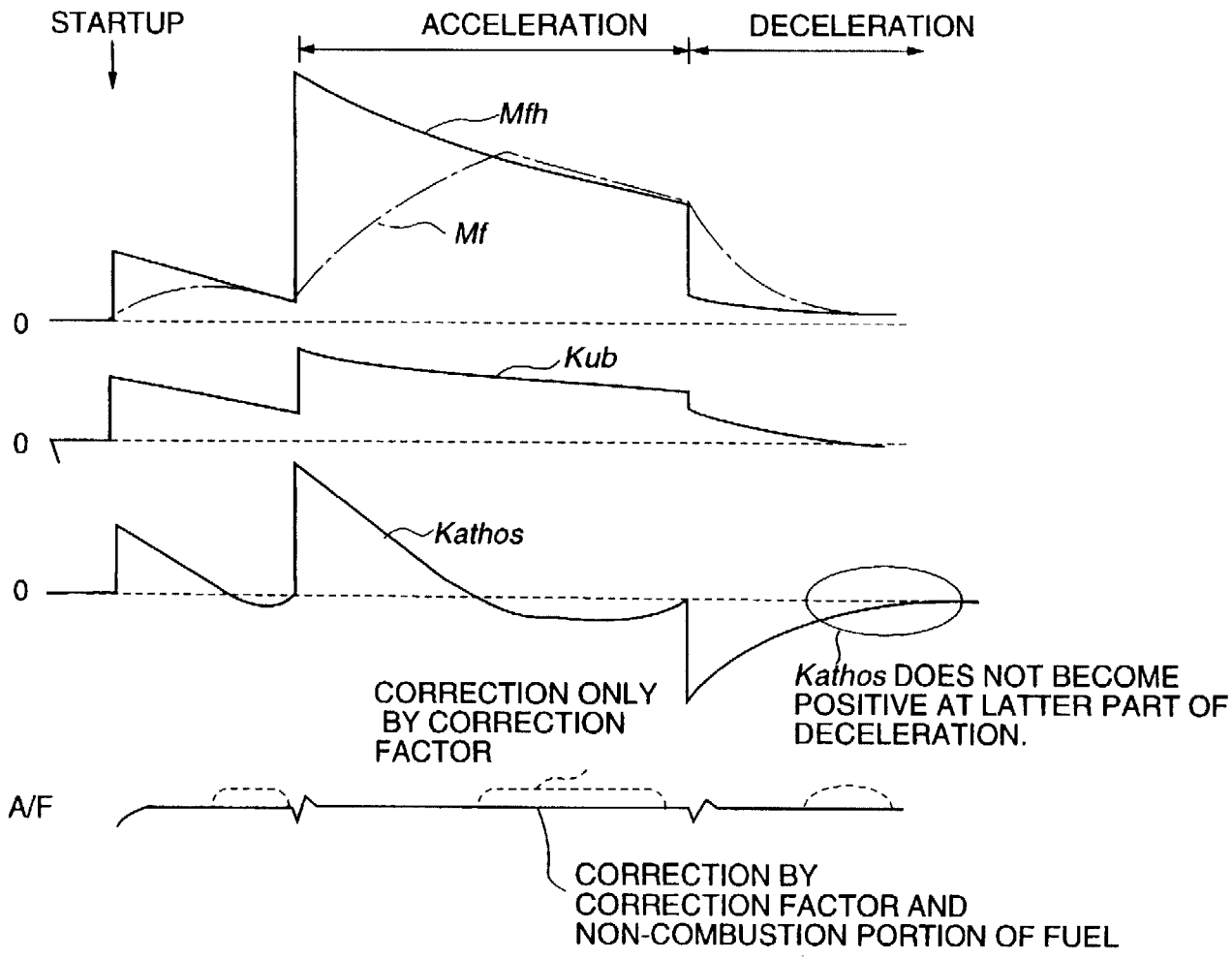
FIGS. 64A–64D are timing charts during acceleration and deceleration describing the result of correction by the correction factor and an unburnt fraction, according to the ninth embodiment.

According to the ninth embodiment, Tfbya is increased by the basic value Kub0 of the unburnt fraction correction coefficient according to the temperature difference Dtw, so Mfh decreases due to increase of the steady state injection amount specified by Tp.Tfbya. As a result, fuel increase due to Kathos in the first half of acceleration in the non-steady temperature state is suppressed. By reducing the increase due to Kathos in the first half of acceleration in the non-steady temperature state in this way, the decrease due to Kathos in the latter half of acceleration in the non-steady temperature state is also reduced. At the same time, by performing an unburnt fraction correction depending on the non-steady temperature state, the decrease due to Kathos is absorbed by the increase of Tp.Tfbya, and the air-fuel ratio flattens out from cold startup to when a steady state temperature is attained, as shown in FIG. 63C.

In other words, according to this embodiment, an unburnt fraction correction is applied to the steady state injection amount by adding the basic value Kub0 of the unburnt fraction correction coefficient Kub to the target air-fuel ratio coefficient Tfbya. Further, by computing Mfh according to Tfbya to which Kub0 has been added, an unburnt fraction correction is also applied to the transient correction amount. Thus, the unburnt fraction correction is considered as a steady state injection amount and a transient correction amount. As a result, according to the ninth embodiment, the steady state correction amount and transient correction amount may be set allowing for the effect of the unburnt fraction in the non-steady temperature state when the temperature largely fluctuates. Consequently, the air-fuel ratio may be maintained flat from cold startup to when the temperature reaches the steady state.

For deceleration in the non-steady temperature state, the characteristics of the behavior are slightly different from those of acceleration. Considering that this situation is the opposite of acceleration in the non-steady temperature state, it might be expected that the air-fuel ratio becomes too rich in the latter half of deceleration in the non-steady temperature state, but it does not. In the latter half of deceleration in the non-steady temperature state, the air-fuel ratio tends towards lean. This is due to the fact that Mfh during deceleration in the non-steady temperature state becomes larger than in the steady temperature state, as shown in FIG. 64A–64D. In other words, Kathos>0 does not occur in the latter half of deceleration, i.e. during deceleration only a decrease correction is made. This tendency of the air-fuel ratio to lean during the latter half of deceleration in the non-steady temperature state is also prevented by the unburnt fraction correction of this invention.

Even when Kub is not introduced into the air-fuel ratio correction, the tendency of the air-fuel ratio to lean during the latter half of deceleration in the non-steady temperature state can still be prevented by suitably setting Kmf during deceleration in the non-steady temperature state.

Further, as the basic value Kub0 of the unburnt fraction correction coefficient is set depending on a predetermined cooling water temperature, engine load and rotation speed, the value of Kub0 is unsuitable for a different cooling water temperature, engine load and rotation speed. However according to the ninth embodiment, the basic value Kub0 is corrected by Kubas so that the basic value Kub0 becomes smaller the higher the cooling water temperature compared to the set value, so even at a cooling water temperature different from the set value, the unburnt fraction correction coefficient Kub can be calculated with high precision.

Likewise, the basic value Kub0 is arranged to be smaller the smaller the engine load Tp, and to be smaller the more the engine rotation speed Ne increases. Hence even at a load and rotation speed different from the set conditions, the unburnt fraction correction coefficient Kub can be precisely calculated.

Figure 65:
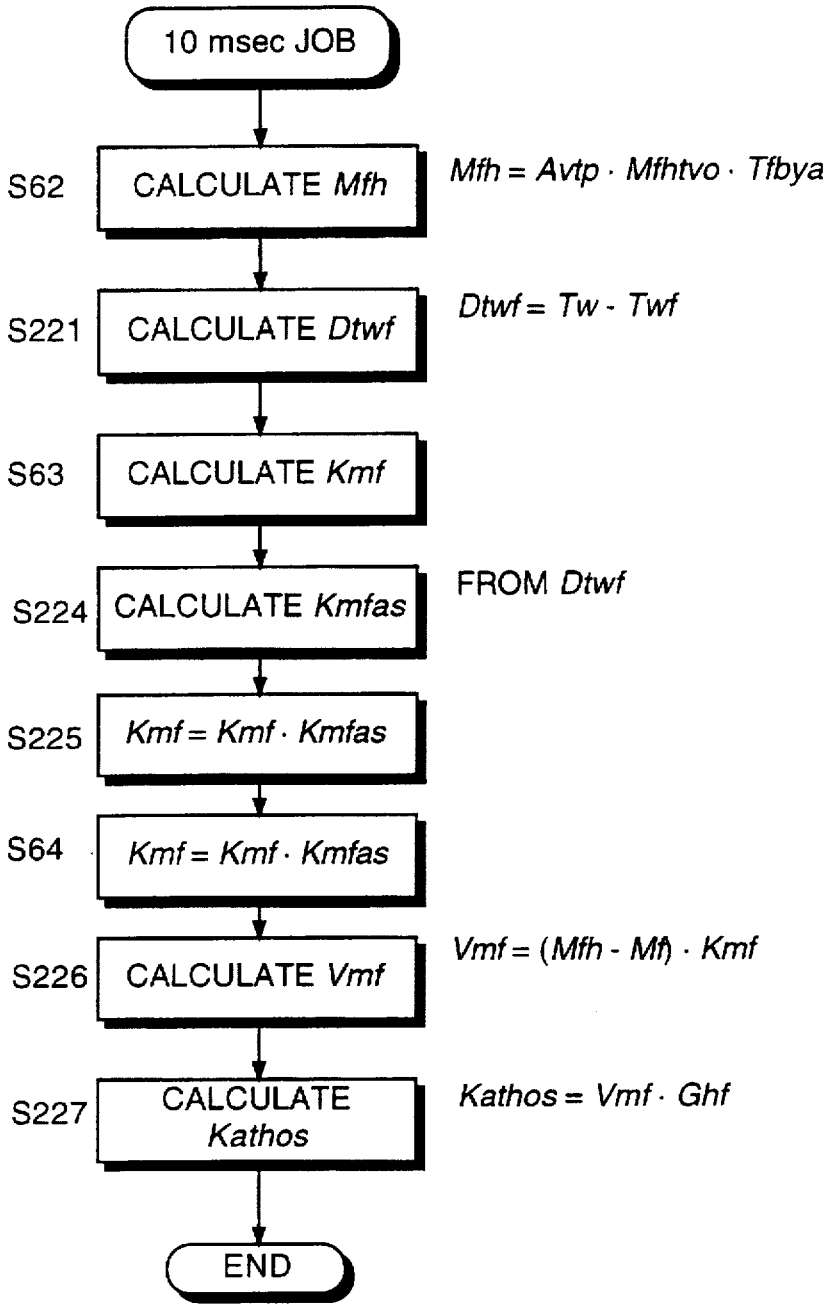
FIG. 65 is similar to FIG. 50, but showing a tenth embodiment of this invention.

FIG. 65 shows a tenth embodiment of this invention.

This flowchart corresponds to the flowchart of FIG. 50 of the aforesaid ninth embodiment.

The difference from the process of FIG. 50 is that only Kmf is corrected by the correction factor Kmfas in the non-steady temperature state, and the correction of the steady state deposition amount Mfh by the correction factor Mfhas in the steps S222, S223 is omitted.

As described for the ninth embodiment, in the non-steady temperature state, the steady state deposition amount Mfh is increased by the unburnt fraction correction coefficient Kub via the target air-fuel ratio coefficient Tfbya. Therefore, even when the steady state injection amount (Tp.Tfbya) is simply increased by the unburnt fraction correction coefficient via the target air-fuel ratio coefficient Tfbya, the same effect as that of the ninth embodiment is obtained.

Regarding correction factors, in addition to the correction factor Mfhas in the non-steady temperature state for the steady state deposition amount Mfh and the correction factor Kmfas in the non-steady temperature state for the quantity proportion Kmf, a correction factor Vmfas for the non-steady temperature state may also be introduced for the deposition rate Vmf.

Also, instead of setting tables of Mfhas, Kmfas, Vmfas using the temperature difference Dtwf as a parameter, they may set using Tw, Twf or the startup water temperature as a parameter. Further, apart from the temperature difference Dtwf, Mfhas, Kmfas, Vmfas may be set using engine load as a parameter.

The ninth and tenth embodiments are based on Tokugan-Hei 8-172361 filed on Jul. 2, 1996 to the Japanese Patent Office.

The embodiments of this invention in which an exclusive property or privilege is claimed are defined as follows:

1. An air-fuel ratio controller for feedback controlling an air-fuel ratio of fuel and air supplied to an engine to a target air-fuel ratio, said engine having a cylinder in which said fuel and air are burned, a fuel injection valve for supplying fuel to said cylinder and a fuel deposition part on which fuel injected from said fuel injection valve temporarily deposits before reaching said cylinder, said controller comprising:

means for computing a basic injection amount of said fuel injection valve, means for detecting an engine running condition, means for computing a target air-fuel ratio corresponding amount according to said engine running condition, means for computing a steady state deposition amount of injected fuel depositing on said deposition part based on said engine running condition, means for correcting said steady state deposition amount according to said target air-fuel ratio corresponding amount, means for computing a quantity proportion based on said engine running condition, means for storing a deposition amount of injected fuel depositing on said fuel deposition part, means for computing a difference between said steady state deposition amount and said stored deposition amount, means for computing a deposition rate based on said difference and said quantity proportion, first correcting means for correcting said basic injection amount by said target air-fuel ratio corresponding amount, second correcting means for correcting a correction value of said first correcting means based on said deposition rate, means for supplying a specific quantity of fuel to said fuel injection valve with a predetermined timing, said specific quantity being obtained based on a value corrected by said second correcting means, and means for updating said deposition amount stored by said storing means by adding said deposition rate to said deposition amount.

2. An air-fuel ratio controller as defined in claim 1, wherein said first correcting means corrects said basic injection amount by multiplying said target air-fuel ratio corresponding amount by said basic injection amount.

3. An air-fuel ratio controller as defined in claim 2, wherein said running condition comprises engine load, engine rotation speed and engine temperature, said steady state deposition amount computing means comprises means for computing a steady state deposition amount corresponding to a stoichiometric air-fuel ratio based on engine load, engine rotation speed and engine temperature, and said steady state deposition amount correcting means comprises means for correcting the steady state deposition amount by multiplying a steady state deposition amount corresponding to the stoichiometric air-fuel ratio by said target air-fuel ratio corresponding amount.

4. An air-fuel ratio controller as defined in claim 3, wherein said steady state deposition amount computing means comprises means for calculating a steady state deposition rate corresponding to said stoichiometric air-fuel ratio based on engine load, engine rotation speed and engine temperature, and means for calculating a steady state deposition amount corresponding to said stoichiometric air-fuel ratio from the product of said steady state deposition rate and said basic injection amount.

5. An air-fuel ratio controller as defined in claim 2, wherein said running condition comprises engine load, engine rotation speed and engine temperature, said steady state deposition amount computing means comprises means for calculating the steady state deposition amount corresponding to said stoichiometric air-fuel ratio based on engine load, engine rotation speed and engine temperature, and said steady state deposition amount correcting means comprises means for computing a gain having said target air-fuel ratio corresponding amount as a parameter, and means for correcting said steady state deposition amount by multiplying the steady state deposition amount corresponding to said stoichiometric air-fuel ratio by said gain.

6. An air-fuel ratio controller as defined in claim 5, wherein said gain computing means computes said gain by multiplying a coefficient having a value which is different when said target air-fuel ratio corresponding amount gives an air-fuel ratio on the rich side and when said target air-fuel ratio corresponding amount gives an air-fuel ratio on the lean side, by said target air-fuel ratio corresponding amount.

7. An air-fuel ratio controller as defined in claim 5, wherein said steady state deposition amount computing means comprises means for calculating a steady state deposition rate corresponding to said stoichiometric air-fuel ratio based on engine load, engine rotation speed and engine temperature, and means for calculating a steady state deposition amount corresponding to said stoichiometric air-fuel ratio from the product of said steady state deposition rate and said basic injection rate.

8. An air-fuel ratio controller as defined in claim 1, wherein said running condition comprises engine load, engine rotation speed and engine temperature, and said quantity proportion computing means comprises means for calculating a quantity proportion based on engine load, engine rotation speed and engine temperature.

9. An air-fuel ratio controller as defined in claim 1, further comprising means for storing a deposition rate on each fuel injection, means for computing a deposition rate difference between a deposition rate stored in an immediately preceding fuel injection and a deposition rate computed by said deposition rate computing means, means for computing a response gain of said second correcting means, and third correcting means for correcting a value corrected by said second correcting means based on said deposition rate difference and response gain so as to obtain said specific quantity.

10. An air-fuel ratio controller as defined in claim 9, further comprising means for prohibiting correction by said third correcting means when said deposition rate is positive but decreasing.

11. An air-fuel ratio controller as defined in claim 9, further comprising means for prohibiting correction by said third correcting means when said deposition rate is negative but increasing towards zero.

12. An air-fuel ratio controller as defined in claim 1, further comprising means for storing a value corrected by said first correcting means on each fuel injection, means for computing a correction value difference between a value corrected by said first correcting means in an immediately preceding fuel injection and a value corrected by said first correcting means in a present fuel injection, means for computing a response gain of said second correcting means, and third correcting means for correcting a value corrected by said second correcting means based on said correction value difference and said response gain.

13. An air-fuel ratio controller as defined in claim 12, further comprising means for prohibiting correction by said third correcting means when said deposition rate is positive but decreasing.

14. An air-fuel ratio controller as defined in claim 12, further comprising means for prohibiting correction by said third correcting means when said deposition rate is negative but increasing towards zero.

15. An air-fuel ratio controller for feedback controlling an air-fuel ratio of fuel and air supplied to an engine to a target air-fuel ratio, said engine having a plurality of cylinders in which said fuel and air are burned, a fuel injection valve for supplying fuel to said cylinders and a fuel deposition part on which fuel injected from said fuel injection valve temporarily deposits before reaching said cylinder, said controller comprising:

means for computing a basic injection amount of said fuel injection valve, means for detecting an engine running condition, means for computing a target air-fuel ratio corresponding amount according to said engine running condition, means for computing a steady state deposition amount of injected fuel depositing on said deposition part based on said engine running condition, means for correcting said steady state deposition amount according to said target air-fuel ratio corresponding amount, means for computing a quantity proportion based on said engine running condition, means for storing a deposition amount of injected fuel depositing on said fuel deposition part, means for computing a difference between said steady state deposition amount and said stored deposition amount, means for computing a deposition rate based on said difference and said quantity proportion, first correcting means for correcting said basic injection amount by said target air-fuel ratio corresponding amount, second correcting means for correcting a correction value of said first correcting means based on said deposition rate, means for storing said deposition rate, means for computing a deposition rate difference between a deposition rate in an immediately preceding fuel injection and a deposition rate computed by said deposition rate computing means, means for computing a response gain of said second correcting means, third correcting means for correcting a value corrected by said second correcting means based on said deposition rate difference and response gain, means for supplying a specific quantity of fuel to said fuel injection valve with a predetermined timing, said specific quantity corresponding to a value corrected by said third correcting means, means for updating a deposition amount stored by said deposition amount storing means by adding said deposition rate computed by said deposition rate computing means to said stored deposition amount, means for cutting fuel injection to a specific cylinder under a predetermined condition, means for predicting a deposition amount which decreases due to fuel injection cut, recovery means for restarting fuel injection under a predetermined condition in said specific cylinder, and means for updating said deposition rate stored in said deposition rate storing means by a value obtained by multiplying said quantity proportion by the difference between a deposition amount stored by said deposition amount storing means and a deposition amount predicted by said predicting means, when said recovery means resumes fuel injection in said specific cylinder.

16. An air-fuel ratio controller for feedback controlling an air-fuel ratio of fuel and air supplied to an engine to a target air-fuel ratio, said engine having a plurality of cylinders in which said fuel and air are burned, a fuel injection valve for supplying fuel to said cylinders and a fuel deposition part on which fuel injected from said fuel injection valve temporarily deposits before reaching said cylinder, said controller comprising:

means for computing a basic injection amount of said fuel injection valve, means for detecting an engine running condition, means for computing a target air-fuel ratio corresponding amount according to said engine running condition, means for computing a steady state deposition amount of injected fuel depositing on said deposition part based on said engine running condition, means for correcting said steady state deposition amount according to said target air-fuel ratio corresponding amount, means for computing a quantity proportion based on said engine running condition, means for storing a deposition amount of injected fuel depositing on said fuel deposition part, means for computing a difference between said steady state deposition amount and said stored deposition amount, means for computing a deposition rate based on said difference and said quantity proportion, first correcting means for correcting said basic injection amount by said target air-fuel ratio corresponding amount, second correcting means for correcting a correction value of said first correcting means based on said deposition rate, means for supplying a specific quantity of fuel to said fuel injection valve with a predetermined timing, said specific quantity corresponding to a value corrected by said second correcting means, means for updating a deposition amount stored by said storing means by adding said deposition rate to said deposition amount, means for cutting fuel injection in all cylinders under a predetermined condition, recovery means for restarting fuel injection in all cylinders under a predetermined condition, means for setting said target air-fuel ratio corresponding amount to zero when fuel injection is cut in all cylinders, means for setting said steady state deposition amount to zero when fuel injection is cut in all cylinders, and means for computing a deposition rate based on said stored deposition amount and a preset quantity proportion when fuel injection is cut in all cylinders.

17. An air-fuel ratio as defined in claim 16, further comprising means for setting said preset quantity proportion based on a decrease proportion of a deposition amount when fuel injection is cut in a specific cylinder.

18. An air-fuel ratio controller for feedback controlling an air-fuel ratio of fuel and air supplied to an engine to a target air-fuel ratio, said engine having a plurality of cylinders in which said fuel and air are burned, a fuel injection valve for supplying fuel to said cylinders and a fuel deposition part on which fuel injected from said fuel injection valve temporarily deposits before reaching said cylinder, said controller comprising:

means for computing a basic injection amount of said fuel injection valve, means for detecting an engine running condition, means for computing a target air-fuel ratio corresponding amount according to said engine running condition, means for computing a steady state deposition amount of injected fuel depositing on said deposition part based on said engine running condition, means for correcting said steady state deposition amount according to said target air-fuel ratio corresponding amount, means for computing a quantity proportion based on said engine running condition, means for storing a deposition amount of injected fuel depositing on said fuel deposition part, means for computing a difference between said steady state deposition amount and said stored deposition amount, means for computing a deposition rate based on said difference and said quantity proportion, first correcting means for correcting said basic injection amount by said target air-fuel ratio corresponding amount, second correcting means for correcting a correction value of said first correcting means based on said deposition rate, means for storing said deposition rate, means for computing a deposition rate difference between a deposition rate in an immediately preceding fuel injection and a deposition rate computed by said deposition rate computing means, means for computing a response gain of said second correcting means, third correcting means for correcting a value corrected by said second correcting means based on said deposition rate difference and response gain, means for supplying a specific quantity of fuel to said fuel injection valve with a predetermined timing, said specific quantity corresponding to a value corrected by said third correcting means, means for updating a deposition amount stored by said deposition amount storing means by adding said deposition rate computed by said deposition rate computing means to said stored deposition amount, means for cutting fuel injection in all cylinders under a predetermined condition, recovery means for restarting fuel injection in all cylinders under a predetermined condition, means for setting said target air-fuel ratio corresponding amount to zero when fuel injection is cut in all cylinders, means for setting said steady state deposition amount to zero when fuel injection is cut in all cylinders, and means for computing a deposition rate based on said stored deposition amount and a preset quantity proportion when fuel injection is cut in all cylinders.

19. An air-fuel ratio controller as defined in claim 18, further comprising means for setting said preset quantity proportion based on a decrease proportion of the deposition amount when fuel injection is cut in a specific cylinder.

20. An air-fuel ratio controller for feedback controlling an air-fuel ratio of fuel and air supplied to an engine to a target air-fuel ratio, said engine having a cylinder in which said fuel and air are burned, a fuel injection valve for supplying fuel to said cylinder and an intake valve on which fuel injected from said fuel injection valve temporarily deposits before reaching said cylinder, said controller comprising:

means for computing a basic injection amount of said fuel injection valve, means for detecting an engine running condition, means for computing a target air-fuel ratio corresponding amount according to said engine running condition, means for detecting an engine cooling water temperature, means for estimating an intake valve temperature based on said cooling water temperature, means for storing a map of a steady state fuel deposition amount on said intake valve set according to a cooling water temperature in a steady temperature state of said engine, means for calculating a steady state deposition amount by looking up said map of steady state deposition amount based on said intake valve temperature, means for computing a steady state deposition correction amount in the non-steady temperature state based on a temperature difference between the cooling water temperature and intake valve temperature, means for correcting said steady state deposition amount based on said steady state correction amount, means for computing a quantity proportion based on said intake valve temperature, means for computing a deposition rate based on said steady state deposition amount after correction and said quantity proportion, means for computing an unburnt fraction correction amount based on said temperature difference, means for correcting said target air-fuel ratio corresponding amount according to said unburnt fraction correction amount, means for computing a fuel injection amount based on said basic fuel injection amount, said target air-fuel ratio corresponding amount after correction and said deposition rate, and means for supplying fuel corresponding to said computed fuel injection amount to said fuel injection valve.

21. An air-fuel ratio controller for feedback controlling an air-fuel ratio of fuel and air supplied to an engine to a target air-fuel ratio, said engine having a cylinder in which said fuel and air are burned, a fuel injection valve for supplying fuel to said cylinder and an intake valve on which fuel injected from said fuel injection valve temporarily deposits before reaching said cylinder, said controller comprising:

means for computing a basic injection amount of said fuel injection valve, means for detecting an engine running condition, means for computing a target air-fuel ratio corresponding amount according to said engine running condition, means for detecting an engine cooling water temperature, means for estimating an intake valve temperature based on said cooling water temperature, means for computing a steady state deposition amount of fuel on said intake valve based on said intake valve temperature, means for storing a map of a quantity proportion set according to the cooling water temperature in a steady engine temperature state, means for calculating a quantity proportion by looking up said map of steady state deposition amount based on said intake valve temperature, means for computing a quantity proportion correction amount in a non-steady temperature state based on a temperature difference between said cooling water temperature and said intake valve temperature, means for correcting said quantity proportion based on said quantity proportion correction amount, means for computing a deposition rate based on said steady state deposition amount and said quantity proportion after correction, means for computing an unburnt fraction correction amount based on said temperature difference, means for correcting said target air-fuel ratio corresponding amount according to said unburnt fraction correction amount, means for computing a fuel injection amount based on said basic fuel injection amount, said target air-fuel ratio corresponding amount after correction and said deposition rate, and means for supplying fuel corresponding to said computed fuel injection amount to said fuel injection valve.

22. An air-fuel ratio controller for feedback controlling an air-fuel ratio of fuel and air supplied to an engine to a target air-fuel ratio, said engine having a cylinder in which said fuel and air are burned, a fuel injection valve for supplying fuel to said cylinder and an intake valve on which fuel injected from said fuel injection valve temporarily deposits before reaching said cylinder, said controller comprising:

means for computing a basic injection amount of said fuel injection valve, means for detecting an engine running condition, means for computing a target air-fuel ratio corresponding amount according to said engine running condition, means for detecting an engine cooling water temperature, means for estimating an intake valve temperature based on said cooling water temperature, means for computing a steady state deposition amount of fuel on said intake valve based on said intake valve temperature, means for computing a quantity proportion based on said intake valve temperature, means for computing a deposition rate based on said steady state deposition amount and said quantity proportion, means for computing a deposition rate correction amount in a non-steady temperature state based on a temperature difference between said cooling water temperature and said intake valve temperature, means for correcting said deposition rate based on said deposition rate correction amount, means for computing an unburnt fraction correction amount based on said temperature difference, means for correcting said target air-fuel ratio corresponding amount according to said unburnt fraction correction amount, means for computing a fuel injection amount based on said basic fuel injection amount, said target air-fuel ratio corresponding amount after correction and said deposition rate after correction, and means for supplying fuel corresponding to said computed fuel injection amount to said fuel injection valve.

23. An air-fuel ratio controller for feedback controlling an air-fuel ratio of fuel and air supplied to an engine to a target air-fuel ratio, said engine having a cylinder in which said fuel and air are burned, a fuel injection valve for supplying fuel to said cylinder and an intake valve on which fuel injected from said fuel injection valve temporarily deposits before reaching said cylinder, said controller comprising:

means for computing a basic injection amount of said fuel injection valve, means for detecting an engine running condition, means for computing a target air-fuel ratio corresponding amount according to said engine running condition, means for detecting an engine cooling water temperature, means for estimating an intake valve temperature based on said cooling water temperature, means for computing a steady state deposition amount of fuel on said intake valve based on said cooling water temperature, means for computing a steady state correction amount in a non-steady temperature state based on a temperature difference between said cooling water temperature and said intake valve temperature, means for correcting said steady state deposition amount based on said steady state deposition correction amount, means for computing a quantity proportion based on said cooling water temperature, means for computing a deposition rate based on said steady state deposition amount after correction and said quantity proportion, means for computing an unburnt fraction correction amount based on said temperature difference, means for correcting said target air-fuel ratio corresponding amount according to said unburnt fraction correction amount, means for computing a fuel injection amount based on said basic fuel injection amount, said target air-fuel ratio corresponding amount after correction and said deposition rate, and means for supplying fuel corresponding to said computed fuel injection amount to said fuel injection valve.

24. An air-fuel ratio controller feedback controlling an air-fuel ratio of fuel and air supplied to an engine to a target air-fuel ratio, said engine having a cylinder in which said fuel and air are burned, a fuel injection valve for supplying fuel to said cylinder and an intake valve on which fuel injected from said fuel injection valve temporarily deposits before reaching said cylinder, said controller comprising:

means for computing a basic injection amount of said fuel injection valve, means for detecting an engine running condition, means for computing a target air-fuel ratio corresponding amount according to said engine running condition, means for detecting an engine cooling water temperature, means for estimating an intake valve temperature based on said cooling water temperature, means for computing a steady state deposition amount of fuel on said intake valve based on said cooling water temperature, means for computing a quantity proportion based on said cooling water temperature, means for computing a quantity proportion correction amount in a non-steady temperature state based on a temperature difference between said cooling water temperature and said intake valve temperature, means for correcting said quantity proportion based on said quantity proportion correction amount, means for computing a deposition rate based on said steady state deposition amount and said quantity proportion after correction, means for computing an unburnt fraction correction amount based on said temperature difference, means for correcting said target air-fuel ratio corresponding amount according to said unburnt fraction correction amount, means for computing a fuel injection amount based on said basic fuel injection amount, said target air-fuel ratio corresponding amount after correction and said deposition rate, and means for supplying fuel corresponding to said computed fuel injection amount to said fuel injection valve.

25. An air-fuel ratio controller for feedback controlling an air-fuel ratio of fuel and air supplied to an engine to a target air-fuel ratio, said engine having a cylinder in which said fuel and air are burned, a fuel injection valve for supplying fuel to said cylinder and an intake valve on which fuel injected from said fuel injection valve temporarily deposits before reaching said cylinder, said controller comprising:

means for computing a basic injection amount of said fuel injection valve, means for detecting engine an engine running condition, means for computing a target air-fuel ratio corresponding amount according to said engine running condition, means for detecting an engine cooling water temperature, means for estimating an intake valve temperature based on said cooling water temperature, means for computing a steady state deposition amount of fuel on said intake valve based on said cooling water temperature, means for computing a quantity proportion based on said cooling water temperature, means for computing a deposition rate based on said steady state deposition amount and said quantity proportion, means for computing a deposition rate correction amount in a non-steady temperature state based on a temperature difference between said cooling water temperature and said intake valve temperature, means for correcting said deposition rate based on said deposition rate correction amount, means for computing an unburnt fraction correction amount based on said temperature difference, means for correcting said target air-fuel ratio corresponding amount according to said unburnt fraction correction amount, means for computing a fuel injection amount based on said basic fuel injection amount, said target air-fuel ratio corresponding amount after correction and said deposition rate after correction, and means for supplying fuel corresponding to said computed fuel injection amount to said fuel injection valve.

* * * * *